US006978627B2

(12) United States Patent
Masui et al.

(10) Patent No.: US 6,978,627 B2
(45) Date of Patent: Dec. 27, 2005

(54) AIR CONDITIONER CONTROL SYSTEM, CENTRAL REMOTE CONTROLLER, AND FACILITY CONTROLLER

(75) Inventors: Hirotaka Masui, Tokyo (JP); Shinji Hattori, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/330,157

(22) Filed: Dec. 30, 2002

(65) Prior Publication Data

US 2003/0140637 A1 Jul. 31, 2003

(30) Foreign Application Priority Data

Jan. 31, 2002 (JP) ..... 2002-022993
Jun. 19, 2002 (JP) ..... 2002-178894
Jun. 20, 2002 (JP) ..... 2002-180417

(51) Int. Cl.[7] ..... F25B 49/02; F24F 11/02
(52) U.S. Cl. ..... 62/127; 62/175; 236/51
(58) Field of Search ..... 62/175, 126, 127, 62/129, 130, 231; 236/51; 165/207, 209; 700/277

(56) References Cited

U.S. PATENT DOCUMENTS 5,435,147 A * 7/1995 Mochizuki et al. ..... 236/51
6,502,411 B2 * 1/2003 Okamoto ..... 236/51
2001/0048376 A1 12/2001 Maeda et al. ..... 340/870.17

FOREIGN PATENT DOCUMENTS

EP 0 704 659 4/1996
JP 2000-266390 9/2000
JP 2001-324204 11/2001

OTHER PUBLICATIONS

Savas; Computer Control of Industrial Processes p. 13-15, Mar. 1966.*
Patent Abstracts of Japan, JP 7-248146, Sep. 26, 1995.*

* cited by examiner

*Primary Examiner*—Harry B. Tanner
(74) *Attorney, Agent, or Firm*—Oblon, Spivak, McClelland, Maier & Neustadt, P.C.

(57) ABSTRACT

An operation information processing section (11) in a central remote controller (5) processes operation information from operation setting buttons (8*a*,8*b*,8*c*), each of which is independent in function, transmits the operation information through a transmission line (6), and generates screen information based on the operation information collected through the transmission line (6), and display the screen information on a display unit (9). A management information processing section (12*a*) generates screen information based on operation information of the air conditioners (1,2) collected through the transmission line (6) and transmits the screen information to the remote monitor terminal (15) through a transmission line (13), and relays control information transmitted from the remote monitor terminal (15) through the transmission line (13), and transmits the control information to the air conditioners (1,2) through the transmission line (6).

38 Claims, 50 Drawing Sheets

FIG.2

| FUNCTION \ USER | | GENERAL USER | BUILDING ADMINISTRATOR | MAINTENANCE TECHNICIAN | SUPERVISOR |
|---|---|---|---|---|---|
| HOMEPAGE ADDRESS | | index.html | administrator.html | maintenance.html | ALL SCREENS ARE READABLE |
| PASSWORD | | guest (INITIAL VALUE) | admin (INITIAL VALUE) | mainte (INITIAL VALUE) | FORSERVICE |
| SCREEN MENU | OPERATION STATE | ○ | ○ | ○ | ○ |
| | SCHEDULE | × | ○ | ○ | ○ |
| | ABNORMAL STATE HISTORY | × | ○ | ○ | ○ |
| | SYSTEM SETTING | × | ○ | ○ | ○ |
| | MAINTENANCE | × | × | ○ | ○ |

○ : MONITABLE
× : NOT MONITABLE

FIG.11

MITSUBISHI Air Conditioner Control System-Microsoft Internet Explorer

File Edit View Favorites Tools Help

Back Serch Favorites History

Monitor/Operation Malfunction Log System Setting Maintenance

Before Malfunction Log Send Mail Log

316

Before Malfunction Log

| MODEL | MARK | CONTENT | UNIT | 1 | 2 | 3 | 4 |
|---|---|---|---|---|---|---|---|
| Y/SuperY | 63HS | High pressure sensor | kg/cm$^2$ | 20.2 | 20.2 | 20.2 | 20.2 |
| Y/SuperY | TH11 | COMP1 discharge temperature | degC | 78.8 | 78.8 | 78.9 | 78.6 |
| Y/SuperY | TH12 | COMP2 discharge temperature | degC | 101.6 | 101.6 | 101.6 | 101.6 |
| Y/SuperY | TH2 | Low pressure saturation temperature | degC | -1.6 | -1.7 | -1.6 | -1.7 |
| Y/SuperY | TH3 | Liquid level detection (Lower) | degC | 0.7 | 0.7 | 0.7 | 0.7 |
| Y/SuperY | TH4 | Liquid level detection (Upper) | degC | 6.5 | 6.5 | 6.5 | 6.5 |
| Y/SuperY | TH5 | Liquid pipe temperature | degC | 8.9 | 8.9 | 8.8 | 8.9 |
| Y/SuperY | TH6 | Outdoor temperature | degC | 14.3 | 14.3 | 14.3 | 14.3 |
| Y/SuperY | TH7 | Subcool coil outlet temperature | degC | 59.4 | 59.4 | 59.4 | 59.4 |
| Y/SuperY | TH8 | Subcool coil bypass outlet temperature | degC | -12.7 | -12.7 | -12.7 | -12.7 |
| Y/SuperY | TH9 | Subcool coil bypass inlet temperature | degC | 5.6 | 5.6 | 5.6 | 5.6 |
| Y/SuperY | THHS | Inverter heat sink temperature | degC | 68.3 | 68.3 | 68.3 | 68.3 |
| Y/SuperY | AL | Accumulator level | xx | 2 | 2 | 2 | 2 |
| Y/SuperY | 63LS | Low pressure sensor | kg/cm$^2$ | 4.9 | 4.9 | 4.9 | 4.9 |
| Y/SuperY | AlphaOC | Circulating composition (R32) | xx | 0.333 | 0.335 | 0.333 | 0.333 |
| Y/SuperY | AlphaOC$^x$ | Circulating composition contorol value (R32) | xx | 0.3 | 0.3 | 0.3 | 0.3 |
| Y/SuperY | Tc | Condensation temperature | degC | 45.6 | 45.6 | 45.6 | 45.7 |

Back

Internet

AIR CONDITIONER CONTROL SYSTEM, CENTRAL REMOTE CONTROLLER, AND FACILITY CONTROLLER

BACKGROUND OF THE INVENTION

1. Field of the Invention

The present invention relates to an air conditioner control system, a central remote controller, and a facility controller for collecting information regarding operation states of air conditioners in the air conditioner control system and for remotely monitoring and controlling the air conditioners and facilities based on the information collected.

2. Description of the Related Art

FIG. 57 is a block diagram showing a configuration of a conventional air conditioner control system which has been disclosed in a Japanese laid-open publication number JP-A-2000-266390. In the diagram, reference characters 102*a*–102*c* designate a plurality of indoor units in the air conditioner control system and 101*a*–101*c* denote a plurality of outdoor units corresponding to the indoor units. The outdoor units 101*a*–101*c* and the corresponding indoor units 102*a*–102*c* form air conditioners in the air conditioner control system. Those outdoor units 101*a*–101*c* and the corresponding indoor units 102*a*–102*c* are controlled in operation using data items which are transferred through a transmission wiring 104. Reference characters 103*a*–103*c* indicate remote controllers, each controller controls the operation of the corresponding indoor unit. Reference 105 designates a central controller controlling the entire operation of the indoor units 102*a*–102*c*. The central controller 105 is connected to the air conditioners through the communication wiring 104 in order to control the operation of the indoor units 102*a*–102*c*. Reference number 106 denotes a facility controller as a building facility for transmitting and receiving data items, which is connected through the communication wiring 104 to the outdoor units 101*a*–101*c*, the indoor units 102*a*–102*c*, the remote controller 103*a*–103*c*, and the central controller 105. The facility controller 106 is connected to a public telephone network 108 through a modem 107 as a connector for the public telephone network 108.

Reference characters 110*a*–110*c* indicate remote monitor terminals for communicating with the facility controller 106 through the modems 109*a*–109*c* and the public telephone network 108 and editing data items regarding the current state of the air conditioners and displaying the data items edited.

By the way, the number of the outdoor units 101*a*–101*c*, the indoor units 102*a*–102*c*, the remote controllers 103*a*–103*c*, and the central controller 105 is not limited by the above case, and, of course, the number of the remote monitor terminals 110*a*–110*c* is also not limited.

FIG. 58 is a block diagram showing an internal configuration of the facility controller 106 in the conventional air conditioner control system disclosed in a Japanese laid-open publication number JP-A-2000-266390, like the configuration shown in FIG. 57. As shown in FIG. 58, the facility controller 106 monitors and controls the operation state of the outdoor units 101*a*–101*c* and the indoor units 102*a*–102*c*. The facility controller 106 comprises a microcomputer 121, a communication means 122, a public telephone network communication means 123, a spot adjustment means 124, a display means 125, and a searching instruction means 126. The microcomputer 121 controls the entire operation of the facility controller 106. The communication means 122 communicates information with the air conditioners comprising the outdoor units 101*a*–101*c* and the indoor units 102*a*–102*c*, the remote controller 103*a*–103*c* and the central controller 105. The public telephone network communication means 123 converts data items in order to perform the communication between the facility controller 106 and the remote monitor terminals 110*a*–110*c* through the public telephone network 108 and the modems 107 and 109*a*–109*c*. Through the spot adjustment means 124 a user inputs system information regarding the current state of the air conditioner control system. The display means 125 informs the current state of the facility controller 106 and the state of the air conditioners to outside such as a user. The searching instruction means 126 is made up of switches which cause a trigger to execute the searching instruction stored in the facility controller 106.

The microcomputer 121 comprises a system information memory means 131, an operation state memory means 132, an address information comparison means 133, and a system information collecting means 134. The system information memory means 131 stores the system information of the air conditioner control system set by the spot adjustment means 124. The operation state memory means 132 stores the operation state of the air conditioners. The address information comparison means 133 compares the address information of the air conditioner control system set at the place where the outdoor units 101*a*–0101*c* and the indoor units 102*a*–102*c* are placed with the address information of the current time detected by the microcomputer 121. The system information collecting means 134 automatically collects the system information of each air conditioner in the air conditioner control system.

The central controller 105 is capable of controlling the operation of each air conditioner connected to the air conditioner control system using an inherent communication protocol. In general, because this type of the communication protocol is different from that of every manufacture of the air conditioners, the air conditioner control system is closed in its system configuration.

The facility controller 106 can communicate with the remote monitor terminals 110*a*–110*c* using each means shown in FIG. 58. However, the system information is available only within the system using the communication protocol. Therefore the air conditioner manufactured by another different manufacture cannot use this type of the communication protocol. Further, the facility controller 106 is separated in configuration from the central controller 105 which can communicate information with the air conditioners. The facility controller 106 is the dedicated equipment to be applicable only to the air conditioner control system comprising the outdoor units 101*a*–101*c* and the indoor units 102*a*–102*c*.

FIG. 59 is a block diagram showing a configuration of a conventional air conditioner control system of a large configuration where a plurality of outdoor units 101 and indoor units 102 are mounted. In FIG. 59, reference number 111 designates a supervision controller, one terminal of which is connected to the facility controller 106 and other terminal is connected to the modem 107. Other system components have the same configuration in the system shown in FIG. 57.

The supervision controller 111 collects the operation information transmitted from a plurality of the facility controllers 106 and transmits the operation information of the outdoor units 101*a*–101*c* and the indoor units 102*a*–102*c* to the remote monitor terminals 110*a*–110*c* through the public telephone network 108 and the modems 109*a*–109*c*.

FIG. 60 is a block diagram showing an internal configuration of the indoor unit controller 141 for the conventional indoor units 102*a*–102*c*. In FIG. 60, reference number 141 designates the indoor unit controller equipped in each of the indoor units 102*a*–102*c*. Reference number 142 denotes an indoor unit component, 143 indicates a facility device mounted in the air conditioner, and 144 designates transmission wiring connected to the facility device 143, through which the interior controller 141 controls the operation of the facility device 143.

In the indoor unit controller 141, reference number 151 indicates a central processing means, 152 denotes a transmission means, 153 indicates an input/output means connected to the component 142 of the indoor unit, and 154 designates an input/output means connected to the facility device 143. The indoor unit component 142 includes a fun motor, a temperature sensor of air at the inlet and the like forming each of the indoor units 102*a*–102*c*. The central processing means 151 executes a program stored previously in a memory (not shown) in order to control the operation of the component 142 through the input/output means 153.

The facility device 143 indicates additional devices such as a luminaire (lighting unit) and an operation switch for the indoor unit, different from the devices incorporated in the indoor unit in advance, set up outside thereof. Therefore a user operates and controls the facility device 143 according to the above program through the facility device input/output means 154 and the transmission wiring 144.

In a case where the user remotely controls the operation state of a facility device as an additional device and of the air conditioner control system, different from the case of the facility device 143 described above, the facility controller 106 and the supervision controller 111 are further mounted in order to collect information regarding the operation state of the facility device and the air conditioner control system and to transmit the information of the operation state to outside.

Because the conventional air conditioner control system has the configuration described above, the following drawbacks occur.

In general, the air conditioner control system uses a difference communication protocol corresponding to every manufacture. It is necessary to use the public telephone network 108 as a communication line when the user remotely controls the operation state of the air conditioners in the system at the place separated from the building where the air conditioners are mounted. The modem 107 includes a general-purpose communication means such as RS232C interface in order to connect the air conditioners to the public telephone network 108. Accordingly, the conventional air conditioner control system has to incorporate a converter for converting the dedicated communication protocol for the air conditioners to a communication protocol for the general-purpose communication means. This increases the cost of the air conditioner control system.

Because RS232C interface for communication through the modem 107 is one-to-one correspondence and the facility controller 106 is connected to only one modem 107, the number of the air conditioners in the system to be connected is thereby limited. When the user monitors the state of the air conditioner control system having a plurality of air conditioners through a display means, it is necessary to incorporate the supervision controller 111 into the air conditioner control system in order to connect a plurality of the facility controllers 106 to the modem 107. This increases the cost of the system and causes the limitation in location where the supervision controller 111 is placed.

When adding an air conditioner of a new type having a new function into the conventional air conditioner control system, it is necessary to change the contents of the programs in the facility controller 106 and the supervision controller 111 through which signals for the new functions added are transmitted between the remote monitor terminals 110*a*–110*c* and the remote controllers 103*a*–103*c* and the central controller 105. This increases the cost of the system and also the labor for maintenance.

Further, it is necessary to incorporate a dedicated program for the remote monitoring. Although there are many demands to use a personal computer (PC) as the remote monitor terminals 110*a*–110*c*, which can also perform paperwork, it is unknown whether or not adverse effect occurs when the personal computer as the remote monitor terminal executes both the dedicated program for the remote monitoring and the paperwork simultaneously. Accordingly, the conventional air conditioner control system has the drawback in which the remote monitor terminals 110*a*–110*c* are used only for the remote monitoring. Furthermore, when the air conditioner is replaced with new one or when the operation system of the personal computer as the remote monitor terminal is updated, it requires to change the programs. This increases the cost necessary for the change of the programs in addition to the cost of the new air conditioner.

In order to solve the drawback described above, there are following methods:

To use a Local Area Network (LAN) as a transmission medium, through which a plurality of devices can transmit data at a high speed, in order to construct the air conditioner control system without incorporating the supervision controller 111;

To incorporate the function of the facility controllers 106 into the central controllers 105 in order to reduce the cost and the labor of the facility controller 106 and wiring thereof; and To incorporate a browser software (or a computer program of a Web browser), for use in monitoring, into the remote monitoring terminals 110*a*–110*c* instead of the dedicated monitoring software and to generate a display window using the browser software and send it.

However, when the above function is incorporated in each central controller 105, it is necessary to incorporate a microcomputer of a high performance and a memory of a large size because LAN has to process a large amount of data items at a high speed. Therefore the cost of the air conditioner control system becomes expensive. In order to sale a high-priced air conditioner control system, the system must include functions of high-performance corresponding to the high-cost. This indicates that the central controller 105 has to use, as operation means and display means, the operation input means such as a LCD (Liquid Crystal Display) window with touch keys as the operation means and the display means in order to achieve the variety of input and display.

Thus, the high-performance of the central controller 105 causes a higher cost based on the reason described above. When the variety of the functions is displayed on a window of a limited area on a display panel, it is necessary to send many data items to the window. This also causes the difficulty for the user to see the window. If the size of the window becomes enlarged, the cost of the system is also increased and this introduces the difficulty to place the large sized window on the central controller 105.

In addition, the high-performance of the function in the central controller 105 causes the drawback where a general user to handle the air conditioners becomes difficulty in operation of the central controller 105 because the system with the high-performance involves unnecessary functions for various users other than the general user, such as a distributor to sale the air conditioners, a building administrator, a working person to set the devices, and a facility designer, who do not handle the entire design, construction, and management for the air conditioner control system in a building.

The indoor unit controller 141 in the indoor units 102*a*–102*c* controls the facility device 143 which is installed optionally at the place where the indoor unit has been mounted according to the program which is stored in advance in a memory device and executed by the central processing means 151. Accordingly, there is the drawback that the program cannot control any additional facility device other than the facility device 143 whose function has been registered in the program in advance.

In order to control the additional facility device above, it is necessary to incorporate dedicated terminals corresponding to the number of the additional facility devices into the system. This increases the costs of device and construction.

Moreover, in order to remotely control the operation state of the air conditioners and facility devices, the facility controllers 106 collect the information regarding the operation state of the air conditioners and transmit the information to outside. Therefore the facility controllers 106 have to incorporate a transmitter of a high-performance.

Furthermore, the conventional air conditioner control system having the configuration shown in FIG. 57 has the following drawback.

In general, in order to reduce the cost of the air conditioner control system, a transmission speed between the air conditioners through the transmission wiring 104 is designed in 9,600 pbs (bit per second) which is relatively low. This transmission speed enables to send approximately three commands per second between the air conditioners.

When the charge is calculated based on an opening state of an electrical expansion valve of each of the indoor units 102*a*–102*c*, it is necessary for each facility controller 106 to obtain the air conditioner information every one minute interval. When sixty indoor units 102*a*–102*c* are connected to the system, it is necessary to send one command every one minute. In addition to this transmission, it is necessary to send the operation commands for the remote controllers 103*a*–103*c*, and communication commands between the indoor units 102*a*–102*c* and the remote monitor terminals 110*a*–110*c*. Therefore the collection interval for commands is limited when the facility controller 106 collects the information of the air conditioners in order to send the information to the remote monitor terminals 110*a*–110*c*.

For example, when a malfunction occurs in the air conditioner control system and one of the remote monitor controller 110*a*–110*c* analyses its problem source and when the control of the electrical expansion valve and the control of the frequency of a compressor in the system are controlled every one minute interval, it is difficult to judge the operation state and the problem source.

In addition, it is difficult to store a large amount of air conditioner information during a long time period because the memory size in the facility controller 106 is limited. As a result, it is necessary to delete the preceding air conditioner information stored in the memory or to send the air conditioner information to the remote monitor controllers 110*a*–110*c* every when the memory is filled with the information collected. This increases the telephone charge through the public telephone network 108. Furthermore, it is necessary to pay the telephone charge in order to send the air conditioner information to a plurality of the remote monitor terminals 110*a*–110*c*. This also increases the entire cost for operating and maintenance.

Moreover, the facility controller 106 cannot send the air conditioner information to the remote monitor controllers 110*a*–110*c* when there is no available telephone traffic during a busy hour in order to connect the facility controller 106 to the remote monitor terminals 110*a*–110*c* for receiving the air conditioner information or when the remote monitor terminals 110*a*–110*c* uses other applications.

In order to solve the problem above, it is necessary to add a dedicated telephone communication line or to mount additional dedicated remote monitor terminals. However, the conventional countermeasure above increases the entire cost of the air conditioning system.

By the way, the decreasing of the number of the transmissions in order to decrease the telephone charge causes to increase the memory size in the facility controller 106. This also increases the entire cost of the air conditioner control system.

On the other hand, when the central monitor device mounted in a building where the air conditioners are mounted collects the air conditioner information without any use of the public telephone network 108, there is no problem about the telephone charge because the telephone charge is not increased. However, the interval to collect or receive the air conditioner information is still long, so that it is difficult to analyze the air conditioner information. The air conditioner information obtained from the conventional air conditioner control system is used as the information of the normal operation state. When a malfunction causes in the system, a dedicated analyzer analysis the air conditioner information obtained. However, in general, the dedicated analyzer is mounted after the malfunction causes. Therefore it is difficult to compare the air conditioner information obtained when the malfunction occurs with the information before the occurrence of the malfunction, and therefore difficult to analyze the problem source.

SUMMARY OF THE INVENTION

It is therefore an object of the present invention to provide an air conditioner control system having following features (a) to (e):

(a) It is not necessary to incorporate any additional devices for remote monitoring and to perform any additional working;

(b) It is not necessary to incorporate any additional devices such as a central controller in a large air conditioner control system;

(c) It is possible to share a paperwork program without using any remote monitoring program which is a dedicated program for a remote monitor terminal;

(d) It is possible to easily handle the air conditioner control system by a distributor to sale air conditioners for the system, a building administrator, a working person to set the air conditioners and a facility designer; and (e) It is possible to reduce the entire cost of the system construction and operation of the system.

It is another object of the present invention to provide an air conditioner control system without any individual remote controller and remote control wiring.

It is still another object of the present invention to provide an air conditioner control system capable of remotely monitoring the operation state of air conditioners and facility devices with a low cost.

It is another object of the present invention to provide an air conditioner control system and a facility controller without deleting preceding air conditioner information and without increasing of the size of the memory incorporated in the facility controller.

It is another object of the present invention to provide an air conditioner control system and a facility controller having following features (f) to (i):

(f) It is possible to reduce the telephone charge for transmission air conditioner information;

(g) It is also possible to reduce the telephone charge when the air conditioner information is transmitted to a plurality of devices;

(h) It is possible to transmit the air conditioner information regardless of the state of the telephone traffic in the remote monitor terminal for receiving the information and regardless of the use state of the remote monitor terminals; and (i) It is not necessary to incorporate any dedicated telephone wiring and any dedicated remote monitor terminal for the system.

It is still another object of the present invention to provide an air conditioner control system capable of collecting the air conditioner information every necessary time interval without any dedicated analyzer for the malfunction in the system.

According to an aspect of the present invention, there is provided an air conditioner control system in which a central remote controller has first transmission means, second transmission means, an operation information processing section, and a management information processing section. The first transmission means communicates with an air conditioner. The second transmission means communicates with a remote monitor terminal. The operation information processing section processes operation information from operation setting means, each of which is independent in function, transmits the operation information to the air conditioner through the first transmission means, collects the operation information of the air conditioner received through the first transmission means, generating screen information based on the collected operation information of the air conditioner, and displaying the screen information on a display means. The management information processing section generates screen information based on the operation information of the air conditioner collected through the first transmission means, transmits the screen information to the remote monitor terminal through the second transmission means, relays control information transmitted from the remote monitor terminal through the second transmission means, and transmits the control information to the air conditioner through the first transmission means. The remote monitor terminal displays the screen information transferred from the central remote controller.

In addition, according to another aspect of the present invention, there is provided an air conditioner control system in which a central remote controller has first transmission means, second transmission means, an operation information processing section, and a management information processing section. In particular, the management information processing section relays the operation information of the air conditioner collected through the first transmission means, transmits the screen information to a remote monitor terminal through the second transmission means, relays control information transmitted from the remote monitor terminal through the second transmission means, and transmits the control information to an air conditioner through the first transmission means. The remote monitor terminal generates screen information based on the operation information transferred from the central remote controller and displays the screen information.

Furthermore, according to another aspect of the present invention, there is provided an air conditioner control system having first central remote controllers, a second remote controller, and a remote monitor terminal. The first central remote controllers handle operation of first air conditioners and collects operation information of the first air conditioners. The second central remote controller handles operation of a second air conditioner and collects operation information of the second air conditioner. The remote monitor terminal monitors operation state of the first and second air conditioners and controls the operation of the first and second air conditioners through a public telephone network. The first central remote controllers collect the operation information of the first air conditioners and transmit the operation information to the second central remote controller through a branch means. The second central remote controller generates screen information based on the operation information of the first air conditioners collected by the first central remote controllers and the operation information of the second air conditioner, and transmits the screen information to the remote monitor terminal through the public telephone network. The remote monitor terminal receives and displays the screen information transmitted from the second central remote controller.

Moreover, according to another aspect of the present invention, there is provided an air conditioner control system having first central remote controllers, a second central remote controller, and a remote monitor terminal. In particular, the second central remote controller relays the operation information of first air conditioners transferred from the first central remote controllers and the operation information of a second air conditioner, and transmits both the operation information to the remote monitor terminal. The remote monitor terminal receives both the operation information, generates screen information based on both the operation information, and displays the screen information generated.

Still furthermore, according to another aspect of the present invention, there is provided an air conditioner control system having a plurality of central remote controllers, an information relay unit, and a remote monitor terminal. The central remote controllers handle operation of air conditioners and collect operation information of the air conditioners. The information relay unit receives the operation information of the air conditioners collected by the central remote controllers. The remote monitor terminal monitors operation state of the air conditioner through a public telephone network and controls the operation of the air conditioner through the public telephone network. The central remote controllers transmit the collected operation information of the air conditioners to the information relay unit through a branch means. The information relay unit receives the operation information transmitted from the central remote controllers and generates screen information based on the operation information received, and transmits the screen information to the remote monitor terminal through the public telephone network. The remote monitor terminal receives the screen information and displays the screen information received.

Still furthermore, according to another aspect of the present invention, there is provided an air conditioner control system having a plurality of the central remote controllers, an information relay unit, and a remote monitor terminal. In particular, the information relay unit receives the operation information transmitted from the central remote controllers, and transmits the operation information to the remote monitor terminal through a public telephone network. The remote monitor terminal receives the operation information transmitted from the information relay unit, generates a screen information based on the operation information received, and displays the screen information generated.

Moreover, according to another aspect of the present invention, there is provided an air conditioner control system having central remote controllers, first and second facility devices, the third facility device, and the facility management device. The central remote controllers handle operation of air conditioners and collecting operation information of the air conditioners. The first and second facility devices are placed together with the air conditioners. The third facility device is added and placed after the initial installation of the air conditioner control system. The facility management device, connected to the central remote controllers through a branch means, controls operation of the third facility device. The facility management device transmits to the air conditioner a request to monitor the first facility device through the central remote controllers based on a facility device control procedure stored in the facility management device, and controls the operation of the second facility device, the third facility device, and the air conditioners according to a state of the first facility device informed from the air conditioner.

Still furthermore, according to another aspect of the present invention, there is provided an air conditioner control system having a central remote controller, a facility device, a facility management device, and a remote monitor terminal. The central remote controller handles operation of the air conditioner and collects operation information of the air conditioner. The facility device is added and placed after the initial installation of the air conditioner control system. The facility management device, connected to the central remote controller through a branch means, controls operation of the facility device. The remote monitor terminal monitors operation state of the air conditioner and controls the operation of the air conditioner. The central remote controller generates screen information based on information regarding the facility device collected by the facility management device, and transmits the screen information to the remote monitor terminal, and the remote monitor terminal receives the screen information and displays the screen information received.

In addition, according to another aspect of the present invention, there is provided a central remote controller of the present invention having first transmission means, second transmission means, an operation information processing section, and a management information processing section. The first transmission means communicates with an air conditioner. The second transmission means, through which an operation state of the air conditioner is monitored, communicates with a remote monitor terminal. The operation information processing section processes operation information from operation setting means, each of which is independent in function, transmits the operation information to the air conditioner through the first transmission means, collects the operation information of the air conditioner received through the first transmission means, generates screen information based on the collected operation information of the air conditioner, and displays the screen information on a display means. The management information processing section generates screen information, to be displayed by the remote monitor terminal, based on the operation information of the air conditioner collected through the first transmission means, transmits the screen information to the remote monitor terminal through the second transmission means, relays control information transmitted from the remote monitor terminal through the second transmission means, and transmits the control information to the air conditioner through the first transmission means.

Still furthermore, according to another aspect of the present invention, there is provided a central remote controller having a first transmission means, a second transmission means, an operation information processing section, and a management information processing section. In particular, the management information processing section relays the operation information of an air conditioner collected through the first transmission means, transmits screen information to the remote monitor terminal, in order to display the screen information thereon, through the second transmission means, relays control information transmitted from the remote monitor terminal through the second transmission means, and transmits the control information to the air conditioner through the first transmission means.

Therefore, in the present invention described above, because it is not necessary to incorporate any dedicated devices, programs, and work, a distributor, a maintenance technician, a facility designer can handle the air conditioner control system easily and to reduce the construction cost or the maintenance cost of the air conditioner control system as large as possible. Further, it is possible to realize the air conditioner control system capable of operating additional facilities and devices with a low cost that are mounted together with the air conditioners after the initial setting without incorporating any additional control devices of a high price.

According to another aspect of the present invention, there is provided an air conditioner control system having air conditioners, facility controllers, and a remote monitor terminal. The facility controllers handles operation of the air conditioners and monitors operation state the air conditioners, collects air conditioner information regarding the operation, stores the collected air conditioner information to memory means, and transmits the air conditioner information stored in the memory means when the number of collection operations is reached to a predetermined value. The remote monitor terminal receives the air conditioner information transmitted from the facility controllers and monitors the operation of the air conditioners.

Still furthermore, according to another aspect of the present invention, there is provided a facility controller having a collection processing section and a transmission processing section. The collection processing section collects air conditioner information regarding the operation of air conditioners and stores the information into memory means, and instructs to transmit the air conditioner information stored in the memory means when the number of collections of the air conditioner information is reached to a predetermined value. The transmission processing section receives the instruction from the collection processing section and transmits the air conditioner information stored in the memory means based on the instruction received.

Therefore, it is not necessary to increase the size of the memory storage in the facility controllers and it is possible to use the preceding air conditioner information efficiently without deleting it.

Still furthermore, it is possible to send various information to places of a plurality of destination addresses without increasing the telephone charge regardless of the presence of a usable telephone line (without checking the presence of the usable telephone line (not busy line) and regardless of checking whether the remote monitor terminal is used for another application, and it is not necessary to incorporate any dedicated telephone line and to install any dedicated remote monitor terminal.

BRIEF DESCRIPTION OF THE DRAWINGS

Other objects, features and advantages of the present invention will become apparent from the following description taken in conjunction with the accompanying drawings, in which:

FIG. 2 shows a list of various screen menus to be displayed for each corresponding user on a display means in a remote monitor terminal in the air conditioner control system according to the first embodiment;

FIG. 11 shows a screen of data contents, before the malfunction occurs, in the maintenance menu to be displayed on the remote monitor terminal in the air conditioner control system according to the first embodiment;

DETAILED DESCRIPTION OF THE PREFERRED EMBODIMENTS

A detailed description will be given, with reference to the accompanying drawings, of the preferred embodiments of the present invention.

First Embodiment

Figure 1:
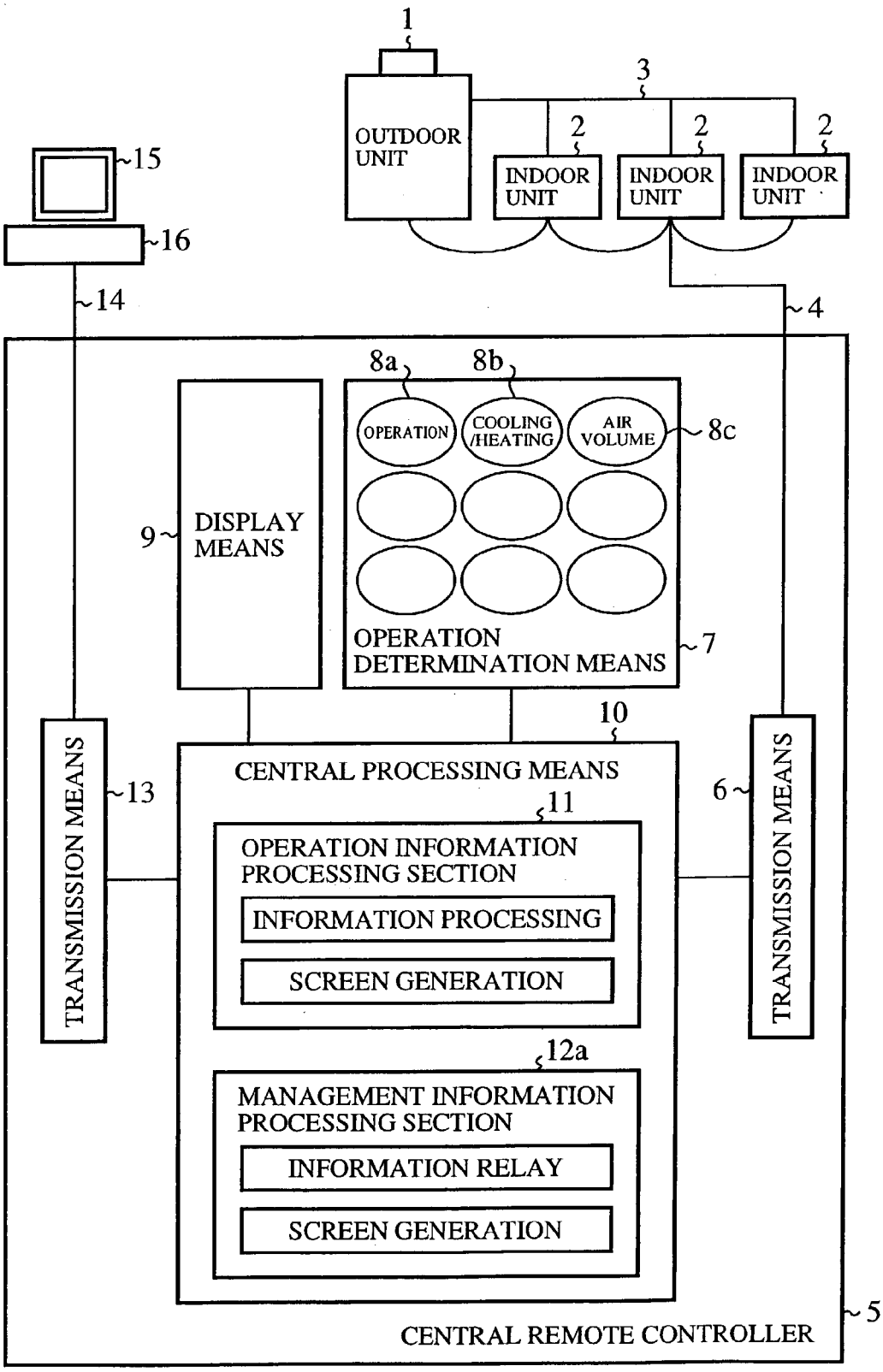
FIG. 1 is block diagram showing a configuration of the air conditioner control system according to a first embodiment of the present invention.

FIG. 1 is block diagram showing a configuration of the air conditioner control system according to a first embodiment of the present invention. In FIG. 1, reference number 1 designates an outdoor unit of an air conditioner and 2 denotes a plurality of indoor units connected to the outdoor unit 1 through a coolant pipe 3. The outdoor unit 1 and the indoor units 2 form one air conditioner. Reference 4 designates a dedicated communication wiring (as a transmission medium) for the air conditioner, through which the outdoor unit 1 is connected to each of the indoor units 2.

Reference number 5 designates a central remote controller connected to the outdoor unit 1 and the indoor units 2 through the transmission medium 4. The central remote controller 5 is capable of dividing air conditioners into several groups. The central remote controller 5 collects and monitors operation information of the air conditioner (as referred to as "air conditioner information"). Reference number 15 denotes a remote monitor terminal in which a browser software (or a computer program of a Web browser) 16 has been installed as a general-purpose software. The remote monitor terminal 15 is capable of remotely monitoring the operation of the air conditioner by receiving the operation information transmitted through the transmission medium 14. The remote monitor terminal 15 also transmits control information in order to control the operation of the air conditioner. It is possible to use a general-purpose personal computer as the remote monitor terminal 15 and also possible to use a Local Area Network (LAN) or a wireless LAN (WLAN) as the transmission medium 14 which can be connected to the personal computer In the central remote controller 5, reference number 6 designates a transmission means (first transmission means) connected to both the outdoor unit 1 and the indoor units 2 through the transmission medium 4 in order to communicate with the air conditioner.

Reference number 7 denotes an operation determination means for performing the operation of the air conditioner, which includes an operation setting means 8 having an operation switch 8*a*, a cooling/heating switch 8*b*, and a switch 8*c* for a volume of air, each of the switches is independent in function. Reference number 9 indicates a display means for displaying contents of the operation of the operation determination means 7 and various operation states of the air conditioner.

Reference number 10 designates a central processing means for processing the operation information and handling information of the air conditioner and further processing management information for the air conditioner control system. Reference number 11 indicates an operation information processing section for processing the handling information from the operation determination means 7 and the operation information of the air conditioner collected through the transmission means 6 and also generating screen information to be displayed on the display means 9.

Reference character 12*a* indicates management information processing section performing following processes:

Relaying the control information transmitted from the remote monitor terminal 15;

Transmitting the control information to the air conditioner in order to control the operation of the air conditioner; and Processing the operation information of the air conditioner collected through the transmission medium 6 in order to display the operation information on the remote monitor terminal 15.

Reference number 13 designates a transmission means (second transmission means) connected to the remote monitor terminal 15 for communicating with the remote monitor terminal 15 through the transmission medium 14.

Next, a description will now be given of the operation of the air conditioner control system of the first embodiment.

The user inputs the handling information through the operation setting means 8 having the operation switch 8*a*, the cooling/heating switch 8*b*, the switch 8*c*, and other switches, each of which is independent in function. The operation information processing section 11 processes and transmits the handling information to the air conditioner through the transmission means 6 and the transmission medium 4 in order to control the operation of the air conditioner.

Because it is so formed that the operation switches 8*a*, 8*b* and 8*c* in the operation setting means 8 in this central remote controller 5 are independent in function to each other and these switches 8*a*, 8*b*, and 8*c* are also limited in area, the number of these switches 8*a*, 8*b*, and 8*c* is approximately equal to the number of functions in the conventional remote controller.

Figure 59:
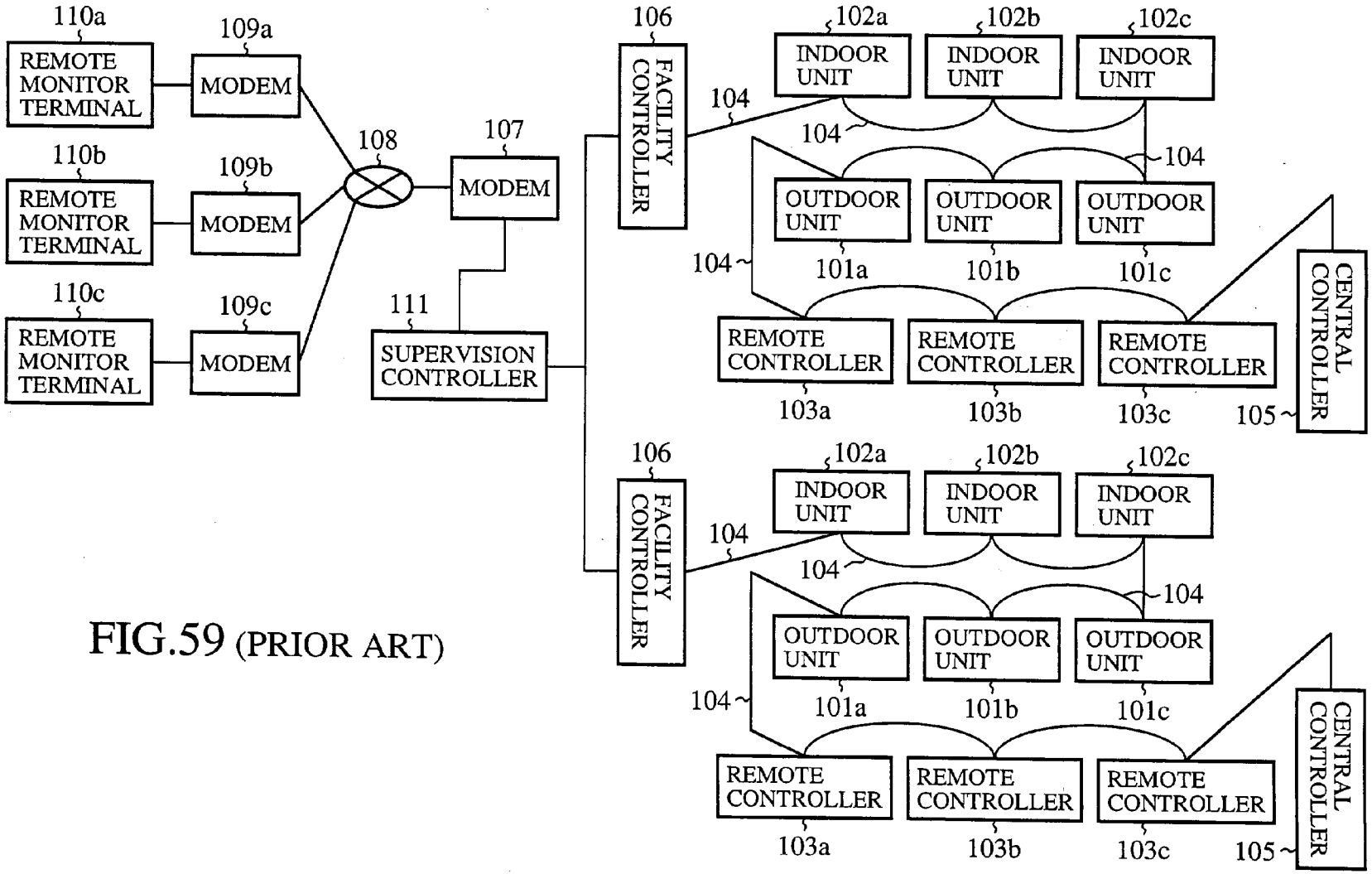
FIG.59 (PRIOR ART)
FIG. 59 is a block diagram showing an another conventional air conditioner control system of a large configuration.
Figure 60:
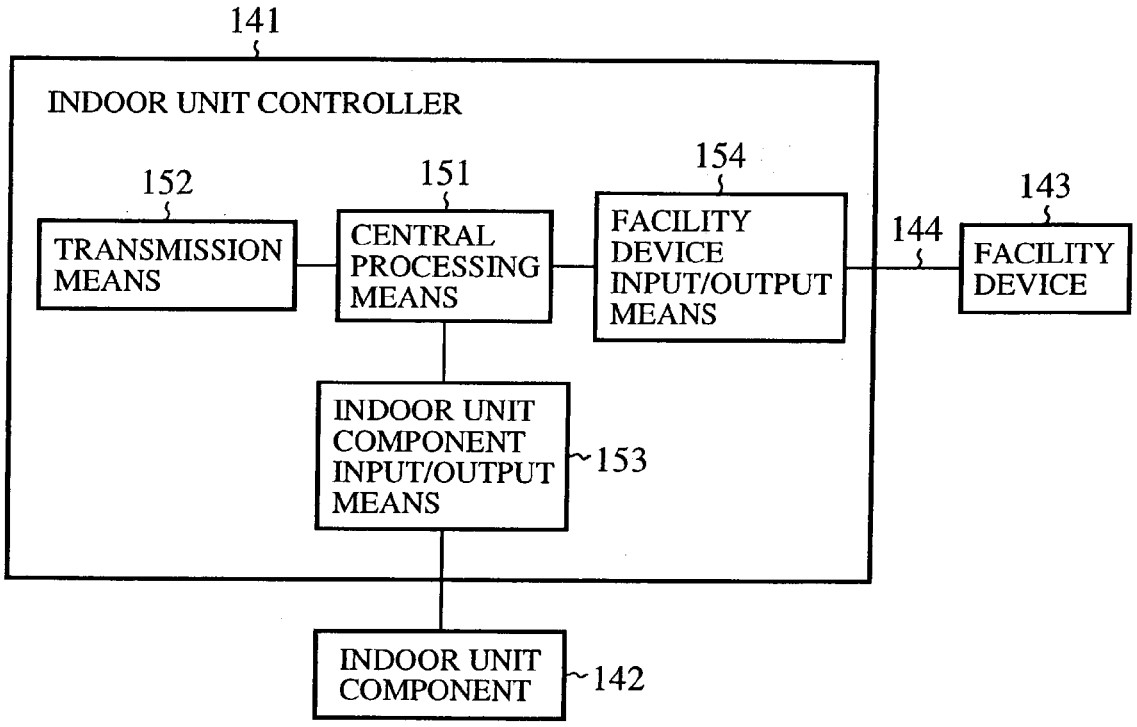
FIG.60 (PRIOR ART)
FIG. 60 is a block diagram showing an internal configuration of an indoor unit controller for an indoor unit in the conventional air conditioner control system.

However, the user can recognize the switches 8*a*, 8*b*, and 8*c* and operate them easily because those switches 8*a*, 8*b* and 8*c* are formed so that each switch is independent in function to each other. This feature is different in configuration and function from the conventional central controllers 105 (see FIG. 59) in which there are plural screens, and touch keys are shown on each screen, and therefore the content of the keys on one screen becomes different from that on another screen, and the user has to scroll the screen in order to select a desired key.

Thus, the user, who actually controls the air conditioner, easily recognizes the function of each switch and handles the switches 8*a*, 8*b*, and 8*c* in the central remote controller 5 of this embodiment.

The operation information processing section 11 generates the screen information based on the handling information from the operation determination means 7 and the operation information from the air conditioner through the transmission medium 4 and the transmission means 6 and displays the screen information on the display means 9.

The management information processing section 12*a* receives and then relays the control information transferred from the remote monitor terminal 15 through the transmission medium 14 and the transmission means 13, and transfers the information to the air conditioner through the transmission means 6 and the transmission medium 4 in order to control the operation of the air conditioner.

The management information processing section 12*a* processes the operation information of the air conditioner transferred from the transmission medium 4 and the transmission means 6 in order to generate the screen information and transfers the screen information to the remote monitor terminal 15. The remote monitor terminal 15 receives the information and displays the received one on a display means (not shown) of a built-in type using the browser software 16. The remote monitor terminal 15 thereby monitors the operation state of the air conditioner.

Here, a description will be given of the explanation of the screen information to be generated by the management information processing section 12*a* in the central remote controller 5 and to be displayed on the remote monitor terminal 15.

FIG. 2 shows a list of various screen menus to be displayed on the remote monitor terminal 15 for plural users of various types.

As shown in FIG. 2, there are the plural screen menus for various users such as a general user, a building manager, a building administrator and a supervisor. Each user can watch the corresponding screen menu using its own homepage address and password. In other word, each user can watch the corresponding screen menu only by using the own password. For example, the general user can monitor only the operation state screen menu, the building manager can monitor a schedule management screen menu, an abnormal history screen menu and a system setting screen menu in addition to the operation state screen menu. The maintenance technician and the supervisor can monitor a maintenance screen menu in addition to the screen menus described above. Thus, the various screen menus are prepared according for demand.

Figure 3:
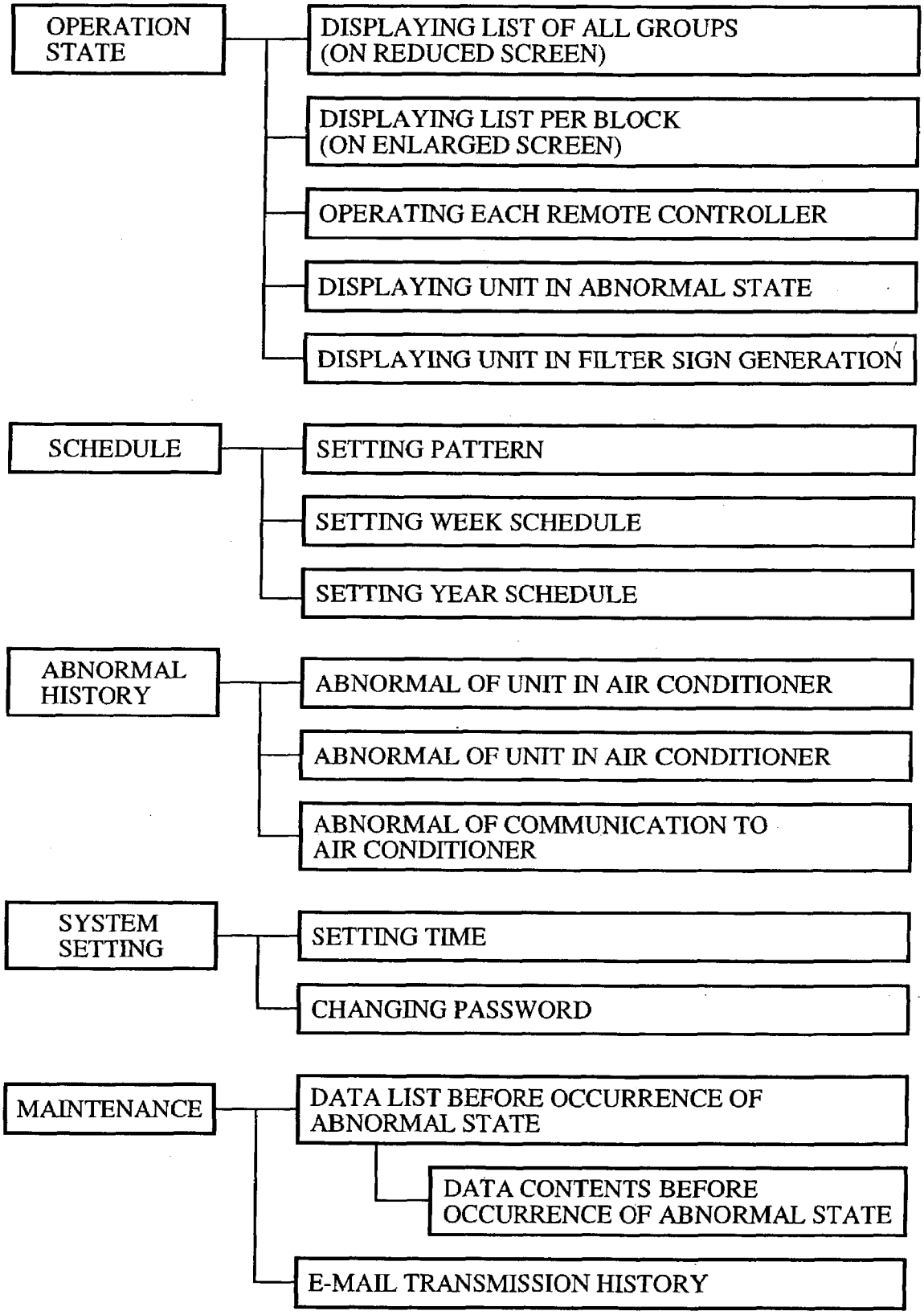
FIG. 3 shows a list of detailed contents of each screen menu, shown in FIG. 2, to be displayed on the remote monitor terminal in the air conditioner control system according to the first embodiment.

FIG. 3 shows a list of detailed contents of each screen menu shown in FIG. 2. As shown in FIG. 3, following screens of various kinds are prepared:

Screen for operation state; Screen for schedule; Screen for abnormal history; Screen for system setting; and Screen for maintenance.

Figure 4:
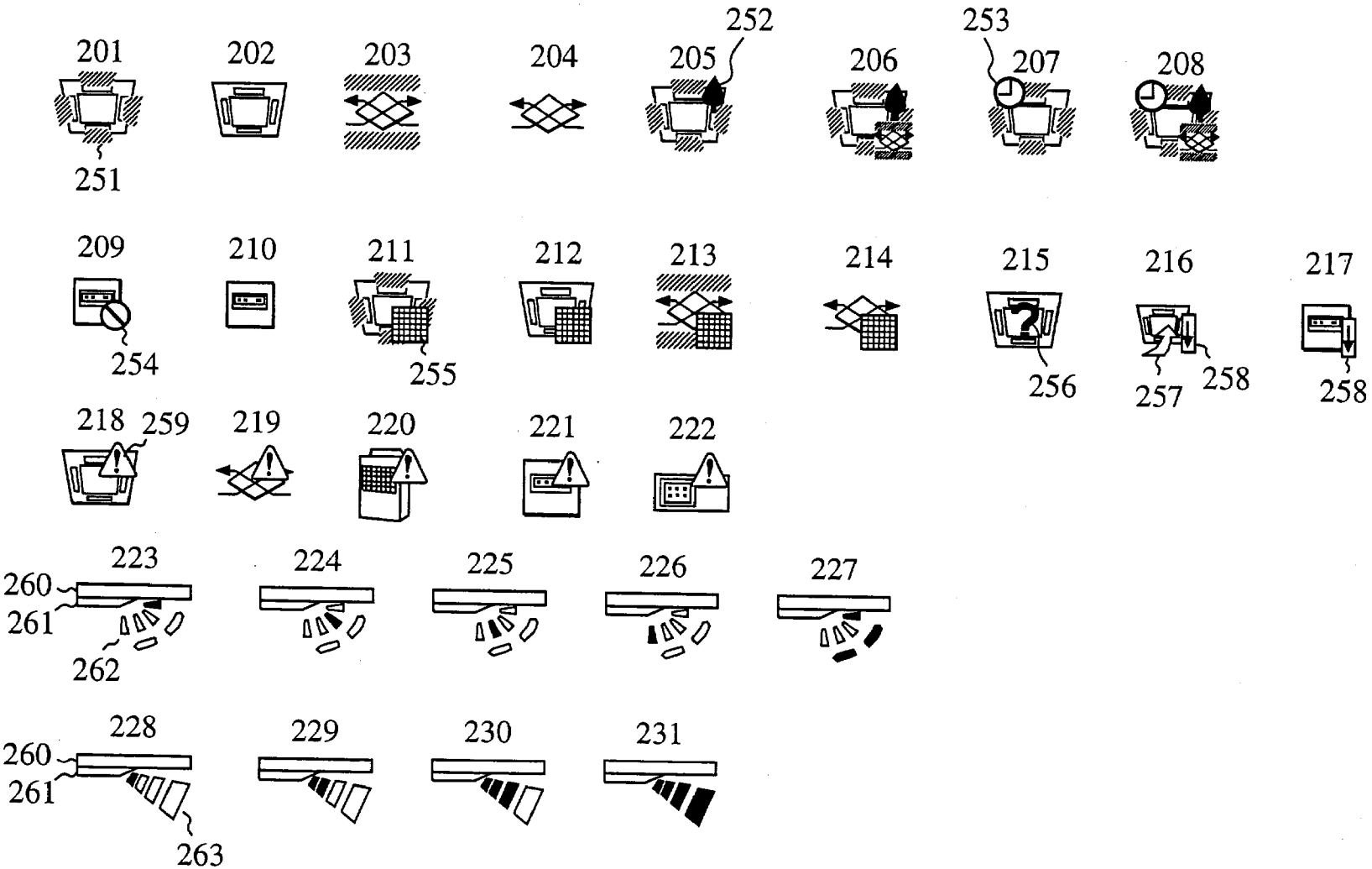
FIG. 4 shows various kinds of icons to be displayed on a screen of the remote monitoring terminal in the air conditioner control system according to the first embodiment.

FIG. 4 shows various kinds of icons to be displayed on the display means in the remote monitor terminal 15. In FIG. 4, reference number 201 designates the icon showing the operation state of a group of the indoor unit 2. This icon 201 has air marks 251, each indicates the direction of the air. Each air mark 251 has a green color. In general, cooling is designated by blue color, and heating by red color. Although the user has to obtain the information whether the current state is cooling or heating from the indoor unit 2 if cooling and heating in an air conditioner are changed automatically, the user can recognize that the current mode is the automatic cooling and heating control when the green color mark is lighted without receiving the information from the indoor unit 2.

Reference number 202 indicates the icon showing a stop state of the group of the indoor units 2. Reference number 203 designates the icon showing the operation of a group of ventilation funs and 204 indicates the icon showing the halt state of the group of the ventilation funs. Reference number 205 denotes the icon showing a saving power state of the group of the indoor units 2. Reference number 206 designates the icon showing the operation state of the group of the ventilation funs corresponding to the group of the indoor units 2. Reference number 207 indicates the icon showing the timer operation of the group of the indoor units 2. Reference number 208 denotes the icon which shows simultaneously the state of the saving operation, the timer operation, and the operation of the ventilation funs in the group of the indoor units 2.

Reference number 209 indicates the icon with a prohibition mark 254 showing the state where the user cannot operate the central remote controller 5. Reference number 211 is the icon of warning with a dirt mark of inlet for the group of the indoor units 2. This dirt mark indicates to the user the time of a filter cleaning or replacement. It is possible to blink the filter mark 255 in order to highlight the warning.

Reference number 212 indicates the icon of warning showing the time of the filter cleaning or replacement for the group of the indoor units 2 during idling. Reference number 213 indicates the icon of warning showing the time of the filter cleaning or replacement for the ventilation funs during operation. Reference number 214 indicates the icon of warning showing the time of the filter cleaning or replacement for the ventilation funs during idling.

Reference number 215 designates the icon including a question mark "?" designated by reference number 256 showing that the group of the indoor units 2 cannot be recognized for communication.

Reference number 216 indicates the icon of the group of the indoor unit 2 with an air mark 257 and a thermometer mark 258. The air mark 257 shows inlet air. The thermometer mark 258 shows the room temperature.

Reference number 217 indicates the icon of the central remote controller 5 with a thermometer mark 258 which shows a setting temperature (° C.) by the central remote controller 5.

Reference numbers 218 to 222 denote icons of warning including the attention mark "!" 259 which warns the occurrence of abnormal state in the unit. In particular, reference number 218 designates the icon showing the indoor unit 2, 220 denotes the icon of the outdoor unit 1, 221 indicates the icon showing each unit in the central remote controller 5, where each unit is shown with an orange color which is different from the red color indicating the heating mode. In the. above case, it is possible to blink the attention mark "!" 259 in order emphasis the occurrence of the abnormal state in the unit.

Reference numbers 223 to 227 are icons showing a sectional view of the indoor unit 2 which is attached to the ceiling of the room. In the icon 223, reference number 260 designates the ceiling mark, 261 denotes the indoor unit 2 and 262 denotes an air direction mark showing the direction of air. Further, the angle of the air direction mark indicates the expansion of air and the initiation of the air blow is indicated with a dark color. Reference number 227 indicates the icon showing that the air blows in up and down direction. The air direction mark 262 indicates four stages of the direction of the air. Reference numbers 228 to 231 indicates the icons including an air speed mark showing the speed of air. As shown in the icon 228, reference number 260 designates a ceiling mark, and 261 denotes the indoor unit 2.

Like the direction of air, the angle of the air speed mark 263 indicates the expansion of air, and the dark color indicates the initiation of air blow. The area of the air speed mark 263 represents the amount of air.

Figure 5:
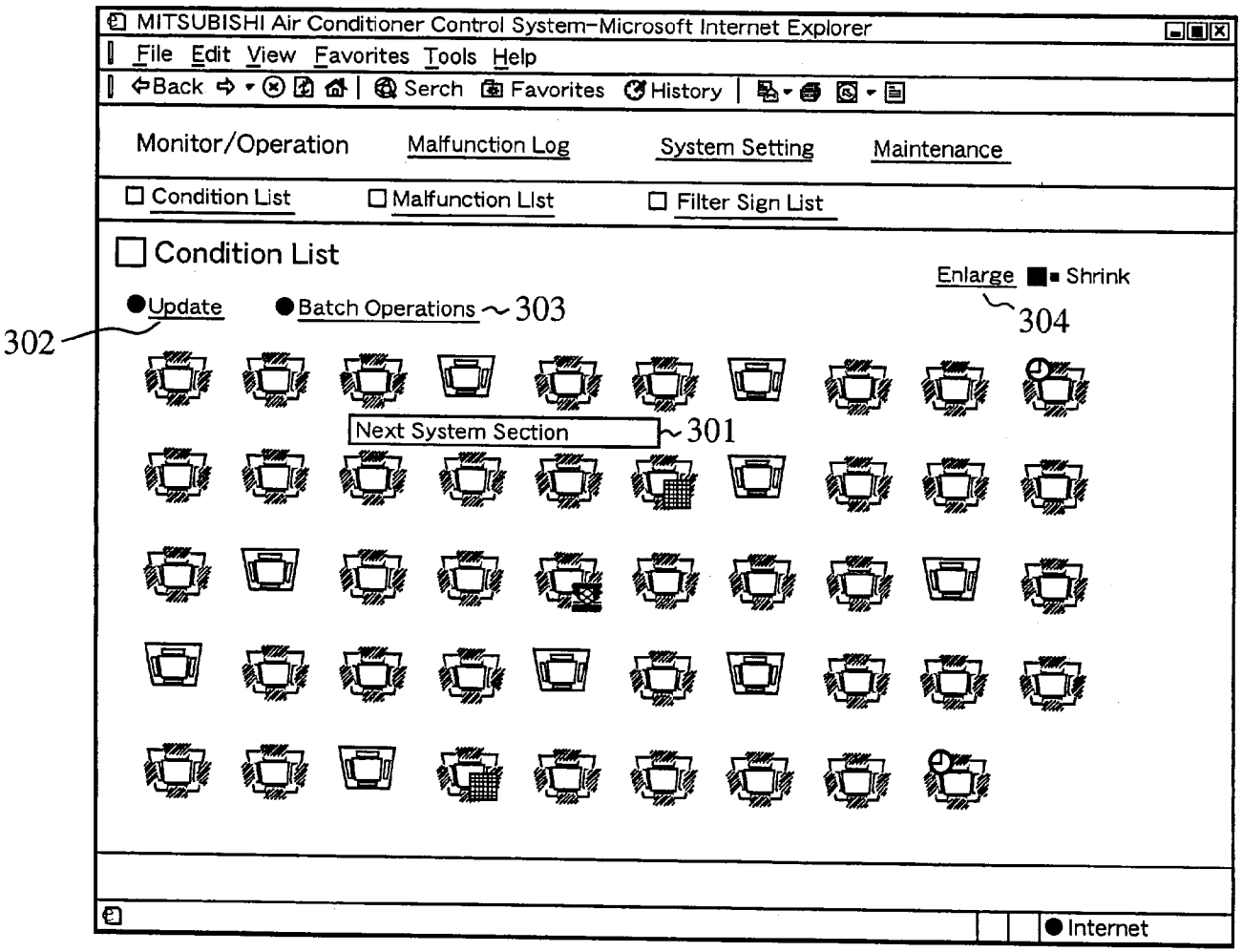
FIG. 5 is a screen showing the menu of various operation states, which is reduced in size, to be displayed on the remote monitor terminal in the air conditioner control system according to the first embodiment.

FIG. 5 is a screen showing the menu of various operation states shown in FIG. 3, reduced in size, to be displayed on the remote monitor terminal. FIG. 5 shows the entire of the screen menu, for example the icons 201 to 208, 211 to 215, and 218 to 222 shown in FIG. 4.

When the user moves the cursor in the remote monitor terminal 15 onto one icon on the screen shown in FIG. 5, the group name of this icon is displayed automatically. In general, although it is difficult to display all of the names of the groups on a screen considering from such a viewpoint of a font size, the present embodiment solves this problem. In general, because the browser screen is not updated automatically, the user wants to perform the update of the browser screen, the user clicks the "Update" button 302. The browser screen is thereby replaced with new one. Further, the user clicks the "Enlarge" button 304, the current screen is switched to the enlarged screen in size showing the entire list of the operation states where the content per block is displayed as shown in FIG. 3.

Figure 6:
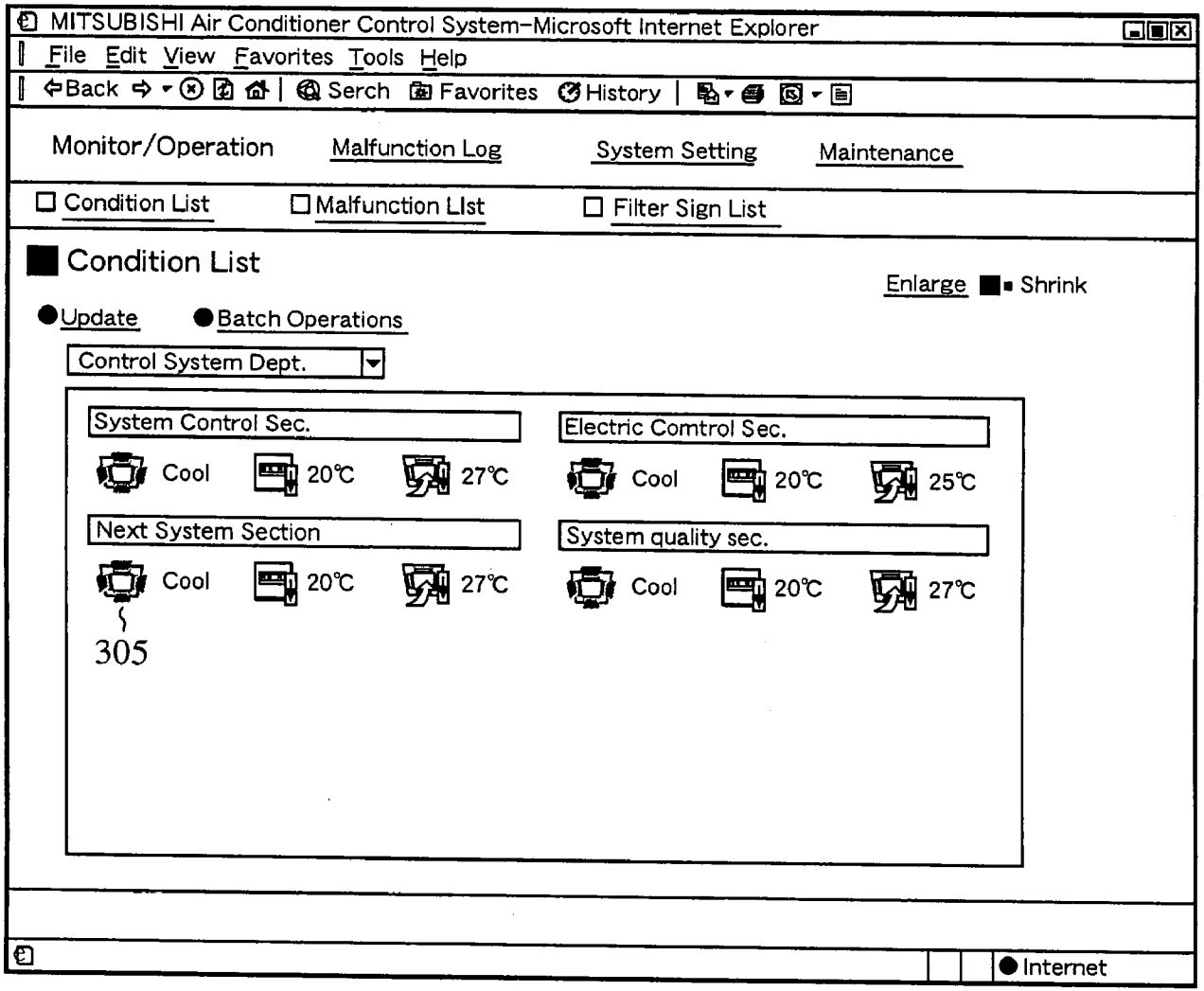
FIG. 6 is a screen showing the menu of the operation state, which is enlarged in size, for each remote controller to be displayed on the remote monitor terminal in the air conditioner control system according to the first embodiment.

FIG. 6 is a screen showing the menu of the operation state, which is enlarged in size, per block in the operation state screen menu, where the block is a unit in a plurality of groups. In FIG. 6, an operation state, a cooling/heating mode, a set temperature and a room temperature are shown. When the user clicks the icon 305 regarding the operation state, the screen is switched to the screen for the operation menu in each remote controller in the entire menu shown in FIG. 3.

Figure 7:
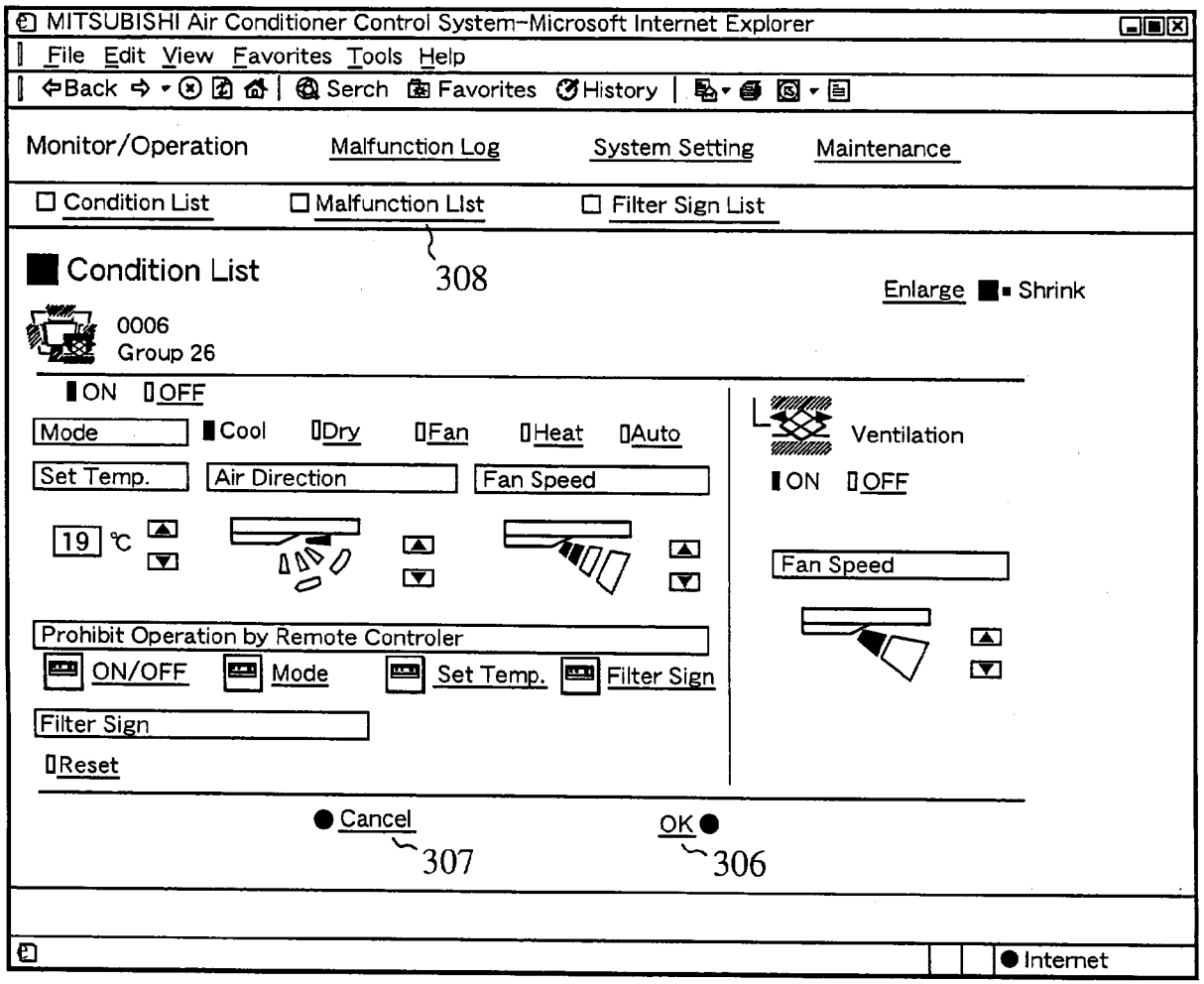
FIG. 7 is a screen showing each remote operation screen in the entire operation state menu to be displayed on the remote monitor terminal in the air conditioner control system according to the first embodiment.

FIG. 7 shows each remote controller operation screen in the operation state menu to be displayed. In this menu, the user can select following operations and change data items: ON/OFF, operation mode, setting temperature, direction of air, volume of air, permission/prohibition of each remote controller, resetting operation of warning about filter, ON/OFF of ventilation fun and amount of air. When the user clicks the "OK" button 306 on the screen after this selection or changing, the operation content is transmitted and the operation becomes effective. When the user clicks "Cancel" button 307, the operation content is canceled. When the user clicks "Malfunction List" button 308, the current screen is shifted to the screen showing the unit in the abnormal state in the operation state screen menu shown in FIG. 3.

Figure 8:
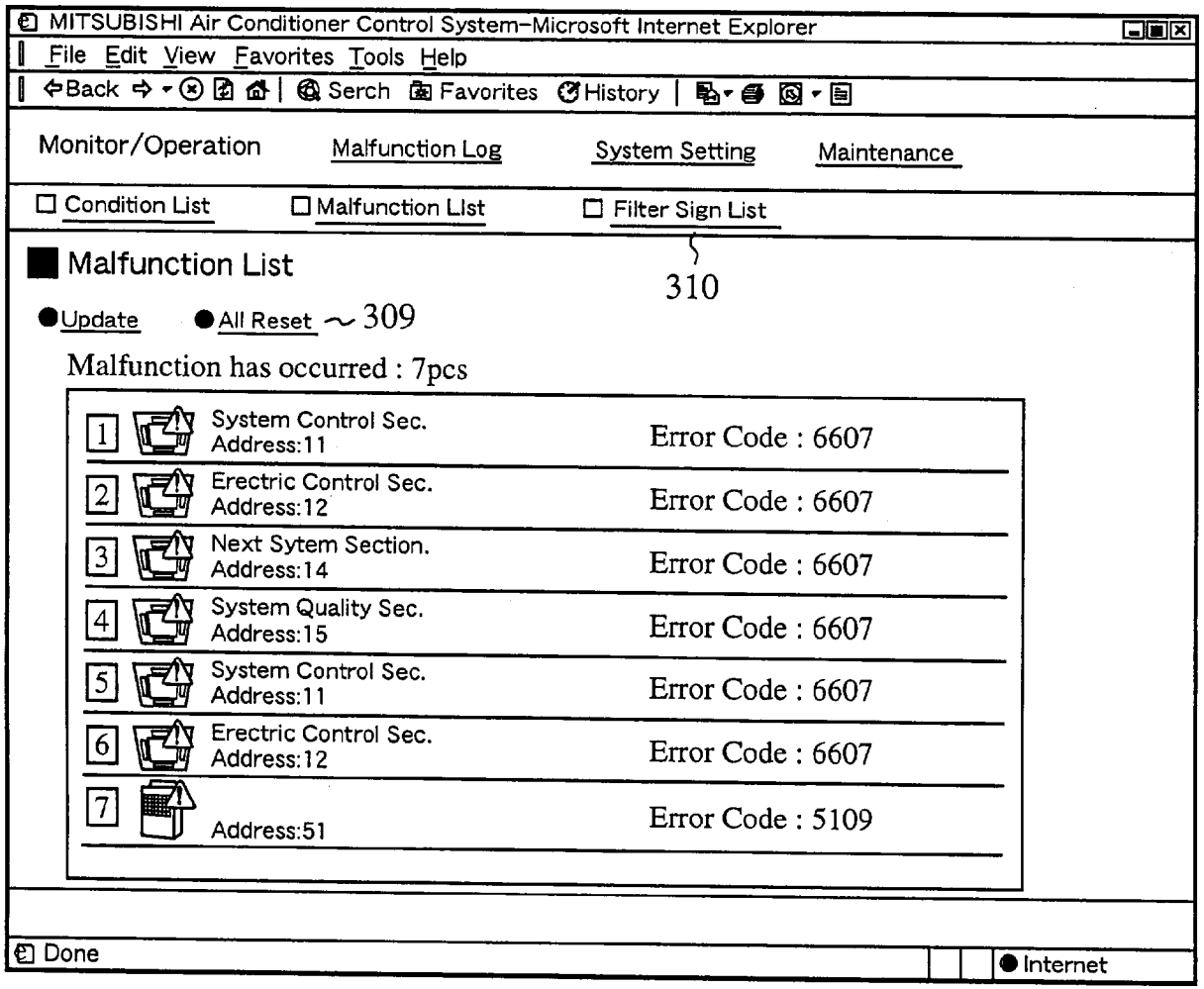
FIG. 8 shows a unit display screen during abnormal state in the menu of the operation states to be displayed on the remote monitor terminal in the air conditioner control system according to the first embodiment.

FIG. 8 shows a unit display screen during abnormal state in the operation state screen menu. When the unit is in the abnormal state, the screen shows the icons 218 to 222 shown in FIG. 4, the address of the unit and the error code number "Error Code".

When the user clicks the "All Reset" button 309, the stop signal is transmitted to all of the units in the abnormal state. The abnormal state is thereby reset.

When the user clicks the "Filter Sign List" button 310, the current screen progresses to the unit display screen during the occurrence of the filter sign shown in the operation state screen menu shown in FIG. 3.

Figure 9:
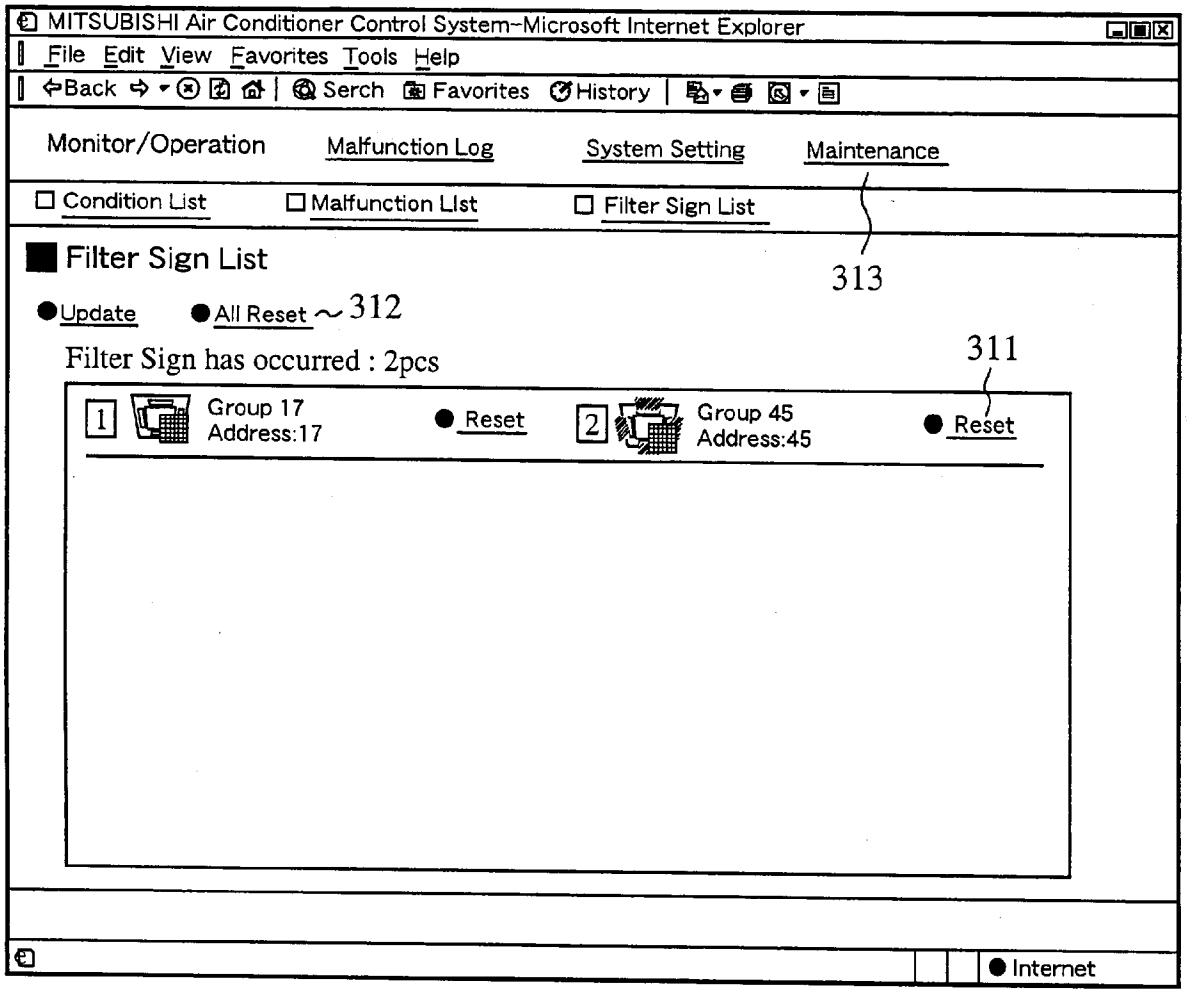
FIG. 9 shows a screen displaying the state of a unit during the occurrence of a filter sign, in the menu of the operation states to be displayed on the remote monitor terminal in the air conditioner control system according to the first embodiment.

FIG. 9 shows a unit display screen during the occurrence of the filter sign in the operation state screen menu.

The filter warning icons 211 to 214 shown in FIG. 4 and the unit address are displayed for the unit in the filter warning. When the user clicks the "Reset" button 311, the filter warning reset signal is transmitted to the unit of the filter warning. When the user clicks the "All Reset" button 312, the reset signal of the filter warning is transmitted to all units. When the user clicks the "Maintenance" button 313, the current screen is switched to the data list screen before the occurrence of the abnormal state in the maintenance screen menu shown in FIG. 3.

Figure 10:
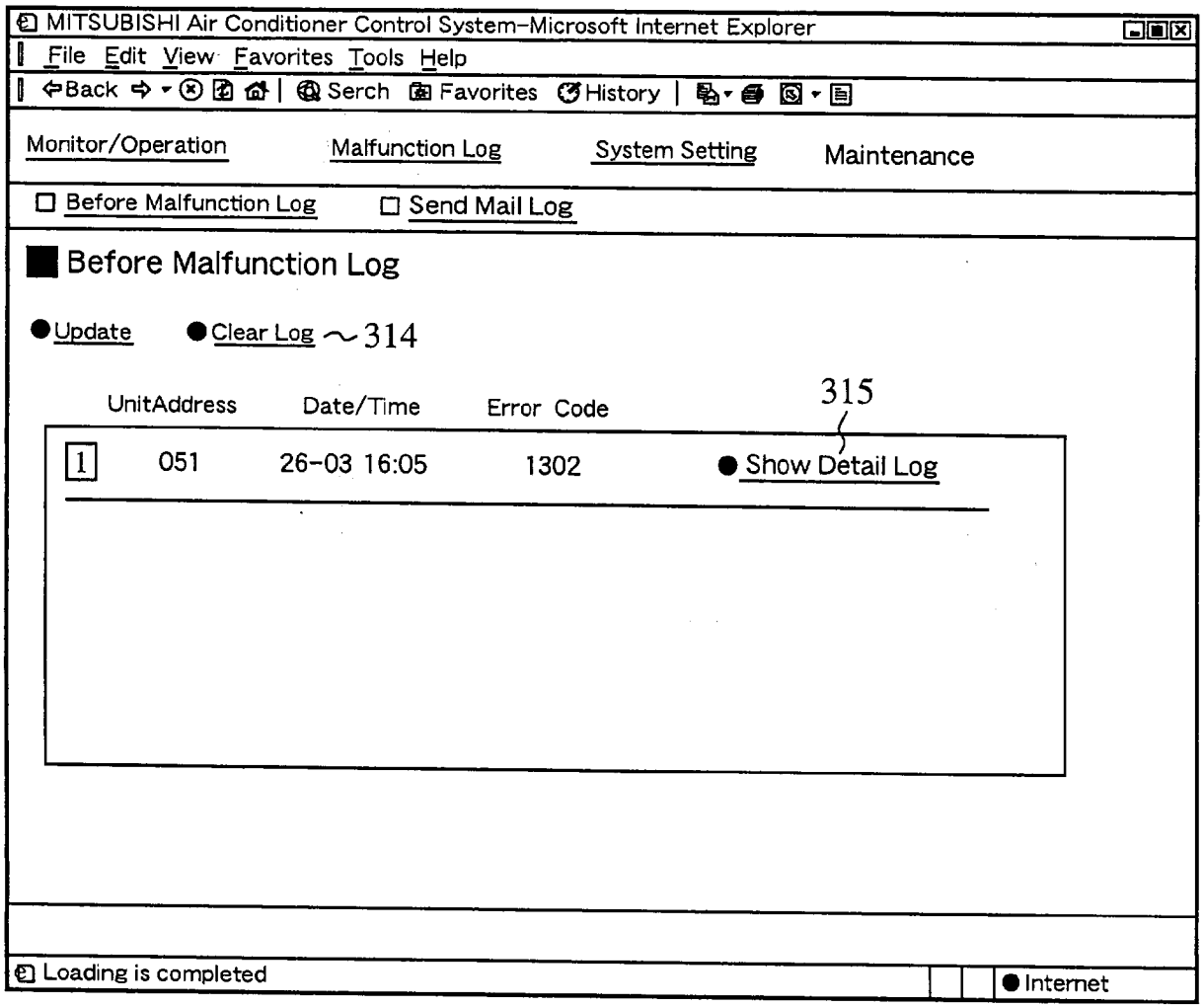
FIG. 10 shows a screen of a data list, before a malfunction occurs, in the maintenance menu to be displayed on the remote monitor terminal in the air conditioner control system according to the first embodiment.

FIG. 10 shows a screen of the data list before a malfunction occurs in the maintenance screen menu. In this screen, the unit address for the unit where the malfunction occurs, the occurrence time and abnormal code are displayed. When the user clicks "Show Detail Log" button 315, the current screen progresses to the data list screen before the abnormal in the maintenance menu shown in FIG. 3.

FIG. 11 shows a screen of the data list before the malfunction occurs in the maintenance screen menu. The screen displays the sensor information before occurrence of the malfunction stored in the unit and actuator information every one minute. When the user clicks the "Send Mail Log"

button 316 in the screen, the current screen progresses to the transmission log screen in the maintenance screen menu shown in FIG. 3.

Figure 12:
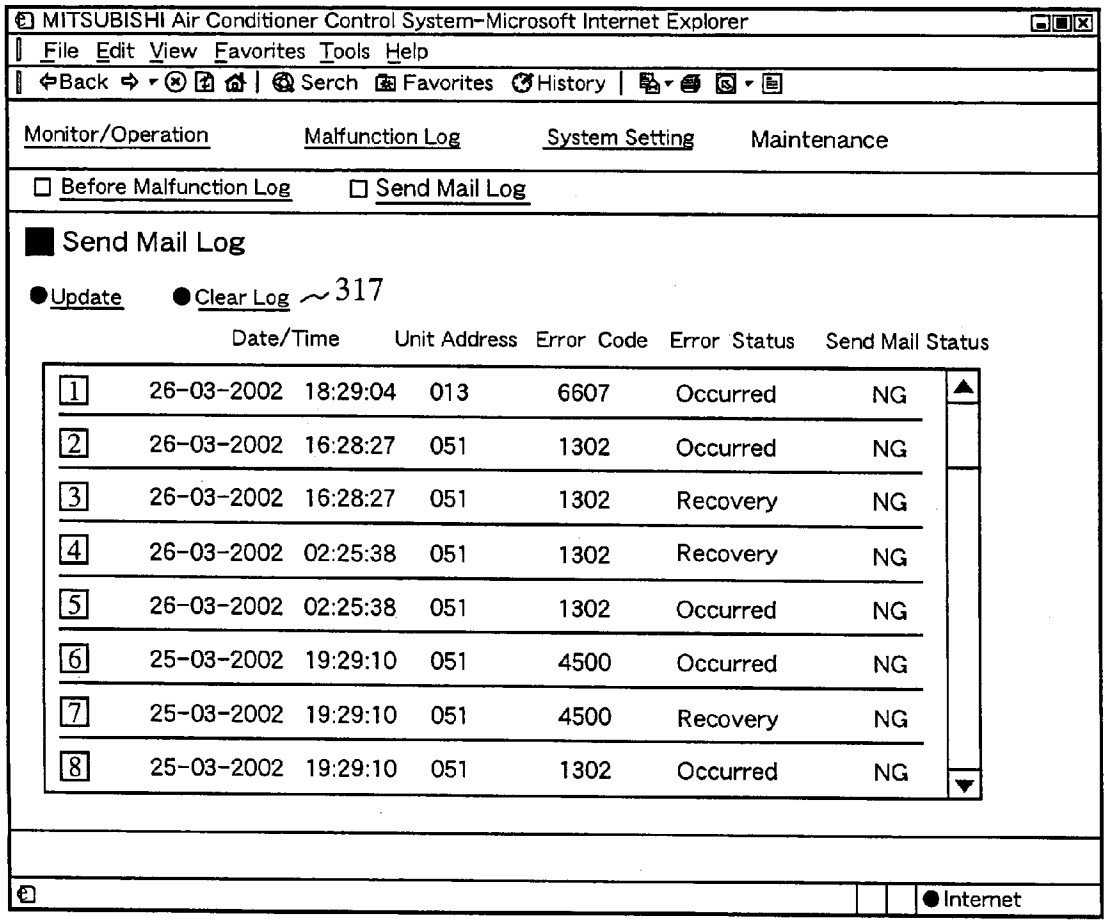
FIG. 12 shows a screen of a mail transmission log in the maintenance menu to be displayed on the remote monitor terminal in the air conditioner control system according to the first embodiment.

FIG. 12 shows a screen of a mail transmission log in the maintenance screen menu.

When the abnormal occurs in one unit, the screen displays mail transmission time, unit address (in malfunction state), error code (number), error status (error occurred or recovery), and send mail status (OK or NG).

When the user clicks the "Clear Log" button 317 on the screen menu, the above information is cleared from the screen. Thus, because the user can recognize the transmission time and the content of the mail from the screen, the user can check whether the central remote controller 5 is in malfunction or the abnormal state occurs in the Internet provider (or ISP: Internet service provider) when the remote monitor terminal 15 does not receive the mail. Thus, because by the building manager and the maintenance technician of the building, where the air conditioner control system is mounted, can handle the management information processing section 12*a* in the central remote controller 5 shown in FIG. 1 in order to control the maintenance information, they can obtain the operation information of the air conditioner through a general-purpose personal computer with highly cost-performance, which is easily available in commerce, as the remote monitor terminal 15. Furthermore, because the personal computer as the remote monitor terminal 15 includes a keyboard, a mouse and a display panel of a large sized screen, the operability thereof becomes easy and high. The user can use the remote monitoring of the air conditioners easily. The personal computer as the remote monitor terminal 15 can execute both the browser software 16 for the remote monitoring and a paperwork software simultaneously without causing any effect to each other. Thus, because the personal computer can be used as the monitoring device, it is possible to reduce the entire cost of the air conditioner control system.

Because the central remote controller 5 comprises the operation determination means 7, the display means 9 and the operation information processing section 11, the normal user can operate the air conditioners without causing any trouble even if a malfunction occurs in the personal computer as the remote monitor terminal 15, for example. Further, because the management information processing section 12*a* in the central remote controller 5 performs continuously the monitoring and controlling of the state of the air conditioners installed in the building, no trouble causes in the facility management for the building.

As described above, according to the first embodiment, the air conditioner control system has the following configuration:

The central remote controller 5 is connected to the air conditioners through the transmission medium 4 as the dedicated transmission wiring and also to the remote monitor terminal 15 made up of the personal computer, in which the browser software 16 has been installed, through the transmission medium 14; and the central remote controller 5 has the operation determination means 7, the operation information processing section 11, and the management information processing section 12*a*. The operation determination means 7 has the operation setting means 8 including the various switches, each of which is independent in function. The operation information processing section 11 processes the operation information from the operation determination means 7 and the operation information of the air conditioners collected, and generates the screen information to be displayed on the display means 9. The management information processing section 12*a* relays and transmits the control information from the remote monitor terminal 15 to the air conditioners in order to control the operation of the air conditioners, and processes the operation information of the air conditioners collected and generates the screen information to be displayed on the remote monitor terminal 15.

Because the first embodiment has the configuration described above, it is not necessary to incorporate any dedicated devices, to install additional software, and to perform installation work for performing the remote monitoring. Further, it is possible for the distributor, a maintenance technician, and a facility designer to easily handle the air conditioner system, and also possible to suppress the cost of the system construction and maintenance of the air conditioner system as low as a possible.

Second Embodiment

Figure 13:
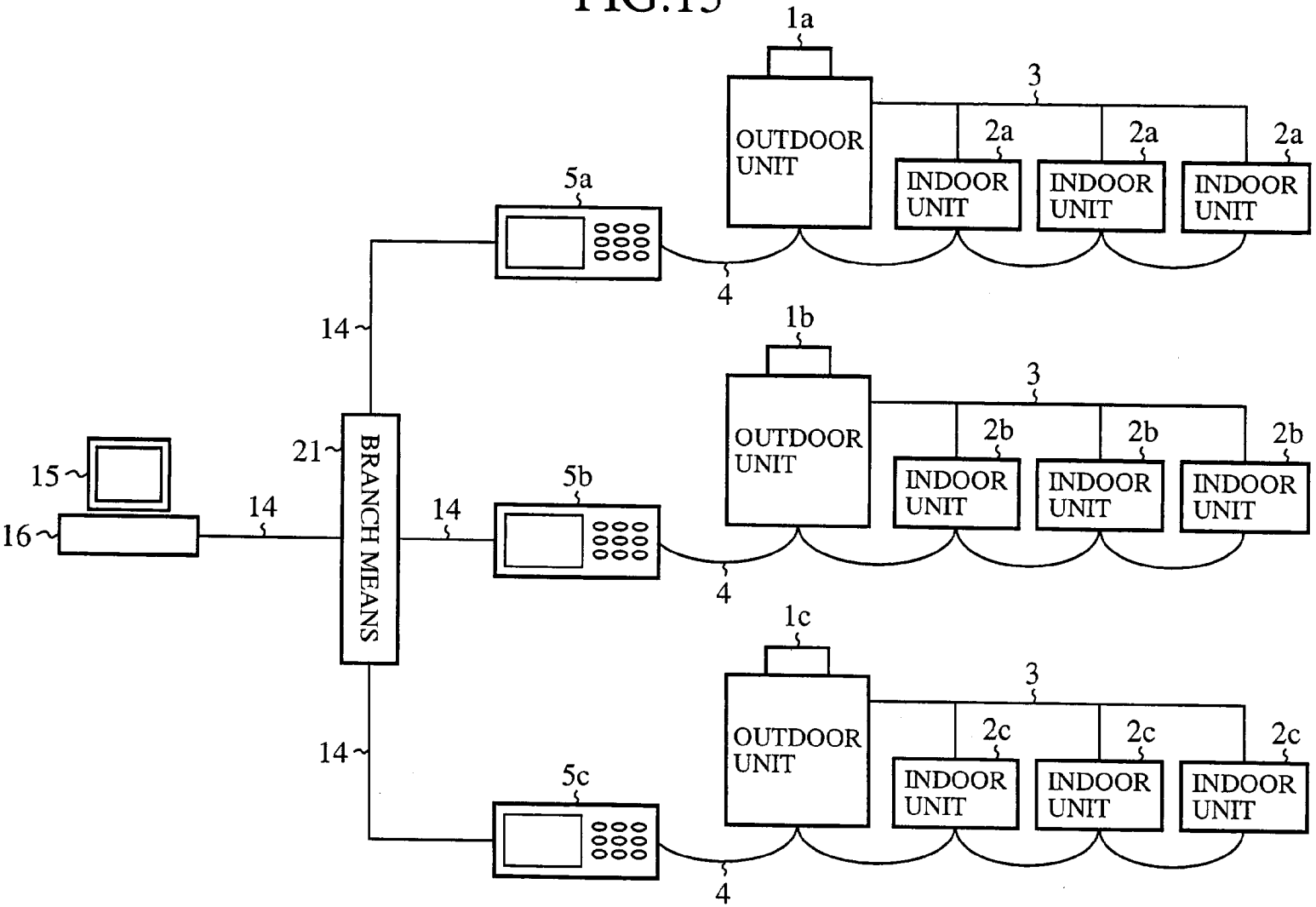
FIG. 13 is a block diagram showing a configuration of an air conditioner control system according to a second embodiment of the present invention.

FIG. 13 is a block diagram showing a configuration an air conditioner control system according to a second embodiment of the present invention. In FIG. 13, reference characters 5*a*, 5*b*, and 5*c* designate central remote controllers connected to the corresponding air conditioners through the transmission medium 4. Each of the air conditioners comprises each of the outdoor units 1*a*, 1*b* and 1*c* and each of the corresponding indoor units 2*a*, 2*b*, and 2*c*. The central remote controllers 5*a*, 5*b* and 5*c* divide the air conditioners into several groups and controls the operation of the corresponding group. Each central remote controller collects the operation information of the corresponding air conditioner in order to monitor the operation state thereof.

Reference number 14 designates a transmission medium capable of being connected to a personal computer and LAN. Reference number 21 denotes a branch means using a hub capable of connecting a plurality of LAN devices. Other components are the same of those in the first embodiment shown in FIG. 1. Accordingly, the same components will be referred to as the same reference number.

As shown in FIG. 13, the remote monitor terminal 15 having the browser software is connected to a plurality of remoter controllers 5*a*, 5*b*, and 5*c* through the transmission medium 14 and the branch means 21 using the hub. Each of the central remote controllers 5*a*, 5*b* and 5*c* has the same function of the central remote controller 5 shown in FIG. 1.

Next, a description will now be given of the operation of the air conditioner control system of the second embodiment.

The process of the central remote controllers 5*a*, 5*b*, and 5*c* are the same of that of the central remote controller 5 in the first embodiment shown in FIG. 1.

In each of the central remote controllers 5*a*, 5*b*, and 5*c*, the management information processing section 12*a* collects and processes the operation information of the air conditioner and generates the screen information to be displayed on the remote monitor terminal 15. The management information processing section 12*a* sends the screen information to the remote monitor terminal 15 through the transmission means 13, the transmission medium 14 and the branch means 21. In order to monitor the operation state of the air conditioner, the personal computer as the remote monitor terminal 15 displays the screen information on a display means (not shown) using the browser software The remote monitor terminal 15 transmits the control information to the central remote controllers 5*a*, 5*b* and 5*c* through the transmission medium 14 and the branch means 21. The management information processing section 12*a* in each of the remote controllers 51, 5*b*, and 5*c* receives and relays the control information from the remote monitor terminal 15 and then sends the information to the air conditioners in order to control them.

As described above, according to the second embodiment, the same effect of the first embodiment can be obtained. In addition, a plurality of the central remote controllers 5*a*, 5*b*, and 5*c* are connected to the remote monitor terminal 15 through the transmission means 14(capable of connecting the remote controllers 5*a*, 5*b*, and 5*c* to the personal computer as the remote monitor terminal 15) and the branch means 21 using the hub (capable of connecting a plurality of LAN devices). Accordingly, even if the concept of the present invention is applied to a large-scale air conditioner control system, it is not necessary to incorporate the supervision controller 111 used in the conventional case. It is thereby possible to provide the air conditioner control system with a low cost.

Further, according to the second embodiment, because there is no dependent relationship between the central remote controllers 5*a*, 5*b*, and 5*c*, it is not necessary to perform the following cases in the prior art: To change or replace the software in the facility controller 106 for relaying signal of new functions and replace the software in the central controller 111 when an air conditioner of a new type is added into the conventional system.

This saves the increasing of the cost and the service and the user can perform the development of the central remote controllers 5*a*, 5*b*, and 5*c* and the management thereof easily.

Still furthermore, according to the second embodiment, it is possible for the remote monitor terminal 15 to control the operation of each air conditioner through the central remote controllers 5*a*, 5*b*, and 5*c*. Thereby, it is possible to replace the remote controllers 103*a*, 103*b*, and 103*c*, each connected to the transmission medium 104 in the conventional one, with the remote monitor terminal 15. In the conventional system, each of the remote controller 103*a*–103*c* and the wiring thereof are limited according to the aspects of a layout, a cost of parts and work, and a layout design where the remote controllers are placed. Further, because the interface function of each of the remote controllers 103*a*–103*c* is limited according to the specification thereof, it is impossible to control the operation of the air conditioners through a transmission medium 14 using the general-purpose LAN. On the contrary, the system configuration of the second embodiment can control the operation of the air conditioners through the transmission medium 14 using a general purpose LAN.

Third Embodiment

Figure 14:
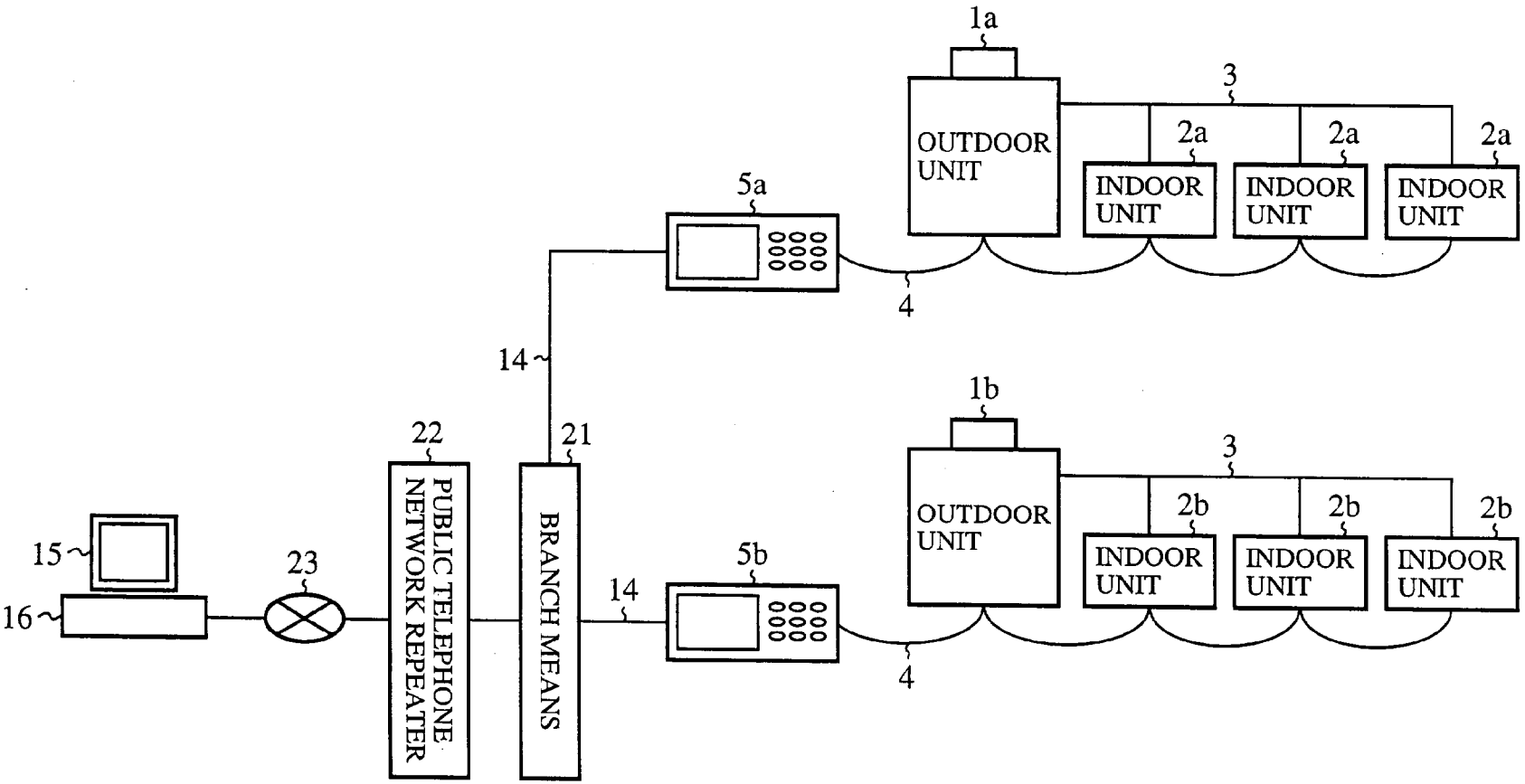
FIG. 14 is a block diagram showing a configuration of an air conditioner control system according to a third embodiment of the present invention.

FIG. 14 is a block diagram showing a configuration of an air conditioner control system according to a third embodiment of the present invention. In FIG. 14, reference number 22 designates a public telephone network repeater using a router connected to the branch means 21. Reference number 23 denotes a public telephone network. Other components in the system of the third embodiment are the same of those of the second embodiment shown in FIG. 13. As shown in FIG. 14, the central remoter controllers 5*a* and 5*b* are connected to the remote monitor terminal 15 incorporating the browser software 16 through the transmission medium 14 (to be connected to the personal computer which is also connectable to a LAN), the branch means 21 using the hub, the public telephone network repeater 22 using the router, and the public telephone network 23.

Next, a description will now be given of the operation of the air conditioner control system of the third embodiment.

The central remote controllers 5*a* and 5*b* and the remote monitor terminal 15 incorporating the browser software 16 operate the same manner of the second embodiment other than the manner of the communication through the public telephone network repeater 22 and the public telephone network 23.

The router to be used as the public telephone network repeater 22 is a dial-up router or a broadband router, for example. Because the router as the public telephone network repeater 22 can distinguish telephone numbers, the router has a security function to cancel the access from telephone numbers that are not registered (or authorized) and a selection function to connect the remote monitor terminal 15 to the desired central remote controller.

As described above, according to the third embodiment, in addition to the same effect of the second embodiment, it is possible to select one of the central remote controllers 5*a* and 5*b* through one public telephone network 23 under the configuration where the public telephone network repeater 22 using the router having the security function and the selection function and the public telephone network 23 are connected. It is thereby possible for the remote monitor terminal 15 to control the operation of the air conditioners and to easily develop the central remote controllers 5*a* and 5*b*.

Fourth Embodiment

Figure 15:
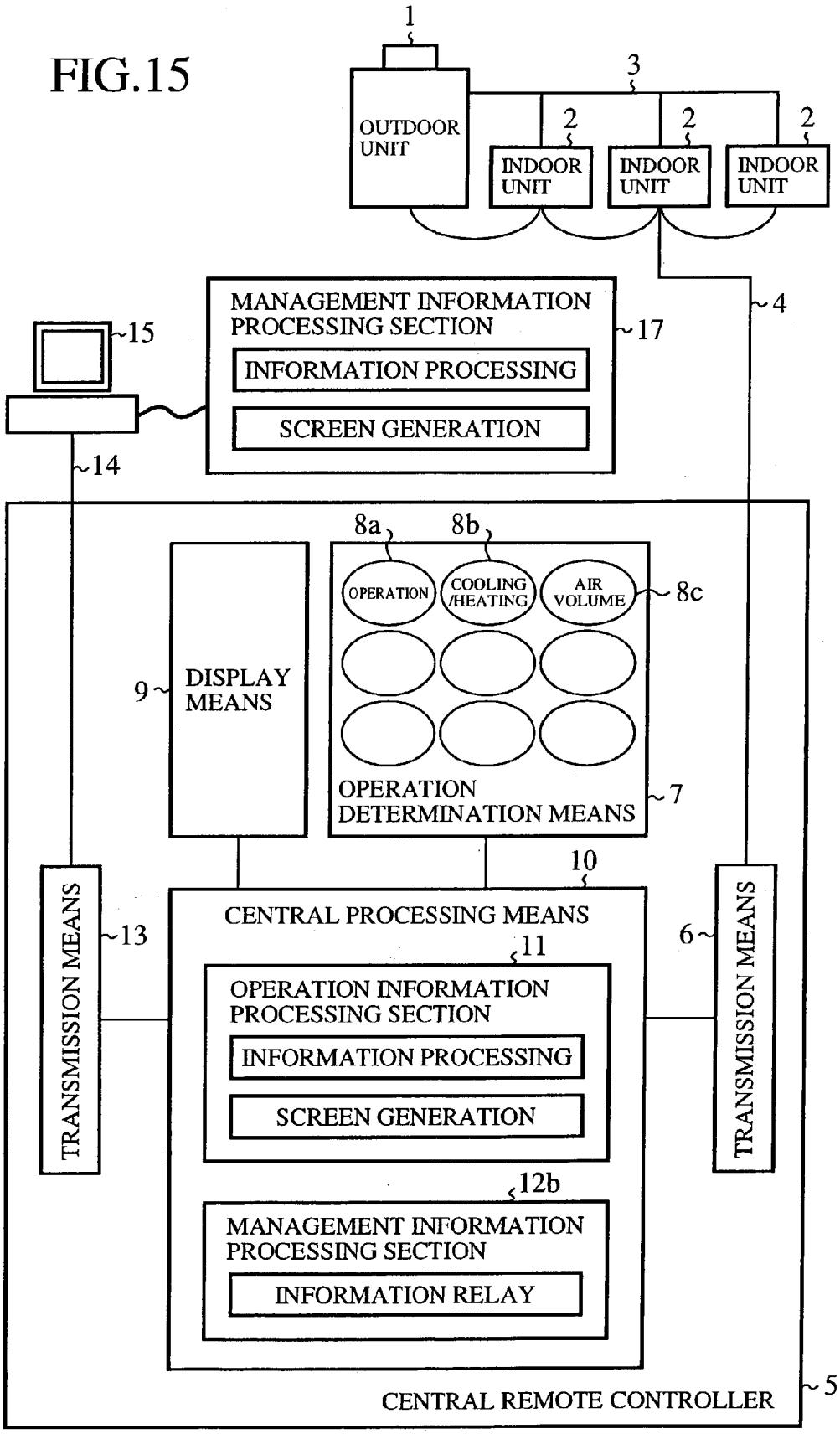
FIG. 15 is a block diagram showing a configuration of an air conditioner control system according to a fourth embodiment of the present invention.

FIG. 15 is a block diagram showing a configuration of an air conditioner control system according to a fourth embodiment of the present invention. In FIG. 15, reference character 12*b* designates a management information processing section incorporated in the central processing means 10 in the central remote controller 5 relays the control information from the remote monitor terminal 15 and transmits the control information to the air conditioner, and further collects the operation information from the air conditioner and transmits the operation information to the remote monitor terminal 15. Reference number 17 denotes a management information processing means as a program software installed in the remote monitor terminal 15. This management information processing means as the program software processes the operation information of the air conditioner transmitted from the central remote controller 5 in order to generate the screen information, and displays the screen information on a display means (not shown). Other components in the system of the fourth embodiment are the same of those of the first embodiment shown in FIG. 1, and therefore the same components will be referred to with the same reference numbers.

Next, a description will now be given of the operation of the air conditioner control system of the fourth embodiment.

The operation information processing section 11 in the central remote controller 5 performs the same operation of that of the first embodiment. The management information processing section 12*b* relays the control information transmitted from the remote monitor terminal 15 through the transmission medium 14 and the transmission means 13, and then transmits the control information to the air conditioner through the transmission means 6 and the transmission medium 4 in order to control the operation of the air conditioner.

The management information processing section 12*b* relays the operation information of the air conditioner collected through the transmission medium 4 and the transmission means 6, and transmits the information to the remote monitor terminal 15 through the transmission means 13 and the transmission medium 14.

The management information processing means 17 incorporated in the remote monitor terminal 15 displays the operation information in order to monitor the operation state of the air conditioner transmitted from the central remote controller 5.

As described above, according to the fourth embodiment, the following configuration of the system is constructed. The central remote controller 5 is connected to the air conditioner through the transmission medium 4 made up of the dedicated communication line, and further connected to the remote monitor terminal 15 made up of the personal computer through the transmission medium 14. The central remote controller 5 has the operation determination means 7, the operation information processing section 11, and the management information processing section 12*b*. The operation determination means 7 has the operation setting means 8 comprising the plural buttons such as the buttons 8*a*, 8*b*, and 8*c*, each button is dependent on function. The operation information processing section 11 processes the operation information obtained by the operation determination means 7 and the collected operation information of the air conditioner, and generates the screen information to be displayed on the display means 9. The management information processing section 12*b* relays the control information from the remote monitor terminal 15 and transmits the information to the air conditioner in order to control the operation thereof. The remote monitor terminal 15 incorporates the management information processing means 17 for generating the screen information. Thus, by using the above configuration, a distributor (or seller), a maintenance technician, and a facility designer can handle the remote monitor controller 15 easily. Further, it is possible to set the cost of the system construction and working as small as possible.

In addition, according to the fourth embodiment, because the remote monitor terminal 15 can process the operation information of all of the air conditioners connected to a plurality of the central remote controllers 5 simultaneously and the operation information of the air conditioners can be transmitted to outside, it is possible for the personal computer as the remote monitor terminal 15 to manage the operation of the air conditioners mounted on a building.

Furthermore, the fourth embodiment has the same effect of the second embodiment when the fourth embodiment has the configuration of the second embodiment, where the remote monitor terminal 15 is connected to a plurality of the central remote controllers 5*a*–5*c* through the branch means 21, and by this configuration, the remote monitor terminal 15 can operate each of the air conditioners.

Still furthermore, the fourth embodiment has the same effect of the third embodiment when the fourth embodiment has the configuration of the third embodiment, where the remote monitor terminal 15 is connected to a plurality of the central controllers 5*a* and 5*b* through the branch means 21, the public telephone network repeater 22, and the public telephone network 23.

Fifth Embodiment

Figure 16:
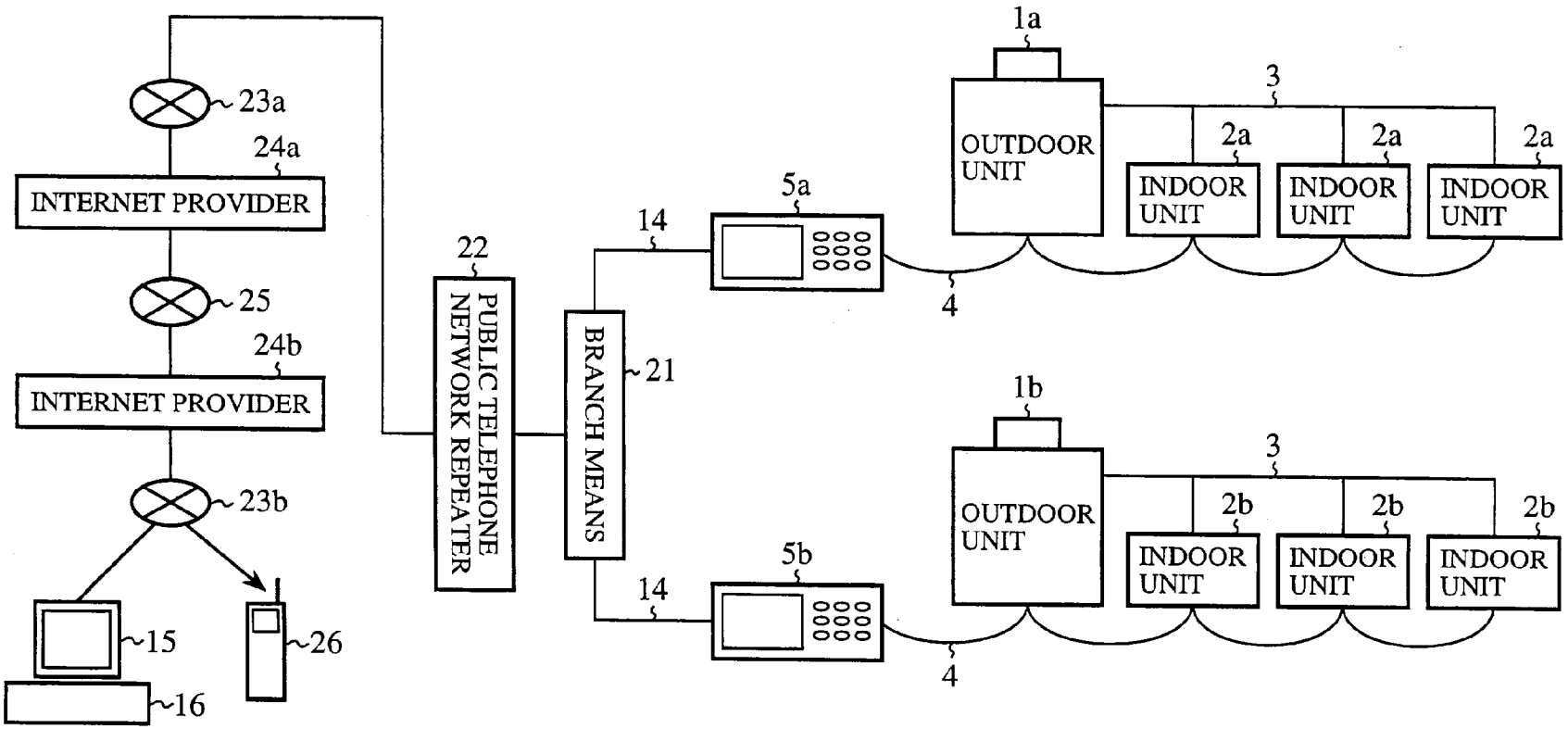
FIG. 16 is a block diagram showing a configuration of an air conditioner control system according to a fifth embodiment of the present invention.

FIG. 16 is a block diagram showing a configuration of an air conditioner control system according to a fifth embodiment of the present invention. In FIG. 16, reference character 23*a* and 23*b*, each designate a public telephone network, 24*a* and 24*b*, each denotes an Internet provider, 25 indicates the Internet connected to the Internet providers 24*a* and 24*b*, and 26 designates a cellular phone having a function of E-mail communication and a function to connect the Internet. In the fifth embodiment, the remote monitor terminal 15 also has the same function of the E-mail communication. Other components are the same of those in the first embodiment shown in FIG. 1.

As shown in FIG. 16, a single or a plurality of the central remote controllers 5*a* and 5*b* are connected to the Internet provider 24*a* through the transmission medium 14 connectable to the personal computer with the LAN, the branch means 21 using the hub, the public telephone network repeater 22 using the router, and the public telephone network 23*a*. The remote monitor terminal 15 incorporating the browser software 16 is also connected to the Internet provider 24*b* through the public telephone network 23*b*.

Next, a description will now be given of the operation of the air conditioner control system of the fifth embodiment.

The basic operation of both the central remote controllers 5*a* and 5*b* and the remote monitor terminal 15 incorporating the browser software 16 is the same as that of the second embodiment, other than the communication through the public telephone network repeater 22 using the router, the public telephone networks 23*a* and 23*b*, the Internet providers 24*a* and 24*b*, and the Internet 25.

The management information processing section 12*a* in each of the central remote controllers 5*a* and 5*b* generates E-mail information regarding the operation information of the air conditioner and the control information obtained from the remote monitor terminal 15, and then transmits the generated one to the Internet provider 24*a* through the transmission means 13, the transmission medium 14, the branch means 21, the public telephone network repeater 22, and the public telephone network 23*a*. The Internet provider 24*a* receives the E-mail information and transmits the E-mail information to the remote monitor terminal 15 or the cellular phone 26 connected to another Internet provider 24*b* through the Internet 25.

Because the cellular phone 26 has a voice function, the cellular phone 26 informs the abnormal state to the user by the voice through a speaker therein when receiving the E-mail information under the condition where each of the central remote controllers 5*a* and 5*b* connected to the corresponding air conditioners automatically transmits to a service technician carrying the cellular phone 26 the E-mail information regarding the abnormal state of the air conditioner through the Internet.

Like the first embodiment, the air conditioner control system of the fifth embodiment has the following configuration. Each of the central remote controllers 5*a* and 5*b* has the management information processing section 12*a*, and the remote monitor terminal 15 incorporates the browser software 16. It is also possible to have the following configuration, like the fourth embodiment. Each of the central remote controllers 5*a* and 5*b* has the management information processing section 12*b* and the remote monitor terminal 15 has the management information processing means 17.

As described above, the air conditioner control system of the fifth embodiment has the same effect of that of the third embodiment or the fourth embodiment. In addition, it is possible to improve the quality of the maintenance service because the operation information of the air conditioners and the control information from the remote monitor terminal 15 can be transmitted immediately as the E-mail information.

Sixth Embodiment

Figure 17:
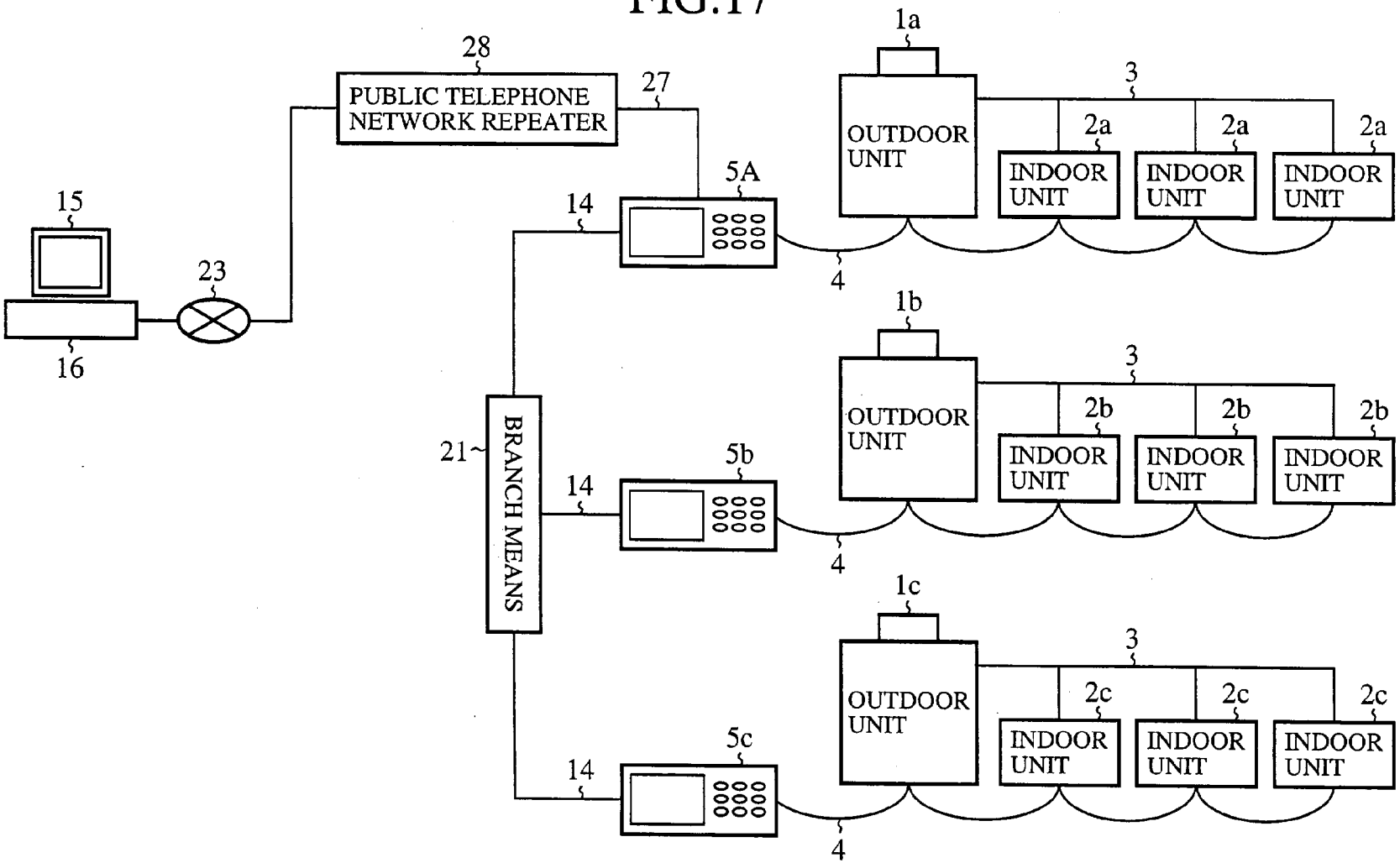
FIG. 17 is a block diagram showing a configuration of an air conditioner control system according to a sixth embodiment of the present invention.

FIG. 17 is a block diagram showing a configuration of an air conditioner control system according to a sixth embodiment of the present invention. In FIG. 17, reference number 27 designates a transmission medium using RS-232C interface, and 28 denotes a public telephone network repeater using a modem. Reference character 5A indicates a central remote controller (second central remote controller) connected to the air conditioner (second air conditioner) comprising the outdoor unit 1*a* and the indoor unit 2*a* through the transmission medium 4. The central remote controller 5A is also connected to the central remote controllers 5*b* and 5*c* (as the first central remote controller) through the transmission medium 14 connectable to the personal computer with the LAN and the branch means 21 using the hub. The central remote controller 5A is further connected to the remote monitor terminal 15 incorporating the browser software 16 through the transmission medium 27 using the RS232C interface, the public telephone network repeater 28 using the modem, and the public telephone network 23.

The central remote controllers 5*b* and 5*c* are connected to the branch means 21 through the transmission medium 14, like the configuration of the second embodiment, and also connected to the air conditioner (as first air conditioner) made up of the outdoor unit 1*b* and the indoor unit 2*b* and the air conditioner (as second air conditioner) made up of the outdoor unit 1*c* and the indoor unit 2*c*.

Figure 18:
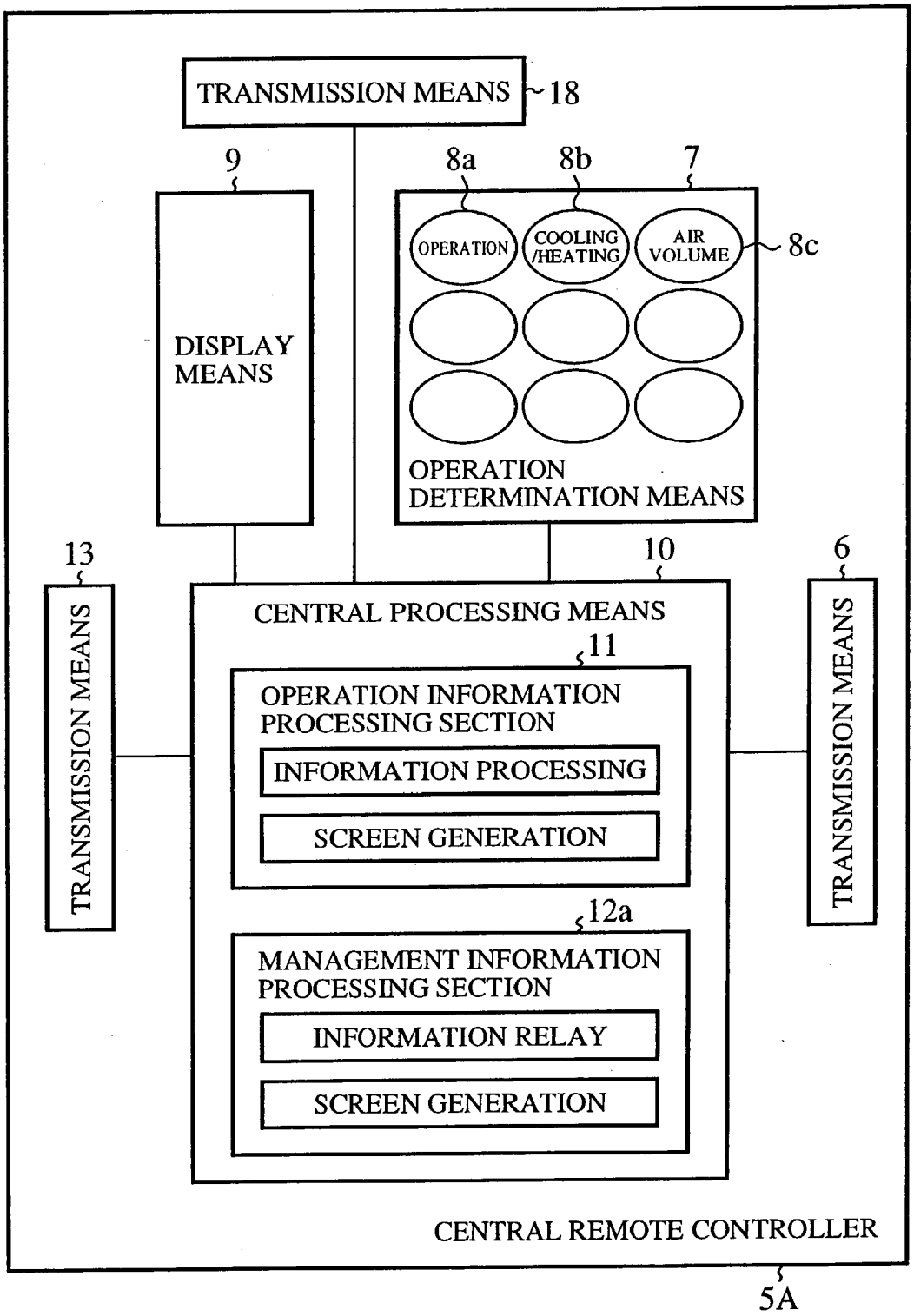
FIG. 18 is a block diagram showing an internal configuration of a central remote controller in the air conditioner control system according to the sixth embodiment.

FIG. 18 is a block diagram showing an internal configuration of the central remote controller 5A. The central remote controller 5A comprises a transmission means 18 (third transmission means) capable of communicating with the remote monitor terminal 15 connected to the transmission medium 27 using the RS232C interface, in addition to the configuration of the central remote controller 5 shown in FIG. 1 of the first embodiment.

The transmission medium 13 (second transmission means) communicates with the central remote controllers 5*b* and 5*c* through the transmission medium 14 and the branch means 21.

Figure 19:
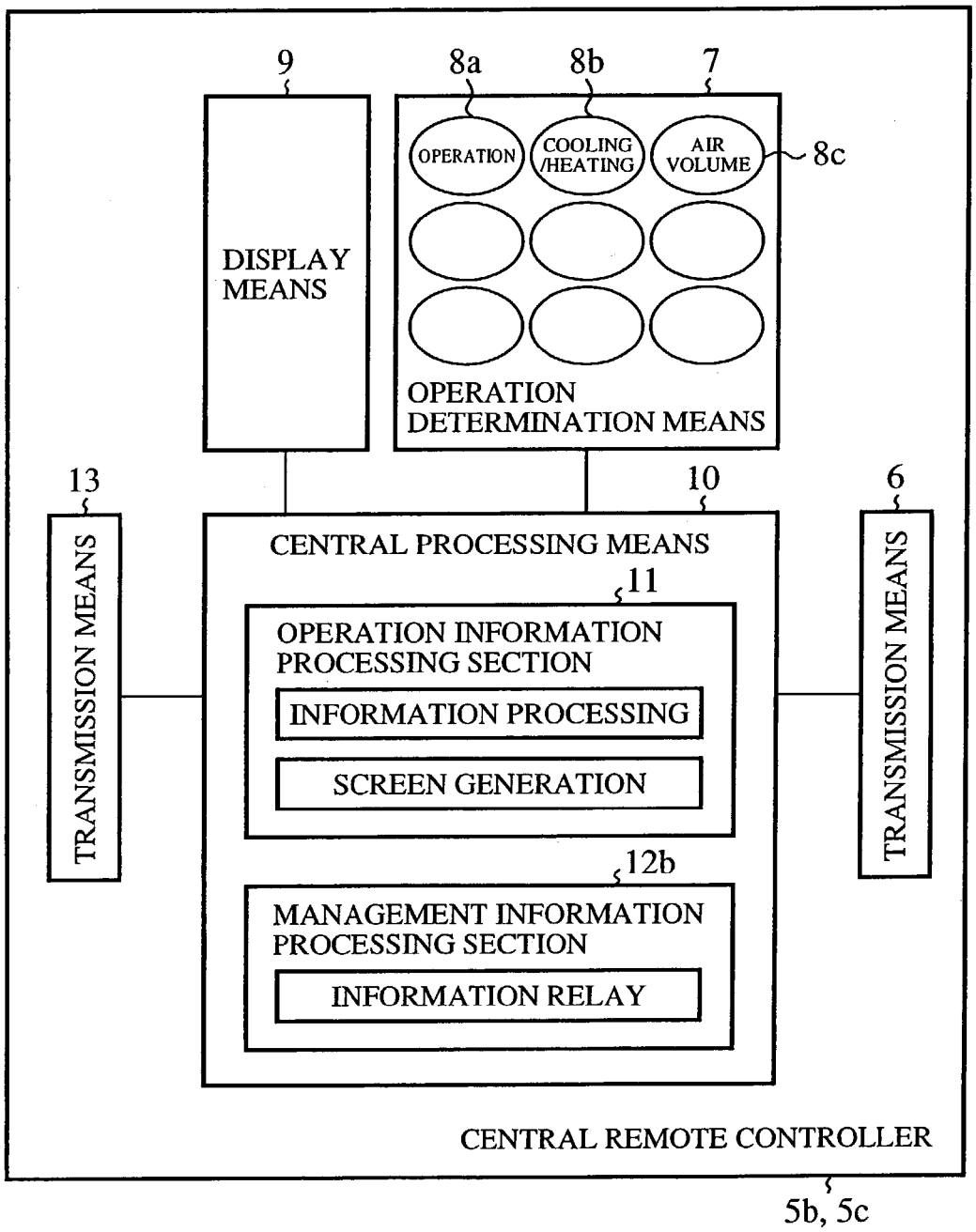
FIG. 19 is a block diagram showing another internal configuration of the central remote controller in the air conditioner control system according to the sixth embodiment.

FIG. 19 is a block diagram showing another internal configuration of each of the central remote controllers 5*b* and 5*c*. Each central remote controller above has the same configuration of the central remote controller 5 of the fourth embodiment shown in FIG. 15. In particular, each of the central remote controllers 5*b* and 5*c* of the sixth embodiment is capable of communicating with the central remote controller 5A through the transmission medium 14 and the branch means 21.

Next, a description will now be given of the operation of the air conditioner control system of the sixth embodiment.

The operation information processing section 11 in each of the central remote controllers 5A, 5*b*, and 5*c* is the same of that of the first embodiment.

The management information processing section 12*b* in each of the central remote controller 5*b* and 5*c* collects the operation information of the air conditioner (as the first air conditioner comprised of the outdoor unit 1*b* and the indoor unit 2*b*) and the operation information of the air conditioner (also as the first air conditioner comprised of the outdoor unit 1*c* and the indoor unit 2*c*) through the transmission medium 4 and the transmission means 6, and then transmits the operation information collected to the central remote controller 5A through the 5 transmission means 13, the transmission medium 14, and the branch means 21.

The management information processing section 12*a* in the central remote controller 5A collects the operation information of the air conditioner composed of the outdoor unit 1*a* and the indoor unit 2*a* through the transmission medium 4 and the transmission means 6 (first transmission means) in addition to the operation information transmitted from the central remote controllers 5*b* and 5*c* through the transmission means 13, generates the screen information, and transmits the generated one to the remote monitor terminal 15 through the transmission means 18, the transmission medium 27, the public telephone network repeater 28, and the public telephone network 23.

When receiving the screen information from the central remote controller 5A, the remote monitor terminal 15 displays the screen information received on the display means (not shown) using the browser software. Thereby, the user can monitor the operation state of the air conditioners.

The remote monitor terminal 15 transmits the control information to the central remote controller 5A through the public telephone network 23, the public telephone network repeater 28, and the transmission medium 27.

When receiving the control information transmitted from the remote monitor terminal 15 through the transmission means 18, the management information processing section 12*a* relays and transmits the received one to the air conditioners made up of the outdoor unit 1*a* and the indoor unit 1*b* through the transmission means 6 and the transmission medium 4 and also transmits it to the central remote controllers 5*b* and 5*c* through the transmission means 13, the transmission medium 14, and the branch means 21.

The management information processing section 12*b* of each of the central remote controllers 5*b* and 5*c* relays the control information from the remote monitor terminal 15 through the transmission means 13 and then transmits the control information to the air conditioners, made up of the outdoor unit 1*b* and the indoor unit 2*b*, and the outdoor unit 1*c* and the indoor unit 2*c*, respectively, through the transmission means 6 and the transmission medium 4.

As described above, according to the sixth embodiment using the modem as the public telephone network repeater which is available to get in the market and easy to install, upon having the same effect of the first embodiment, there is the effect to obtain the air conditioner control system with a low cost because the sixth embodiment does not require the supervision controller 111 necessary for the conventional air conditioner control system (see FIG. 59) even if a large sized air conditioner control system is constructed.

Furthermore, according to the sixth embodiment, it is possible for the remote monitor terminal 15 to control the operation of each of the air conditioners through the corresponding central remote controllers 5A, 5*b*, and 5*c*. Thus, the sixth embodiment has the effect where the remote monitor terminal 15 acts as each of the conventional remote controllers 103*a*–103*c* connected to the transmission medium 104 for each of the conventional air conditioners.

Seventh Embodiment

Figure 20:
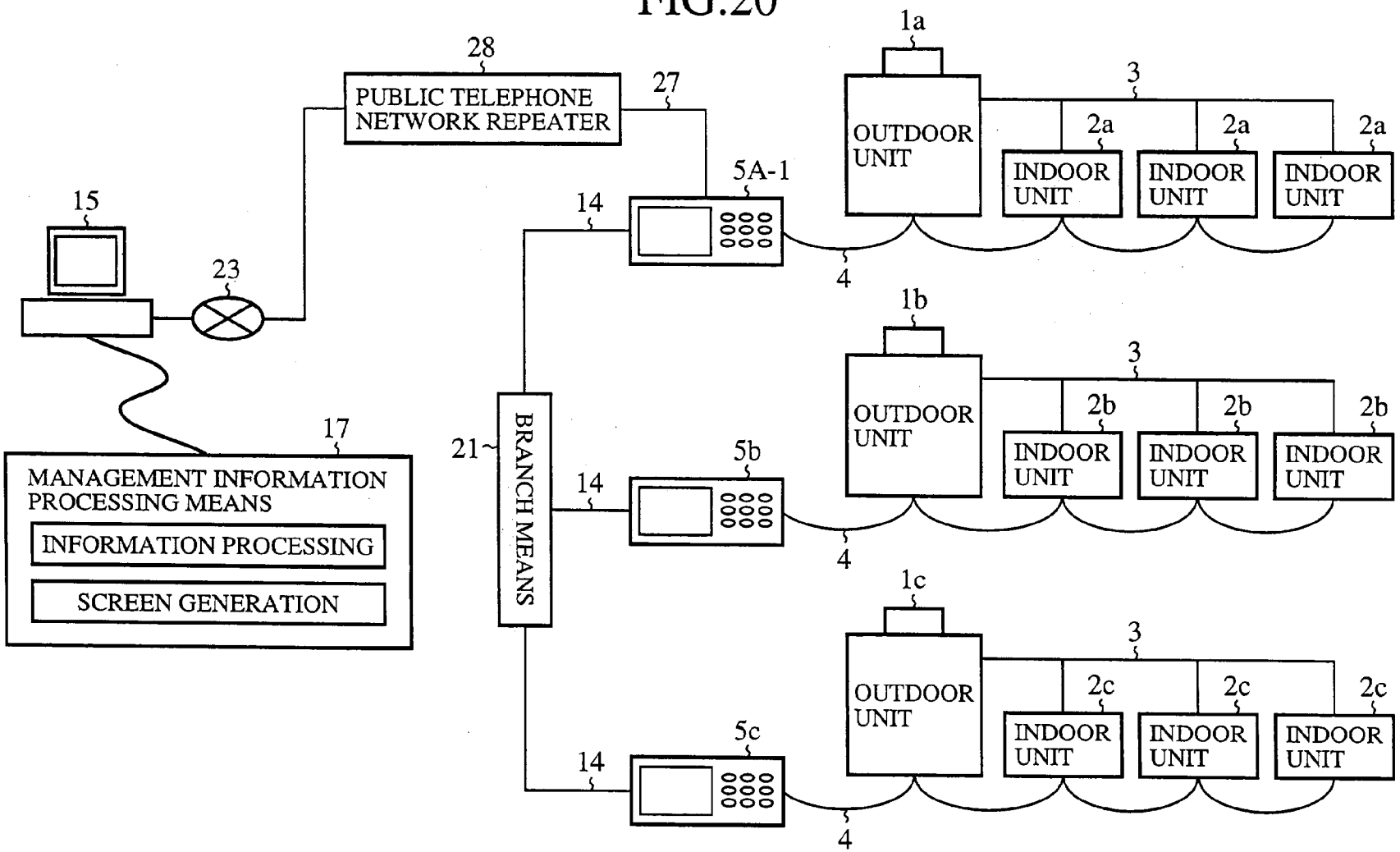
FIG. 20 is a block diagram showing a configuration of an air conditioner control system according to a seventh embodiment of the present invention.

FIG. 20 is a block diagram showing a configuration of an air conditioner control system according to a seventh embodiment of the present invention. The remote monitor terminal 15 in the sixth embodiment shown in FIG. 17 incorporates the browser software 16. On the contrary, the remote monitor terminal 15 of the seventh embodiment incorporates the management information processing means 17 as a building maintenance software, like the configuration of the fourth embodiment. Reference character 5A-1 indicates a central remote controller for the air conditioner comprising the outdoor unit 1*a* and the indoor units 2*a*. Other components are the same of those in the sixth embodiment shown in FIG. 17, and therefore the same components will be referred to with the same reference numbers.

Figure 21:
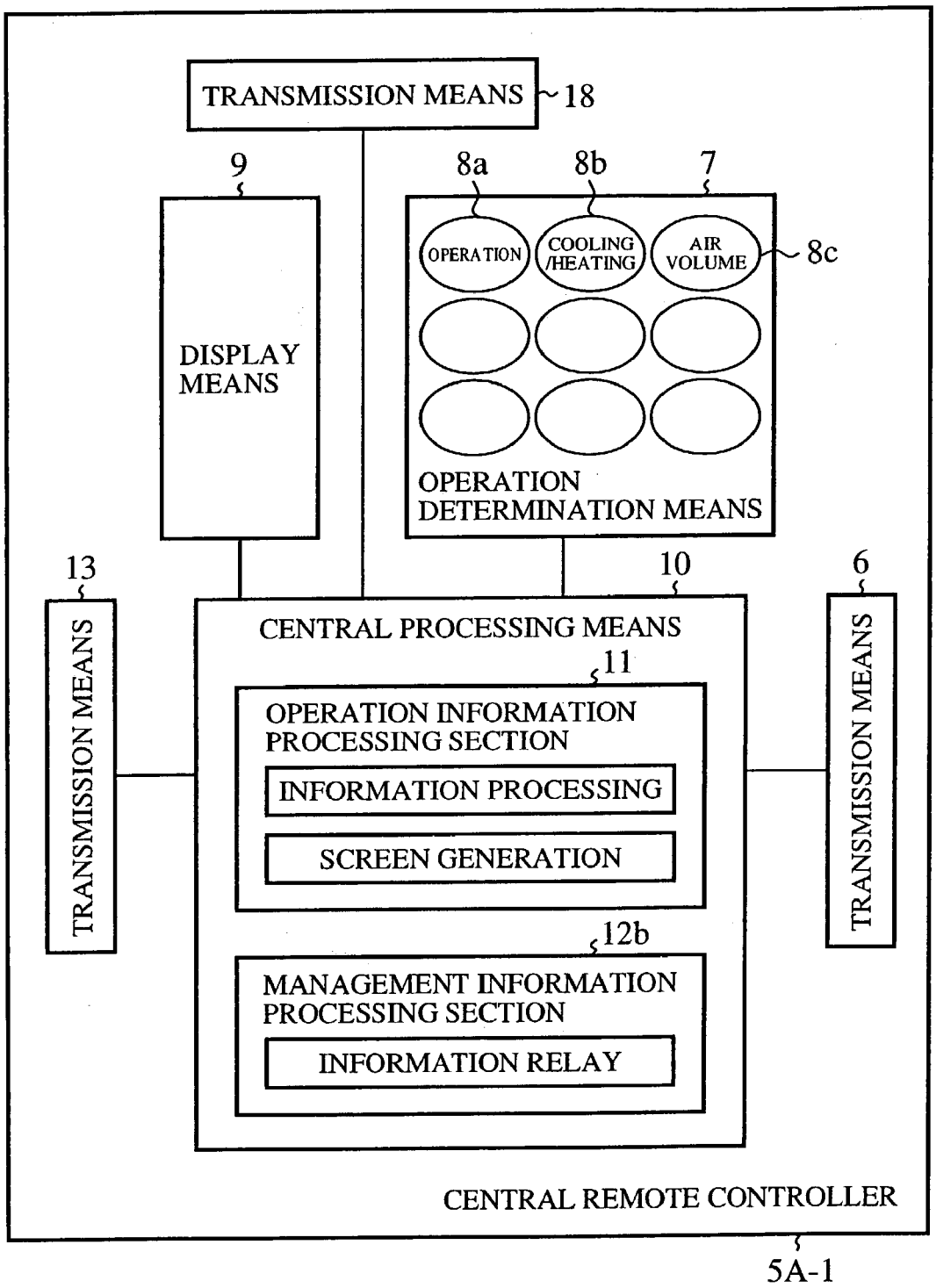
FIG. 21 is a block diagram showing an internal configuration of a central remote controller in the air conditioner control system according to the seventh embodiment.

FIG. 21 is a block diagram showing the internal configuration of the central remote controller 5A-1. The central remote controller 5A-1 shown in FIG. 21 comprises the transmission means 18 (third transmission means) capable of communicating with the remote monitor terminal 15 connected to the transmission medium 27 using the RS232C interface, in addition to the configuration of the central remote controller 5 shown in FIG. 15 of the fourth embodiment.

By the way, the transmission medium 13 (as the second transmission means) communicates with the central remote controllers 5*b* and 5*c* (as the first central remote controller) through the transmission medium 14 and the branch means 21.

The central remote controllers 5*b* and 5*c* have the same configuration of the sixth embodiment shown in FIG. 19.

Next, a description will now be given of the operation of the air conditioner control system of the seventh embodiment.

The operation information processing section 11 in each of the central remote controller 5A-1 (as the second central remote controller) and the central remote controllers 5*b* and 5*c* is the same of that of the first embodiment.

The management information processing section 12*b* in each of the central remote controller 5*b* and 5*c* collects the operation information of the air conditioner (comprised of the outdoor unit 1*b* and the indoor unit 2*b*) and the operation information of the air conditioner (comprised of the outdoor unit 1*c* and the indoor unit 2*c*) through the transmission medium 4 and the transmission means 6, and then transmits the collected operation information to the central remote controller 5A-1 through the transmission means 13, the transmission medium 14, and the branch means 21.

The management information processing section 12*a* in the central remote controller 5A-1 collects the operation information of the air conditioner (as the second air conditioner) composed of the outdoor unit 1*a* and the indoor unit 2*a* through the transmission medium 4 and the transmission means 6 (as the first transmission means) in addition to the operation information transmitted from the central remote controllers 5*b* and 5*c* through the transmission means 13, and transmits the collected operation information to the remote monitor terminal 15 through the transmission means 18, the transmission medium 27, the public telephone network repeater 28, and the public telephone network 23.

When receiving the operation information from the central remote controller 5A-1, the management information processing section 17 in the remote monitor terminal 15 generates the screen information based on the operation information received, and displays the generated one on the display means (not shown). Thereby, the user can monitor the operation state of the air conditioners.

The remote monitor terminal 15 transmits the control information to the central remote controller 5A-1 through the public telephone network 23, the public telephone network repeater 28, and the transmission medium 27.

When receiving the control information transmitted from the remote monitor terminal 15 through the transmission means 18, the management information processing section 12*b* in the central remote controller 5A-1 relays and transmits the received one to the air conditioner through the transmission means 6 and the transmission medium 4 and also transmits it to the central remote controllers 5*b* and 5*c* through the transmission means 13, the transmission medium 14, and the branch means 21.

The management information processing section 12*b* of each of the central remote controllers 5*b* and 5*c* relays the control information from the remote monitor terminal 15 through the transmission means 13 and then transmits the control information to the air conditioners, made up of the outdoor unit 1*b* and the indoor unit 2*b*, and the outdoor unit 1*c* and the indoor unit 2*c*, respectively, through the transmission means 6 and the transmission medium 4.

As described above, according to the seventh embodiment, because the central remote controller 5A-1 in a plurality of the central remote controllers 5A-1, 5*b*, and 5*c* is used as a main remote controller and only the central remote controller 5A-1 is connected to the remote monitor terminal 15 through the modem as the public telephone network repeater 28, which is available to get in the market and easy to install. Therefore, upon having the same effect of the fourth embodiment, the seventh embodiment has the effect to construct the air conditioner control system with a low cost because the seventh embodiment does not require the supervision controller 111 in the conventional air conditioner control system (see FIG. 59) even if a large sized air conditioner control system is constructed.

Furthermore, according to the seventh embodiment, it is possible for the remote monitor terminal 15 to control the operation of each of the air conditioners through the corresponding central remote controllers 5A-1, 5*b*, and 5*c*. Thus, the sixth embodiment has the effect where the remote monitor terminal 15 acts as each of the conventional remote controllers 103*a*, 103*b*, and 103*c* connected to the transmission medium 104 in each of the conventional air conditioners.

Eighth Embodiment

Figure 22:
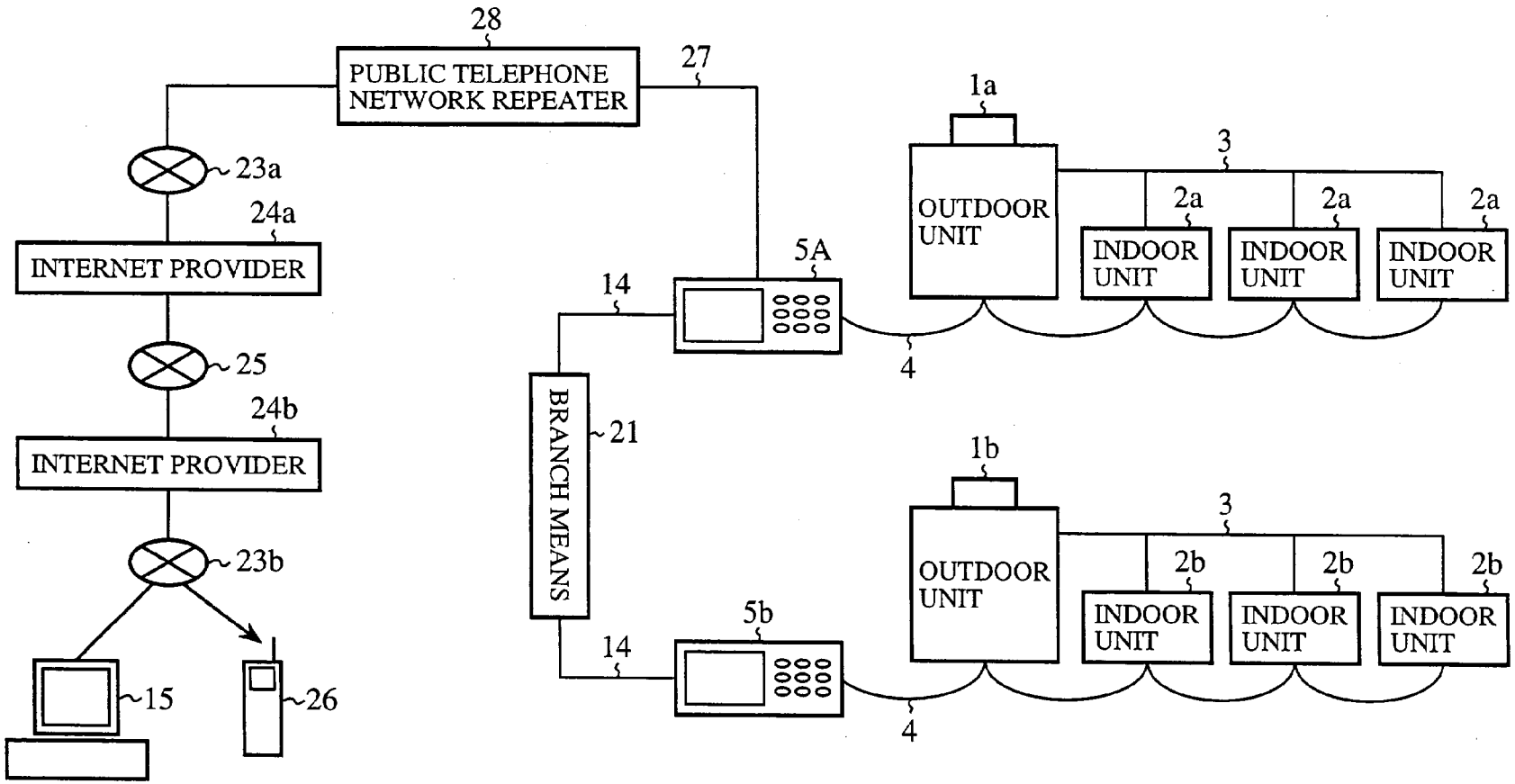
FIG. 22 is a block diagram showing a configuration of an air conditioner control system according to an eighth embodiment of the present invention.

FIG. 22 is a block diagram showing a configuration of an air conditioner control system according to an eighth embodiment of the present invention.

The configuration of the air conditioner control system of the eighth embodiment is capable of communicate between the remote monitor terminal 15 and the cellular phone 16 and the central remote controller 5A or 5A-1 through the Internet providers 24*a* and 24*b* and the Internet 25 in the sixth embodiment shown in FIG. 17, in addition to the configuration of the air conditioner control system of the sixth embodiment shown in FIG. 17 or of the seventh embodiment shown in FIG. 20.

Although the internal configuration of the central remote controller 5A or 5A-1 of the eighth embodiment has the same configuration of the sixth embodiment shown in FIG. 18 or of the seventh embodiment shown in FIG. 21, the management information processing section 12*a* (see FIG. 18) or the management information processing section 12*b* (see FIG. 19) has the function to generate the E-mail information.

Next, a description will now be given of the operation of the air conditioner control system of the eighth embodiment.

The management information processing section 12*a* or 12*b* in the central remote controller 5A, 5A-1, 5*b*, or 5*c* receives operation information transmitted from the air conditioners or control information transmitted from the remote monitor terminal 15, and makes E-mail information regarding the operation information of the air conditioners or regarding the control information. The management information processing section 12*a* or 12*b* transmits the Email information to the Internet provider 24*a* through the transmission means 18, the transmission medium 27 using the RS232C interface, the public telephone network repeater 28, and the public telephone network 23.

When receiving the E-mail information, the Internet provider 24*a* transmits the received E-mail information to the remote monitor terminal 15 or the cellular phone 26 connected to another Internet provider 24*b* through the Internet.

As described above, according to the eighth embodiment, in addition to the effect of the sixth embodiment or the seventh embodiment, it is possible to improve the quality of the maintenance service because the operation information of the air conditioner or the control information from the remote monitor terminal 15 can be transmitted immediately as the E-mail information.

Ninth Embodiment

Figure 23:
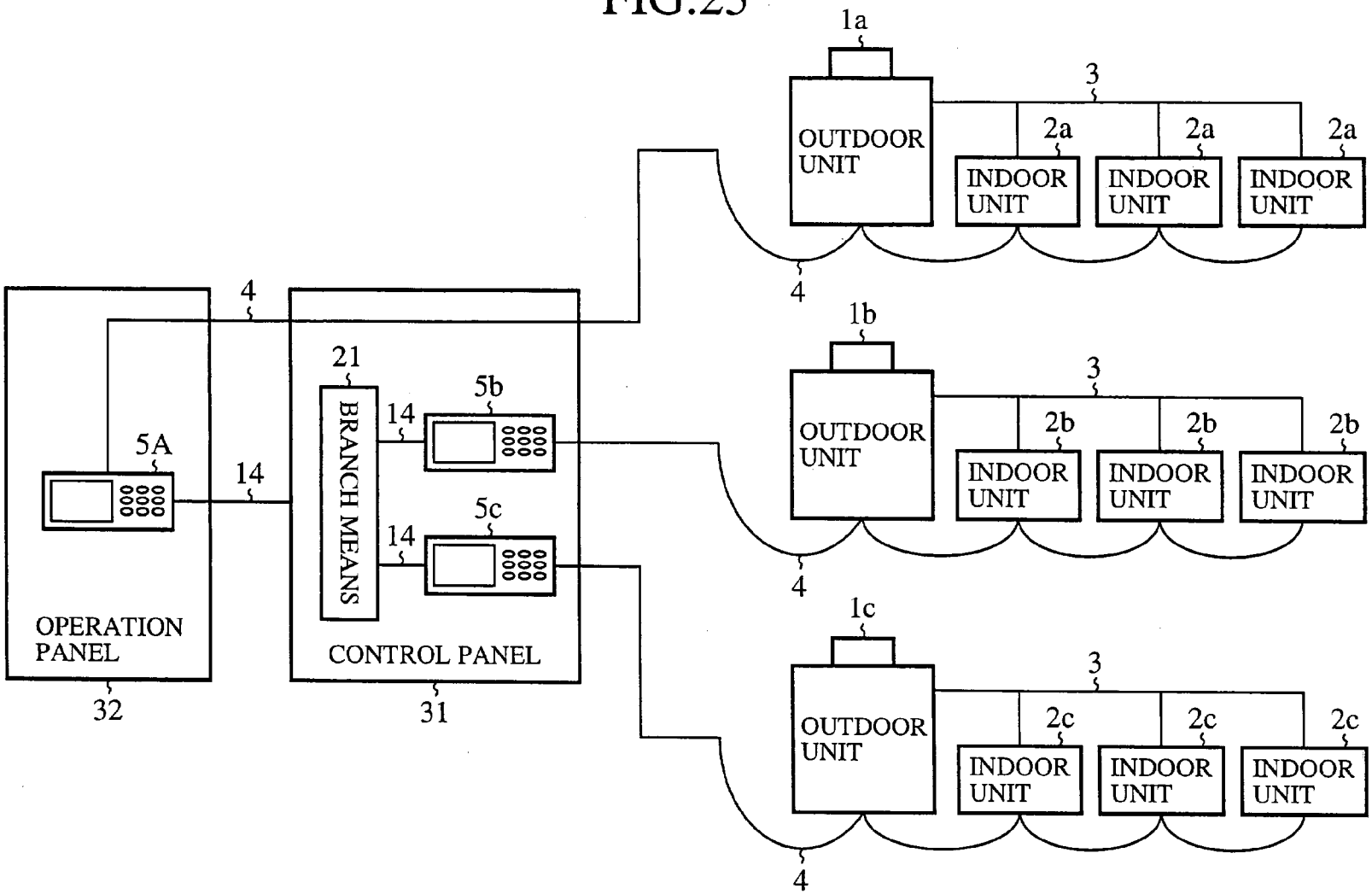
FIG. 23 is a block diagram showing a configuration of an air conditioner control system according to a ninth embodiment of the present invention.

FIG. 23 is a block diagram showing a configuration of an air conditioner control system according to a ninth embodiment of the present invention. In FIG. 23, reference number 31 designates a control panel on which the central remote controllers 5*b* and 5*c* (as the first remote controller), the branch means 21, the transmission medium 4, and the transmission medium 14 are mounted. Reference number 32 denotes an operation panel on which the central remote controller 5A (as the second remote controller), the transmission medium 4, and the transmission medium 14 are mounted. The operation panel 32 is placed in position outside of the control panel 31 or mounted on the control panel 31.

The ninth embodiment shows the layout of the components in the air conditioner control systems according to the first to eighth embodiments. In the layout, because the operation panel 32 on which the central remote controller 5A (or 5A-1) is mounted is mounted outside of the control panel 31 or the surface of the control panel 31, the user can operate the operation determination means 7 easily and watch the display means 9 in the central remote controller 5A (or 5A-1). The manufacture manufactures and provides a package product including the control panel 31 and the operation panel 32.

It is possible to build the remote controlling of the air conditioners by connecting the transmission means 18 in the central remote controller 15 to the remote monitor terminal 15 through the public telephone network repeater 28 using the modem.

Further, it is possible to arrange one of the central remote controllers 5*a*, 5*b*, and 5*c* in the system configuration of the second embodiment on the operation panel 32 instead of the central remote controller 5A or 5A-1, for example.

As described above, according to the ninth embodiment, it is possible to provide the control panel 31 and the operation panel 32 in which the central remote controllers 5*b*, 5*c*, and 5A (or 5A-1) are packaged. This can be constructed in a compact form of the air conditioner control system and reduces the work and also decreases the cost of the system construction and the system maintenance.

Tenth Embodiment

Figure 24:
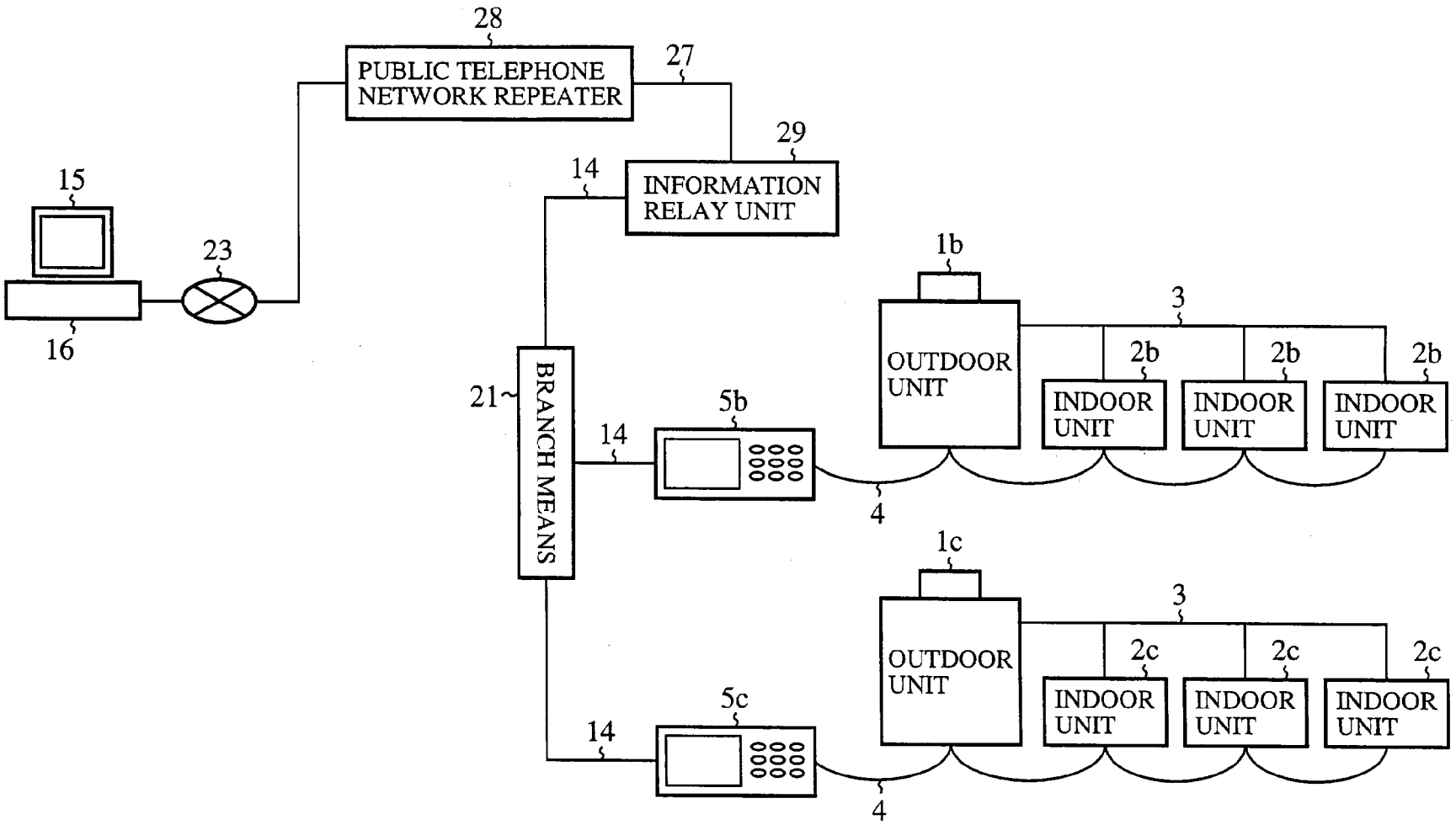
FIG. 24 is a block diagram showing a configuration of an air conditioner control system according to a tenth embodiment of the present invention.

FIG. 24 is a block diagram showing a configuration of an air conditioner control system according to a tenth embodiment of the present invention. In FIG. 24, reference number 29 designates an information relay unit. Other components in the system of the tenth embodiment are the same of those in the sixth embodiment shown in FIG. 17.

Figure 25:
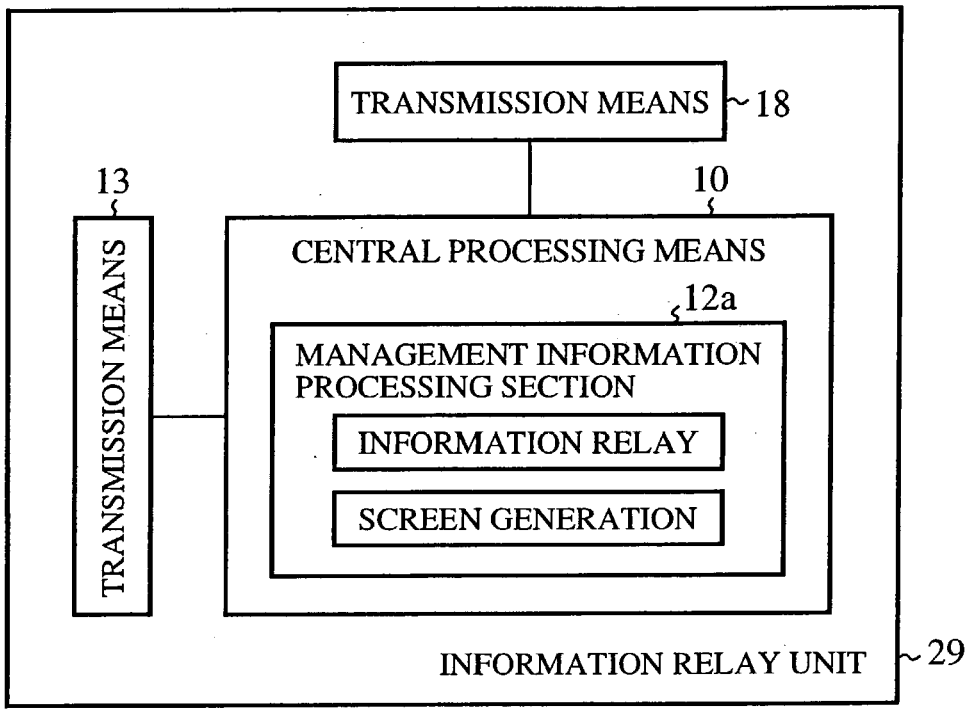
FIG. 25 is a block diagram showing an internal configuration of an information relay unit in the air conditioner control system according to the tenth embodiment of the present invention.

FIG. 25 is a block diagram showing an internal configuration of the information relay unit 29. The information relay unit 29 comprises a central processing means 10, the management information processing section 12*a*, the transmission means 13 (as the first transmission means) connected to the transmission medium 14, and the transmission means 18 (as the second transmission means) connected to the transmission medium 27 using RS232C interface. Each of the central remote controllers 5*b* and 5*c* has the same internal configuration of the sixth embodiment shown in FIG. 19.

Next, a description will now be given of the operation of the air conditioner control system of the tenth embodiment.

Like the sixth embodiment, the management information processing section 12*b* in each of the central remote controllers 5*b* and 5*c* collects the operation information of the air conditioner and transmits the collected one to the information relay unit 29 through the transmission means 13, the transmission medium 14, and the branch means 21.

The management information processing section 12*a* in the information relay unit 29 receives the operation information of the air conditioner transmitted from the central remote controllers 5*b* and 5*c* through the transmission means 13 and then generates the screen information. The management information processing section 12*a* transmits the generated screen information to the remote monitor terminal 15 through the transmission means 18, the transmission medium 27, the public telephone network repeater 28, and the public telephone network 23.

When receiving the screen information from the information relay unit 29, the remote monitor terminal 15 displays the screen information received on the display means (not shown). Thereby, the user can monitor the operation state of the air conditioners.

The remote monitor terminal 15 transmits the control information to the information relay unit 29 through the public telephone network 23, the public telephone network repeater 28, and the transmission medium 27.

When receiving the control information transmitted from the remote monitor terminal 15 through the transmission means 18, the management information processing section 12*a* in the information relay unit 29 relays and transmits the received one to the central remote controllers 5*b* and 5*c* through the transmission means 13, the transmission medium 14, and the branch means 21.

The management information processing section 12*b* in the central remote controller 5*b* or 5*c* relays the control information from the remote monitor terminal 15 through the transmission means 13 and transmits it to the air conditioner through the transmission means 6 and the transmission medium 4.

As described above, because the information relay unit 29 does not have the operation determination means 7, the display means 9, and the transmission means 6, on the contrary, the central remote controller 5A of the sixth embodiment has those means 6, 7, and 9 (see FIG. 19), although the information relay unit 29 has only the interface function to manage the central remote controllers 5*b* and 5*c* and the remote monitor terminal 15, the manufacture can manufacture it at a low cost.

As described above, the tenth embodiment has the same effect of the sixth embodiment. In addition, the information relay unit 29 of a low-cost having a limited function can collect the operation information transmitted from the central remote controllers 5*b* and 5*c* and communicates with the remote monitor terminal 15. This configuration has the effect to reduce the cost of the installation of the components for the remote monitoring.

Eleventh Embodiment

Figure 26:
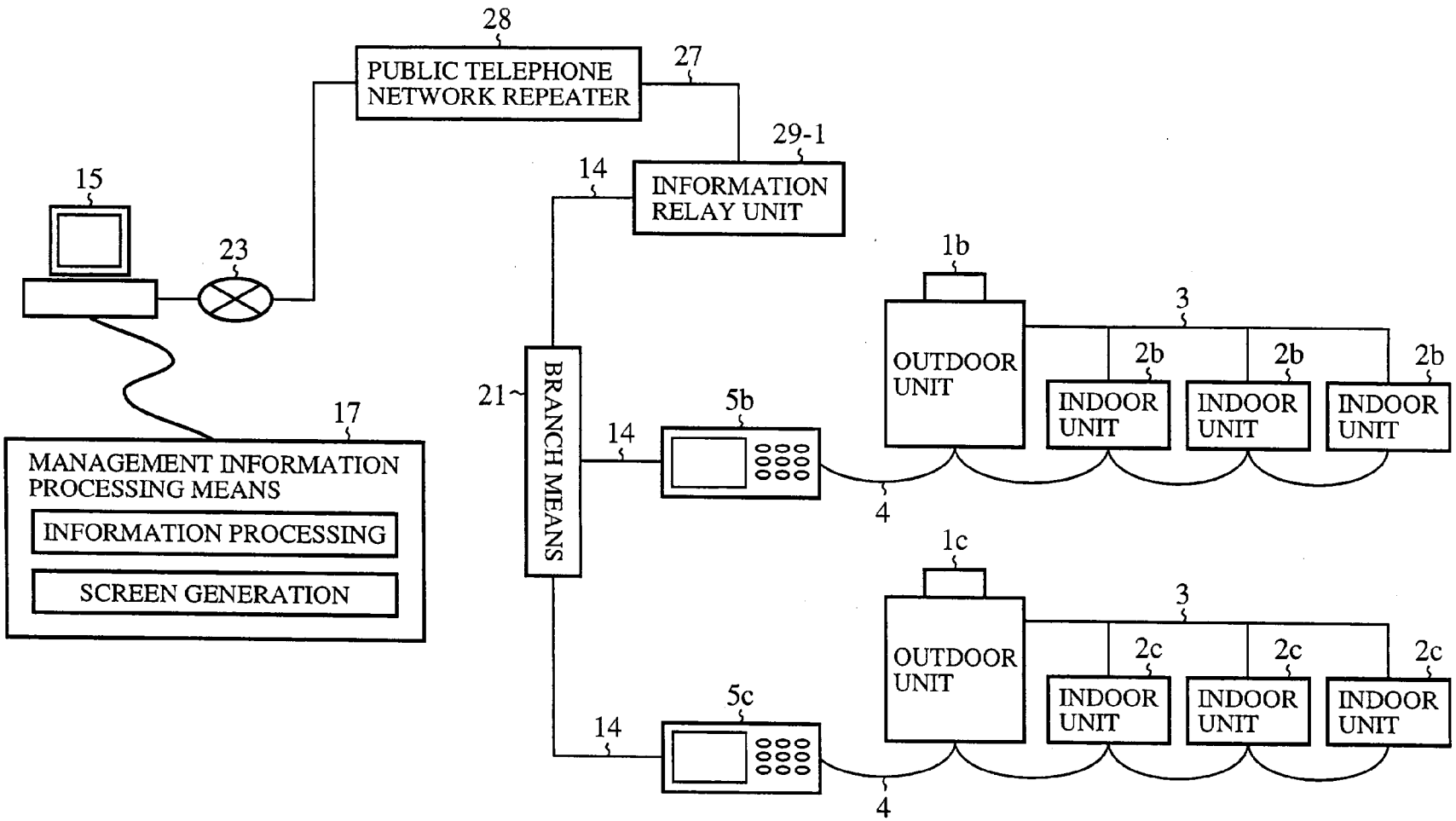
FIG. 26 is a block diagram showing a configuration of an air conditioner control system according to an eleventh embodiment of the present invention.

FIG. 26 is a block diagram showing a configuration of an air conditioner control system according to an eleventh embodiment of the present invention. In FIG. 26, reference character 29-1 designates an information relay unit having only the management function of the remote monitor terminal 15 that is involved in the central remote controller 5A-1 (see FIG. 21). Other components in the system of the tenth embodiment are the same of those in the seventh embodiment shown in FIG. 20.

Figure 27:
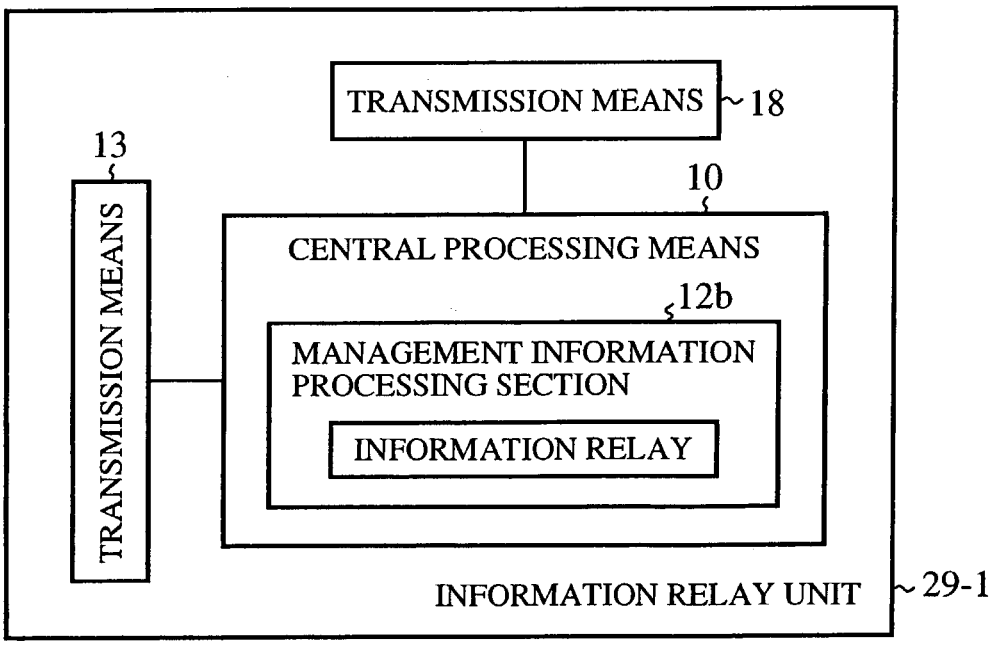
FIG. 27 is a block diagram showing an internal configuration of an information relay unit in the air conditioner control system according to the eleventh embodiment of the present invention.

FIG. 27 is a block diagram showing the internal configuration of the information relay unit 29-1. The information relay unit 29-1 comprises the central processing means 10, the management information processing section 12*b*, the transmission means 13 (as the first transmission means) connected to the transmission medium 14, and the transmission means 18 (as the second transmission means) connected to the transmission medium 27. Each of the central remote controllers 5*b* and 5*c* has the same internal configuration of the sixth embodiment shown in FIG. 19.

Next, a description will now be given of the operation of the air conditioner control system of the eleventh embodiment.

Like the seventh embodiment, the management information processing section 12*b* in each of the central remote controllers 5*b* and 5*c* relays the operation information of the air conditioner and transmits the operation information to the information relay unit 29-1 through the transmission means 13, the transmission medium 14, and the branch means 21.

The management information processing section 12*b* in the information relay unit 29-1 receives the operation information of the air conditioner transmitted from the central remote controllers 5*b* and 5*c* through the transmission means 13, relays the operation information, and transmits the operation information to the remote monitor terminal 15 through the transmission means 18, the transmission medium 27, the public telephone network repeater 28, and the public telephone network 23.

When receiving the operation information, the management information processing means 17 generates screen information based on the received one and displays the screen information on the display means (not shown). Thereby, the user can monitor the operation state of the air conditioners.

The remote monitor terminal 15 transmits the control information to the information relay unit 29-1 through the public telephone network 23, the public telephone network repeater 28, and the transmission medium 27.

When receiving the control information transmitted from the remote monitor terminal 15 through the transmission means 18, the management information processing section 12*b* in the information relay unit 29-1 relays and transmits the received one to the central remote controllers 5*b* and 5*c* through the transmission means 13, the transmission medium 14, and the branch means 21.

The management information processing section 12*b* in the central remote controller 5*b* or 5*c* relays the control information from the remote monitor terminal 15 through the transmission means 13 and transmits it to the air conditioner through the transmission means 6 and the transmission medium 4.

As described above, the eleventh embodiment has the same effect of the seventh embodiment. In addition, the information relay unit 29-1 of a low-cost having a limited function can collect the operation information transmitted from the central remote controllers 5*b* and 5*c* and communicates with the remote monitor terminal 15. This configuration has the effect to reduce the cost of the installation of the components for the remote monitoring.

Twelfth Embodiment

Figure 28:
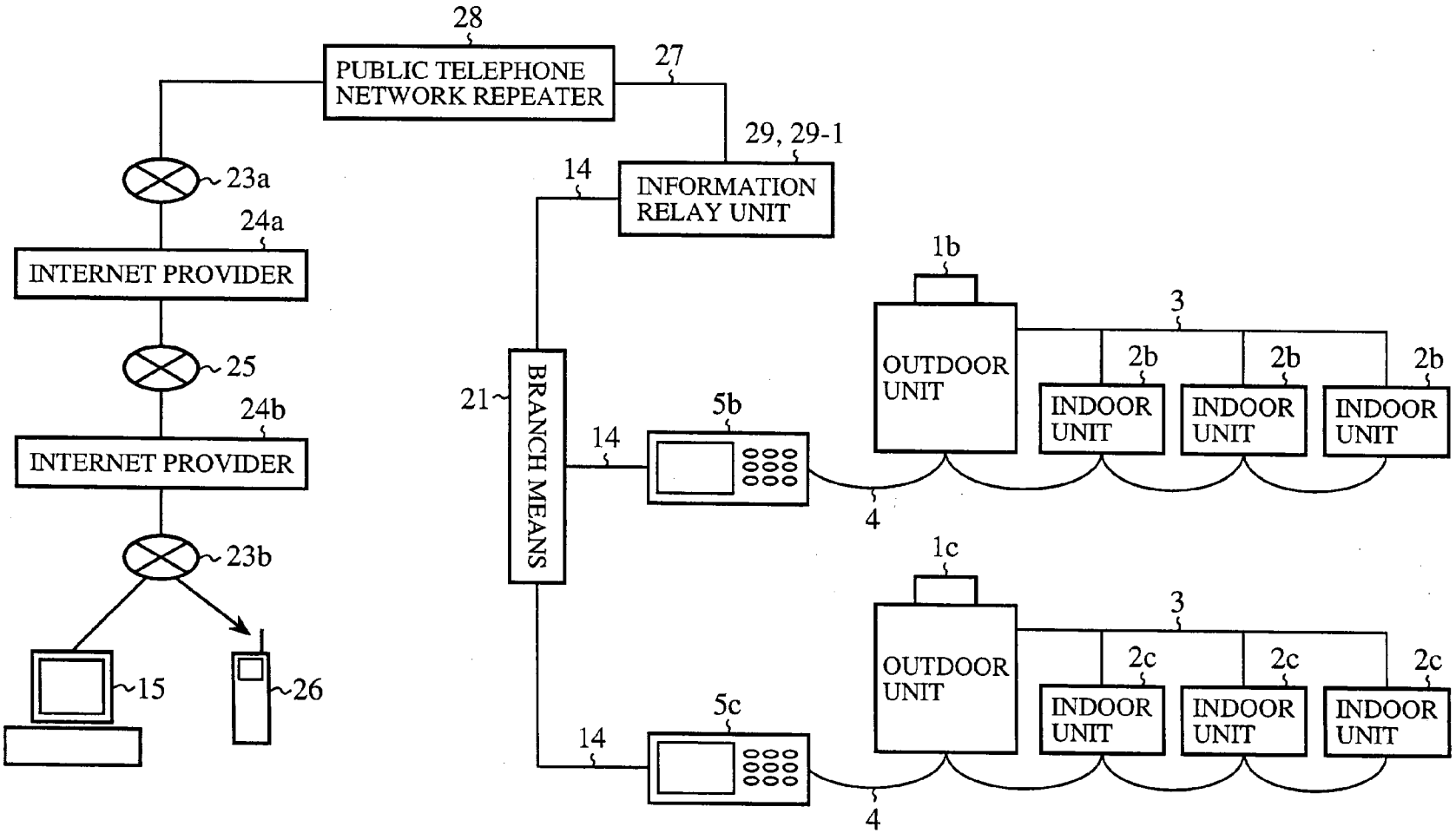
FIG. 28 is a block diagram showing a configuration of an air conditioner control system according to a twelfth embodiment of the present invention.

FIG. 28 is a block diagram showing a configuration of an air conditioner control system according to a twelfth embodiment of the present invention.

The air conditioner control system of the twelfth embodiment further includes the Internet providers 24*a* and 24*b* and the Internet 25 of the fifth embodiment shown in FIG. 16 in addition to the system configuration of the tenth embodiment shown in FIG. 24 or to the system configuration of the eleventh embodiment shown in FIG. 26 through the Internet providers 24*a* and 24*b* and the Internet 25. The configuration of the twelfth embodiment shown in FIG. 28 can communicate between the remote monitor terminal 15 or the cellular phone 26 and the information relay unit 29 or 29-1.

The information relay unit 29 or 29-1 has the same internal configuration of the tenth embodiment shown in FIG. 25 or the eleventh embodiment shown in FIG. 27. The management information processing section 12*a* or 12*b* has the function to generate the E-mail information.

Next, a description will now be given of the operation of the air conditioner control system of the twelfth embodiment.

The management information processing section 12*a* or 12*b* in the information relay unit 29 or 29-1 generates E-mail information regarding the operation information of the air conditioner from the central remote controllers 5*b* and 5*c* received through the transmission means 13 or the control information obtained from the remote monitor terminal 15, and then transmits the generated one to the Internet provider 24*a* through the transmission means 18, the transmission medium 27 using RS232C interface, the public telephone network repeater 28 using a modem, and the public telephone network 23*a*. The Internet provider 24*a* receives the E-mail information and transmits the E-mail information to the remote monitor terminal 15 or the cellular phone 26 connected to another Internet provider 24*b* through the Internet.

Because the cellular phone 26 has a voice function using a speaker, the cellular phone 26 informs the abnormal state to the user by the voice through the speaker when receiving the E-mail information under the condition where each of the central remote controllers 5*a* and 5*b* connected to the corresponding air conditioners automatically transmits to a service technician carrying the cellular phone 26 the E-mail information regarding the abnormal state of the air conditioner through the Internet 25.

As described above, the air conditioner control system of the eleventh embodiment has the same effect of that of the tenth embodiment or the eleventh embodiment. In addition, it is possible to improve the quality of the maintenance service because the operation information of the air conditioners and the control information from the remote monitor terminal 15 can be transmitted immediately as the E-mail information.

Thirteenth Embodiment

Figure 29:
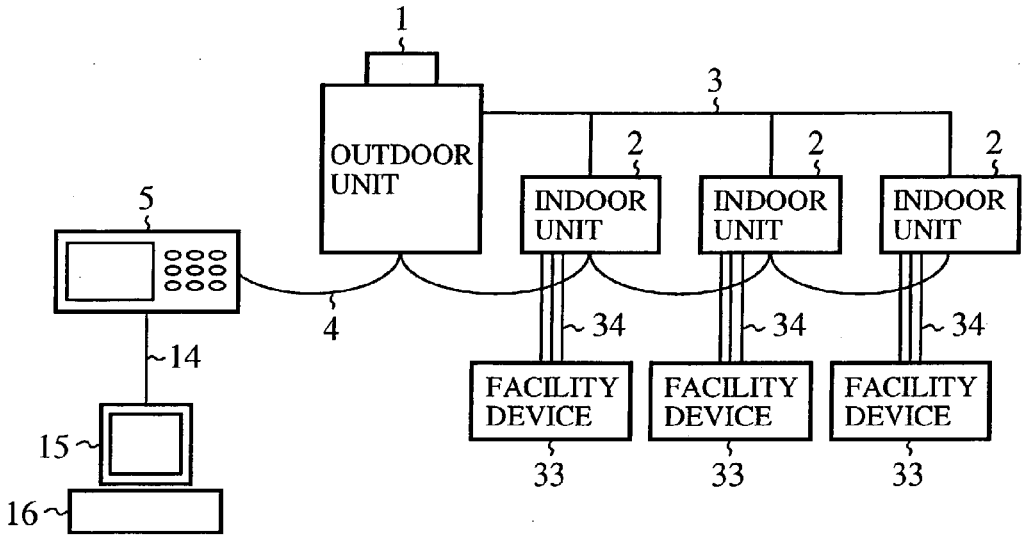
FIG. 29 is a block diagram showing a configuration of an air conditioner control system according to a thirteenth embodiment of the present invention.

FIG. 29 is a block diagram showing a configuration of an air conditioner control system according to a thirteenth embodiment of the present invention. In FIG. 29, reference number 33 designates facility devices connected to the indoor units 2, which are placed together with the air conditioners. Reference number 34 denotes wirings through which the indoor units 2 are connected to the facility devices 33. Other components are the same of those in the first embodiment shown in FIG. 1. Therefore the same components will be referred to with the same numbers.

Figure 30:
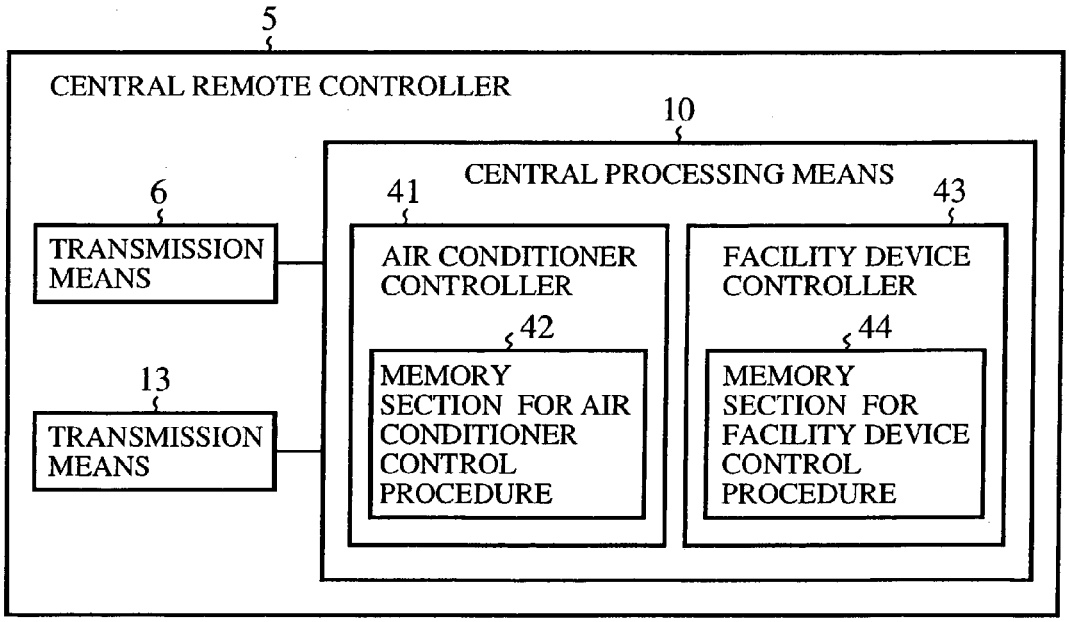
FIG. 30 is a block diagram showing an internal configuration of a central remote controller in the air conditioner control system according to the thirteenth embodiment.

FIG. 30 is a block diagram showing an internal configuration of the central remote controller 5. In FIG. 30, reference number 41 designates an air conditioner controller in the central processing means 10, 42 denotes an air conditioner control procedure memory section, 43 indicates a facility device controller, and 44 designates a facility device control procedure memory section.

When the facility device controller 43 is mounted on a printed circuit board of the air conditioner controller 41, it is possible to omit a dedicated control terminal for controlling the facility devices placed together with the air conditioner devices and a dedicated wiring between the central remote controller 5 and the indoor units 2.

Although the central remote controller 5 in the thirteenth embodiment has the same configuration of that of the first embodiment shown in FIG. 1, the detail configuration thereof is omitted from FIG. 30.

Figure 31:
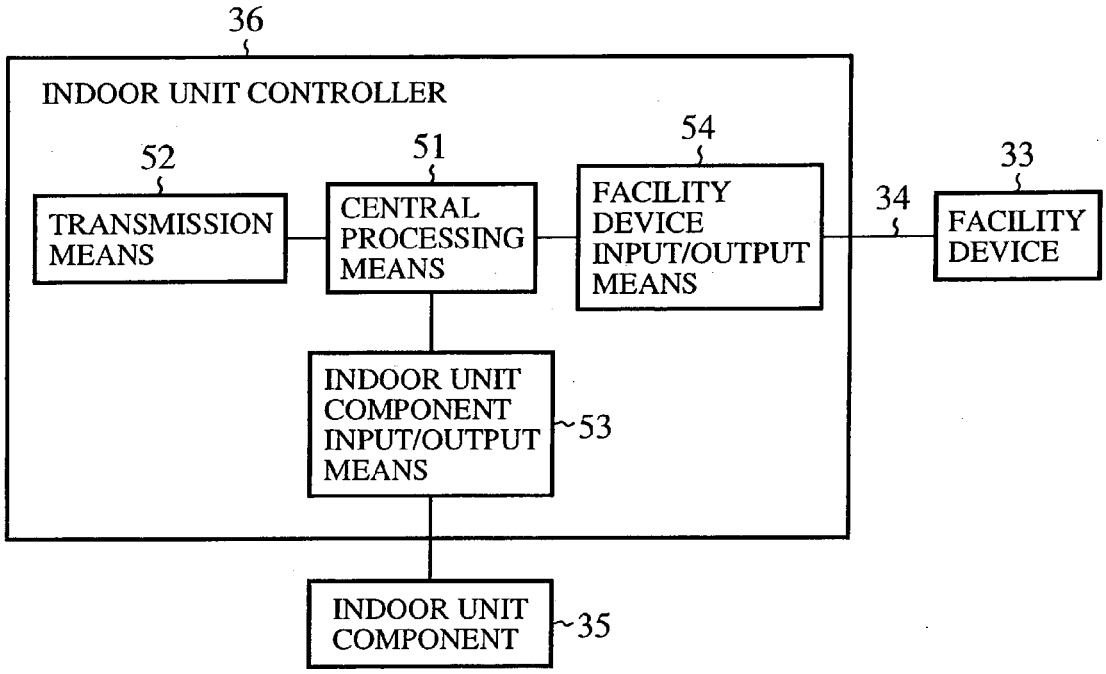
FIG. 31 is a block diagram showing an internal configuration of an indoor unit controller equipped in an indoor unit in the air conditioner control system according to the thirteenth embodiment.

FIG. 31 is a block diagram showing an internal configuration of the indoor unit control means 36 built in the indoor unit 2. In FIG. 31, reference number 51 designates a central processing means, 52 denotes a transmission means connected to the transmission medium 4, 53 indicates an indoor unit component input/output means connected to an indoor unit component 35 built in the indoor unit 2, and 54 designates facility device input/output means connected to the facility device 33 through the wiring 34.

Next, a description will now be given of the operation of the air conditioner control system of the thirteenth embodiment.

The central processing means 10 in the central remote controller 5 transmits to the indoor unit controller 36 built in the indoor unit 2 the request for monitoring the operation state of the facility device 33 (a first facility device) through the transmission means 6 and the transmission medium 4 according to the control procedure stored in the facility device control procedure memory section 44. The central processing means 51 in the indoor controller 36 transmits the state of the facility device 33 to the central remote controller 5 through the transmission means 52 and the transmission medium 4 according to the request for monitoring received through the transmission means 52.

The central processing means 10 in the central remote controller 5 transmits the control instruction to the indoor unit controller 36 according to the control procedure stored in the air conditioner control procedure memory section 42.

The central processing means 51 in the indoor unit control means 36 controls the operation of the indoor unit component 35 through the indoor unit component input/output means 53 according to the control instruction from the central remote controller 5.

The central processing unit 10 in the central remote controller 5 transmits the control instruction to the indoor unit controller 36 according to the control procedure stored in the facility device control procedure memory section 44.

The central processing means 51 in the indoor unit control means 36 controls through the facility device input/output means 54 the operation of another facility device (second facility device) different from the facility device 33 (first facility device) as the target in monitoring.

Figure 32:
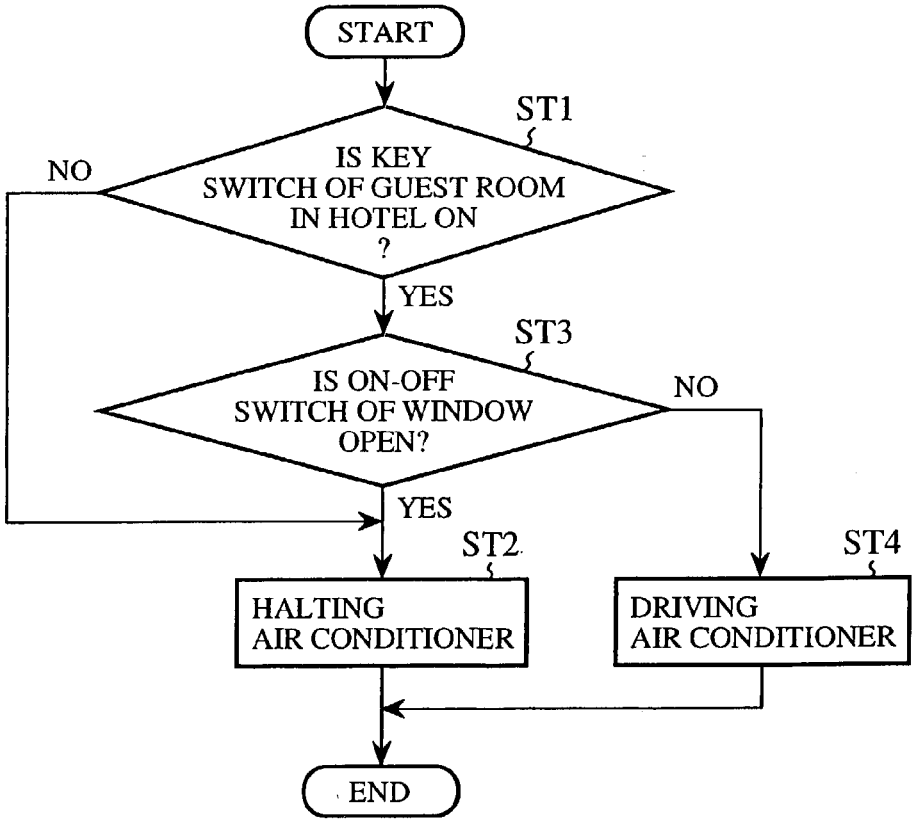
FIG. 32 is a flow chart showing one example of a process of the central remote controller in the air conditioner control system according to the thirteenth embodiment.

FIG. 32 is a flow chart showing one example of a process of the central remote controller 5. FIG. 32 shows a case of a key switch and an on-off switch of a window in a guest room in a hotel as an example of the facility device 33 placed together with the air conditioner. The flow chart shown in FIG. 32 shows the control procedure of the air conditioner under the state of the key switch and the on-off switch.

The central remote controller 5 transmits the request for monitoring the operation of the facility device 33 to the indoor unit controller 36 according to the control procedure stored in the facility device control procedure memory section 44.

In Step ST1 shown in FIG. 32, the central processing means 10 in the central remote controller 5 receives the state information of the facility device 33 (namely, the key switch and the on-off switch) and judges whether the key switch in the guest room is ON or OFF based on the state information received.

When the judgment result indicates that the key switch is OFF, in Step ST2 the central processing means 10 transmits the control instruction to halt the operation of the air conditioner according to the control procedure stored in the memory section 42. On the contrary, when the judgment result indicates that the key switch is ON, in Step ST3 the central processing means 10 judges whether the on-off switch of the window is open based on the state information of the facility device 33 received according to the control procedure stored in the memory section 44. When the judgment result indicates that the on-off switch of the window is open, in Step ST2, the central processing means transmits the control signal to halt the operation of the air conditioner according to the control procedure stored in the memory section 42. When the judgment result indicates that the on-off switch of the window is closed, in Step ST4, the central processing means 10 transmits the control signal to initiate the operation of the air conditioner according to the control procedure stored in the memory section 42.

The central processing means 10 in the central remote controller 5 transmits the instruction to halt or initiate the operation of the air conditioner to the indoor unit control means 36. The central processing means 51 in the indoor unit control means 36 controls the operation of the indoor unit component 35 through the indoor unit component input/output means 53 according to the control instruction received.

In the thirteenth embodiment, although the facility device 33 is connected to the indoor unit 2 in the configuration of the first embodiment shown in FIG. 1, it is also possible to connect the facility device 33 to the indoor unit 2 in the configuration of the fourth embodiment shown in FIG. 15.

As described above, according to the thirteenth embodiment, it is possible to construct the air conditioner control system with a low cost without introducing any dedicated control terminal and without the wiring work thereof, where another facility device 33 or the air conditioner is controlled according to the predetermined procedure corresponding to the state of the facility device 33 placed together with the air conditioner. In particular, it is possible to reduce. the construction cost remarkably in a case such as a hotel where a large number of air conditioners are mounted and optional facility devices are installed in each room.

The thirteenth embodiment shows the control of the indoor unit control means 36 and the facility device 33 connected to the indoor unit 2. The present invention is not limited by this configuration. For example, it is possible to apply the concept of the thirteenth embodiment to the configuration comprising the outdoor unit control means and the facility device connected to the outdoor unit 1.

Fourteenth Embodiment

Figure 33:
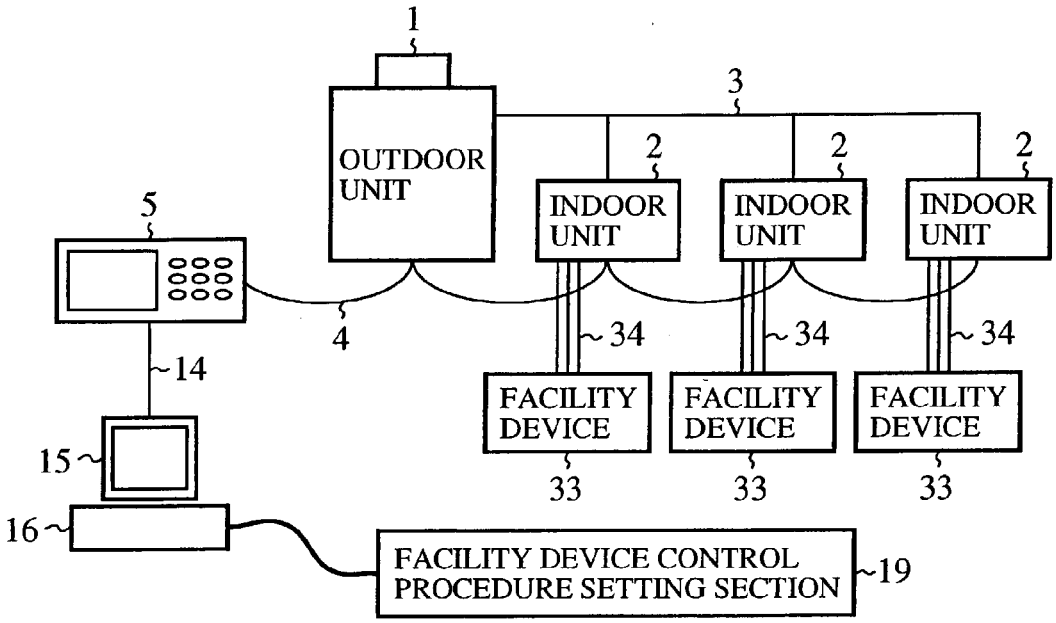
FIG. 33 is a block diagram showing a configuration of an air conditioner control system according to a fourteenth embodiment of the present invention.

FIG. 33 is a block diagram showing a configuration of an air conditioner control system according to a fourteenth embodiment of the present invention. In FIG. 33, reference number 19 designates a facility device control procedure setting section in the remote monitor terminal 15, to be also used as an initial setting tool, when the air conditioner is installed. This setting section 19 also sets conditions based on a customer's specification at a trial of the air conditioners installed.

The internal configuration of the central remote controller 5 of the fourteenth embodiment has the same configuration of that of the thirteenth embodiment shown in FIG. 30. The internal configuration of the indoor unit control means in the indoor unit 2 of the fourteenth embodiment has the same configuration of that of the thirteenth embodiment shown in FIG. 31.

Next, a description will now be given of the operation of the air conditioner control system of the fourteenth embodiment.

The remote monitor terminal 15, to be also used as the initial setting tool, transmits to the central remote controller 5 through the transmission medium 14 the facility device control procedure generated by the facility device control procedure setting section 19.

When receiving the facility device control procedure through the transmission means 13, the central remote controller 5 stores it in the memory section 44.

The central processing unit 10 reads the control procedure stored in the memory section 44 and transmits it to the indoor unit control means 36 through the indoor unit 2 through the transmission means 6. The indoor unit control means 36 receives the control procedure through the transmission means 52 and the central processing means 51 controls the facility device 33 through the facility device input/output means 54.

Like the thirteenth embodiment, the concept of the fourteenth embodiment can be applied to the case of the control example shown in FIG. 32, where the fourteenth embodiment performs the same processes of Steps TS11 to Step ST14. The control procedure stored in the memory section 44 in the central remote controller 5 has been transmitted from the remote monitor terminal 15 as the initial setting tool.

As described above, the fourteenth embodiment has the same effect of the thirteenth embodiment. In addition, because the remote monitor terminal 15 as the trial tool such as a personal computer, connected to the air conditioner, can operate optionally according to the customer's specification. It is thereby possible to obtain the effect to reduce the cost of the construction of the air conditioner control system and to raise the quality of the maintenance service.

Fifteenth Embodiment

Figure 34:
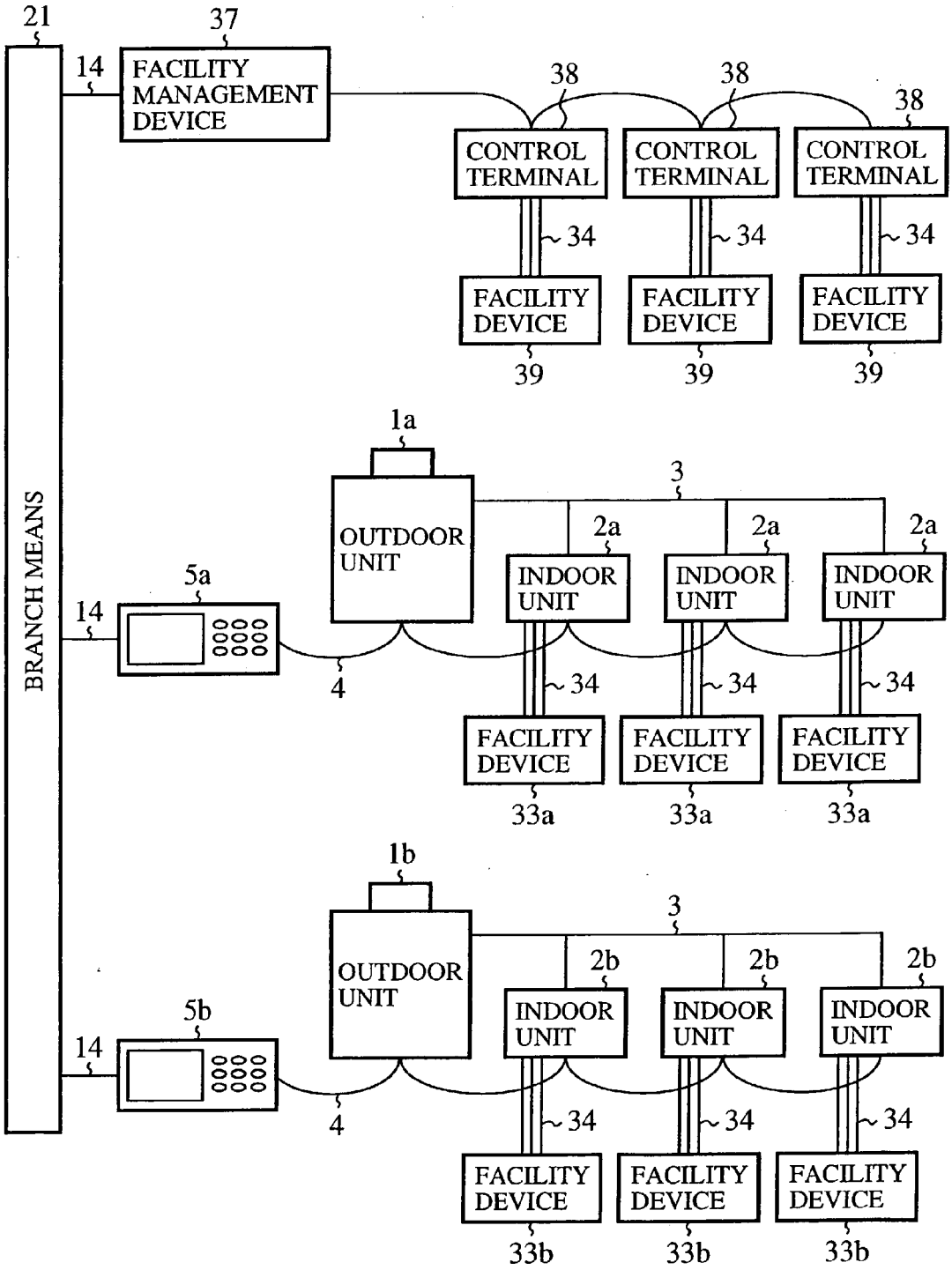
FIG. 34 is a block diagram showing a configuration of an air conditioner control system according to a fifteenth embodiment of the present invention.

FIG. 34 is a block diagram showing a configuration of an air conditioner control system according to a fifteenth embodiment of the present invention. In FIG. 34, reference number 37 designates a facility management device for controlling the operation of one or more additional facility devices which have not connected to the air conditioner control system at the initial installation of the system. The facility management device 37 is connected to the central controllers 5*a* and 5*b* through the branch means 21. For example, there is a sequencer of a low cost as the facility control device 3. The sequencer is easy to make a control program.

Reference number 38 denotes control terminals, each connected to the facility control device 37. The control terminal 38 is incorporated in a sequencer in advance when the sequencer is used as the facility management device 37. Reference number 39 indicates facility devices (third facility devices) as the additional devices to be added into the air conditioner control system after the initial installation.

Figure 35:
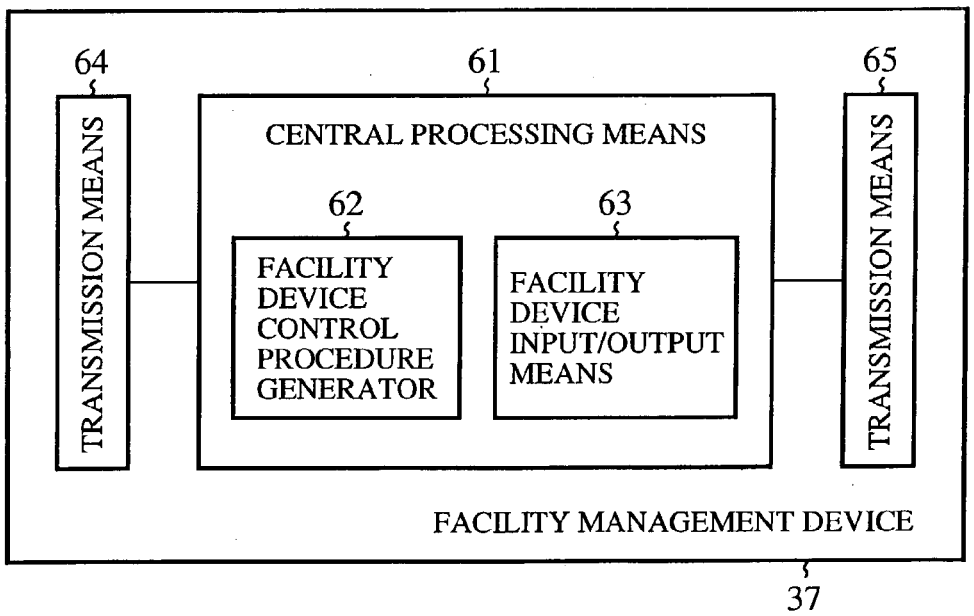
FIG. 35 is a block diagram showing an internal configuration of a facility management device in the air conditioner control system according to the fifteenth embodiment.

FIG. 35 is a block diagram showing an internal configuration of the facility management device 37. In FIG. 35, reference number 61 designates a central processing means, and 62 denotes a facility device control procedure generation means (as a program) for controlling the operation of the facility devices 33*a* and 33*b* (the first and second facility devices) placed together with the air conditioners. Reference number 63 indicates a facility device control means for controlling the facility devices 39, which are incorporated after the initial installation. Reference number 64 designates a transmission means connected to the transmission medium 14, and 65 denotes a transmission means connected to the transmission wiring of the control terminal 38.

When the facility device controller generation means 62 as a program for controlling the operation of the facility devices 33 is mounted on the circuit of the facility device controller for controlling the facility devices 39, it is not necessary to incorporate any controller of a high cost.

The internal configuration of the central remote controllers 5*a* and 5*b* in the fifteenth embodiment has the same configuration of those of the thirteenth embodiment shown in FIG. 30. Further, the internal configuration of the indoor unit control means 36 (omitted from FIG. 34) incorporated in the indoor units 2*a* and 2*b* of the fifteenth embodiment has the same configuration of those of the thirteenth embodiment shown in FIG. 31.

Next, a description will now be given of the operation of the air conditioner control system of the fifteenth embodiment.

The central processing means 61 communicates with the corresponding control terminal 38 through the transmission means 65 in order to control the operation of the corresponding facility devices 39.

The central processing means 61 transmits the request to monitor the state of the facility devices 33*a* and 33*b* (as the first and second facility devices) connected to the indoor unit control means 36 (omitted from FIG. 34) to the central remote controllers 5*a* and 5*b* according to the procedure generated by the facility device control procedure generation means 62.

The central remote controllers 5*a* and 5*b* transmit to the indoor unit control means 36 the request to monitor the state of the facility devices 33*a* and 33*b* connected to the indoor unit control means 36. The indoor unit control means 36 transmits the state of the facility devices 33*a* and 33*b* to the central remote controllers 5*a* and 5*b*. The central remote controllers 5*a* and 5*b* then transmit the information regarding the state of the facility devices 33*a* and 33*b* to the facility management device 37.

When receiving the information regarding the state of the facility devices 33*a* and 33*b*, the facility management device 37 transmits the control signal for the indoor unit control means 36 to the central remote controllers 5*a* and 5*b* according to the control procedure generated by the means 62. The central remote controllers 5*a* and 5*b* transmits the control instruction received to the indoor unit control means 36. When receiving the control instruction, the central processing means 51 in the indoor unit control means 36 controls the operation of another facility devices 33*a* and 33*b* (as the second facility device) and the indoor unit component 35 other than the facility devices 33*a* and 33*b* (as the first facility device) according to the control instruction from the central remote controllers 5*a* and 5*b*.

The facility device control means 63 in the facility management device 37 can control the operation of the facility devices 39 through the transmission means 65 according to the state of the facility devices 33*a* and 33*b* received from the central remote controllers 5*a* and 5*b*.

Figure 36:
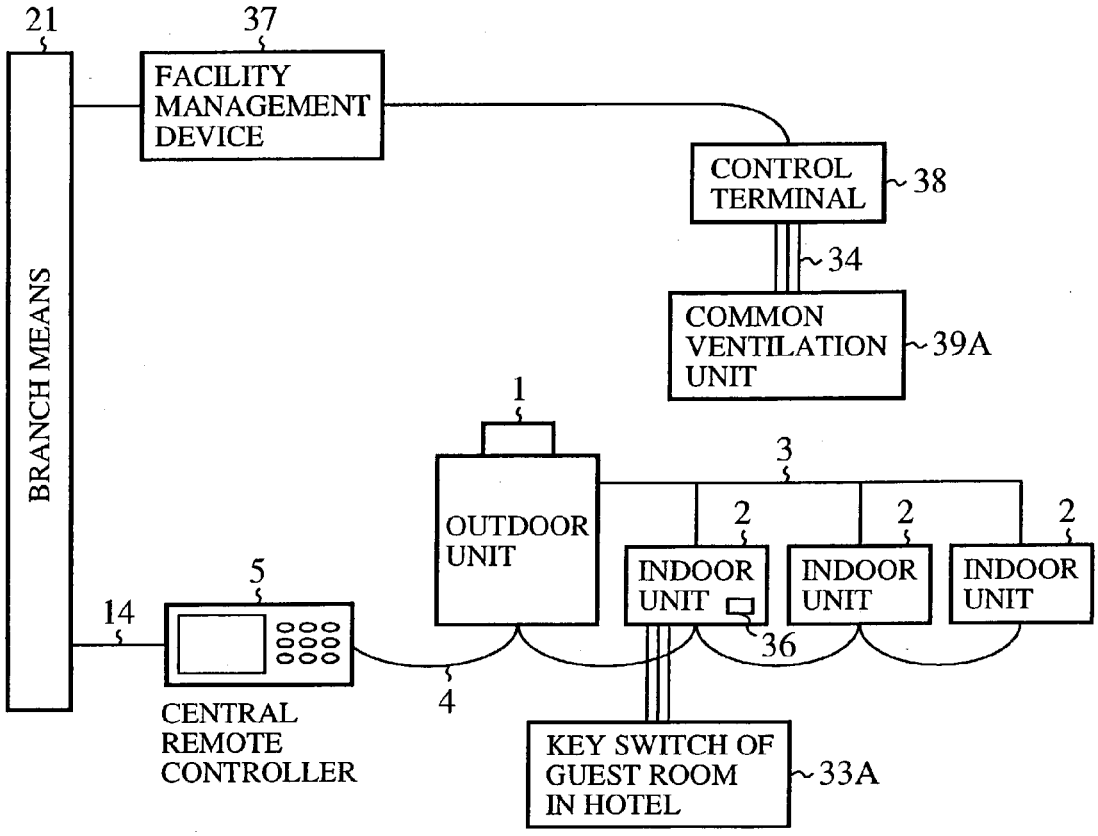
FIG. 36 is a block diagram showing another configuration of the air conditioner control system according to the fifteenth embodiment.
Figure 37:
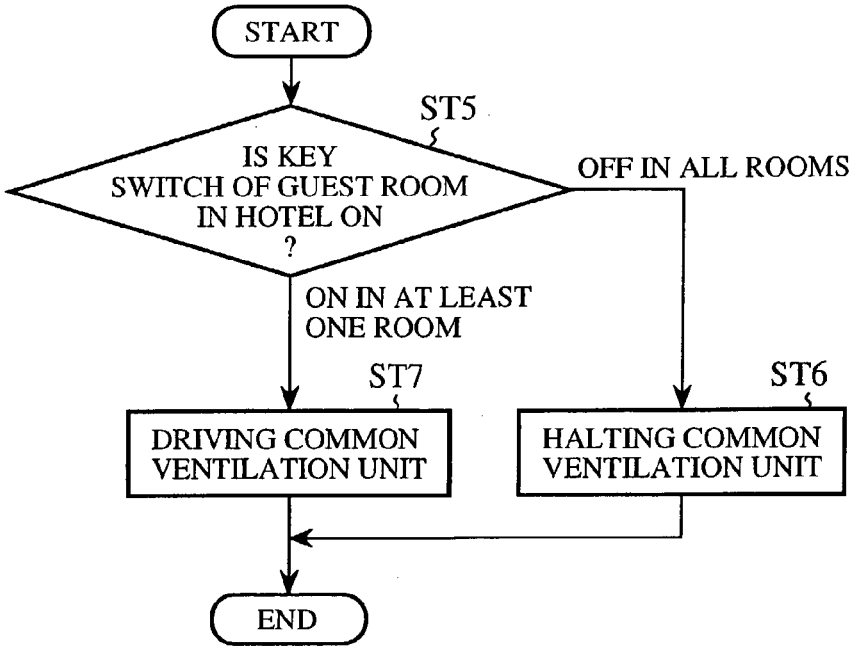
FIG. 37 is a flow chart showing one example of a process of the facility management device in the air conditioner control system according to the fifteenth embodiment.

FIG. 36 is a block diagram showing another configuration of the air conditioner control system when the key switch 33A in guest room in a hotel are used as the facility devices 33*a* and 33*b* and when a common ventilation unit 39A is also used as the facility device 39. FIG. 37 is a flow chart showing one example of the process of the facility management device 37 in the air conditioner control system according to the fifteenth embodiment, where the key switch 33A of the guest room and the common ventilation unit 39A are used.

The central processing means 61 in the facility management device 37 transmits the request to monitor the state of the key switches 33A to the indoor unit control means 36 through the central remote controller 5 according to the control procedure generated by the facility device control procedure generation means 62.

The central processing means 61 in the facility management device 37 then receives the information regarding the state of the key switch 33A in the guest room in the hotel transferred from the central remote controller 5 through the indoor unit control means 36 in the indoor unit 2.

In Step ST5 shown in FIG. 37, the central processing means 36 in the facility device control means 37 receives the information regarding the state of the key switch 33A, and recognizes whether the key switch 33A of the guest room in the hotel are ON based on the received information.

When the judgment result indicates that the key switches in all of the guest rooms are OFF, the facility device control means 63 transmits the instruction to halt the operation of the common ventilation device 39A to the control terminal 38 in Step ST6.

When the judgment result indicates that the key switch in al least one guest room is ON, the facility device control means 63 transmits the instruction to initiate or continue the operation of the common ventilation device 39A to the control terminal 38 in Step ST7.

As described above, according to the fifteenth embodiment, the facility management device 37 controls the operation of the facility devices 39 of various types that are added after the initial installation of the air conditioner control system. Thereby, the air conditioner control system including the central remote controllers 5*a* and 5*b* can be sell to customers as a basic component in a standard system specification.

Further, the fifteenth embodiment has the effect to provide the control system with a low cost, which controls the operation of both the facility devices 33 placed together with the air conditioners, and optional facility devices 39.

Sixteenth Embodiment

Figure 38:
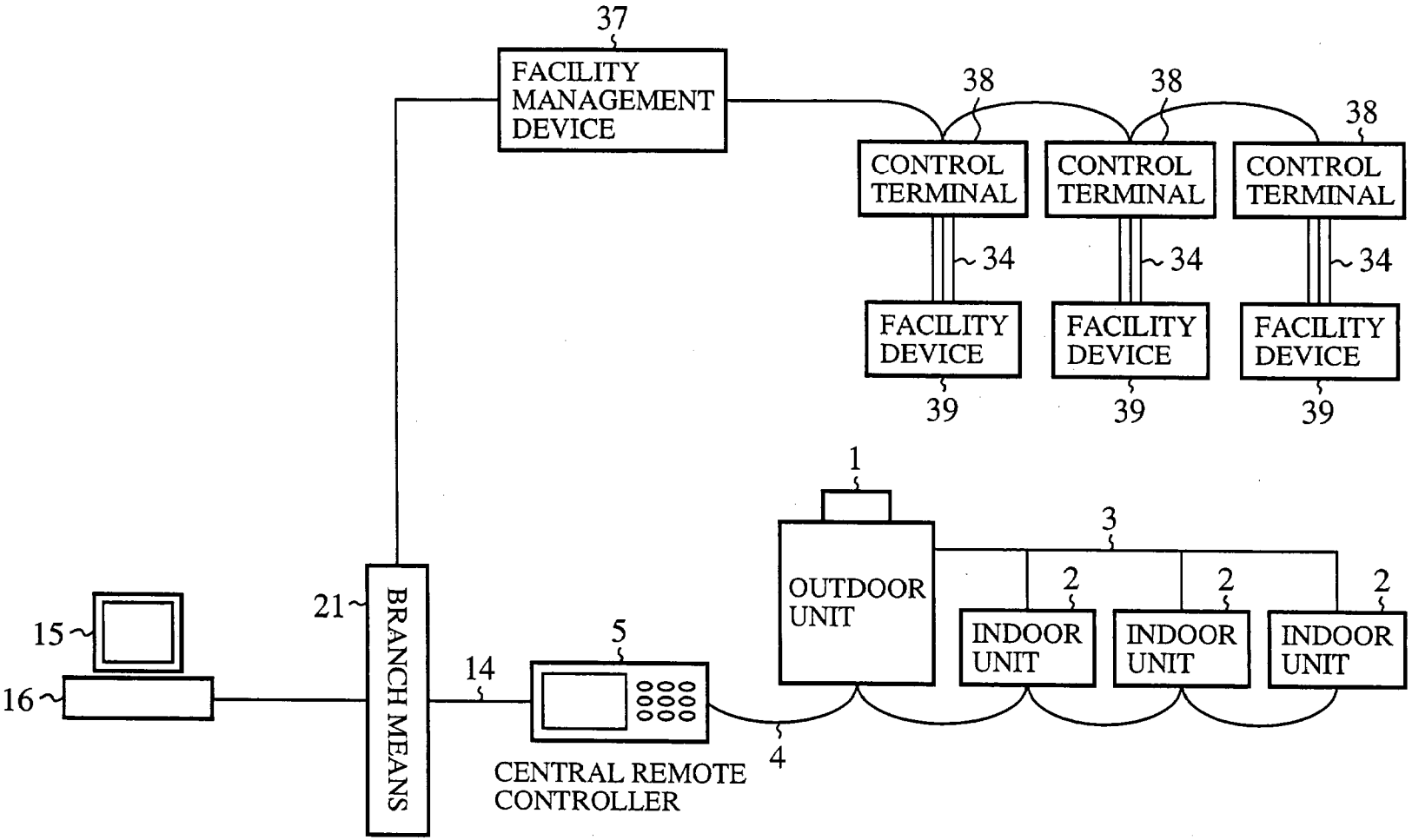
FIG. 38 is a block diagram showing a configuration of an air conditioner control system according to a sixteenth embodiment of the present invention.

FIG. 38 is a block diagram showing a configuration of an air conditioner control system according to a sixteenth embodiment of the present invention. In the sixteenth embodiment, the remote monitor terminal 15 is connected to the configuration of the system of the fifteenth embodiment shown in FIG. 34. Thereby, the user can remotely monitor the operation state of the air conditioners and facility devices.

Figure 39:
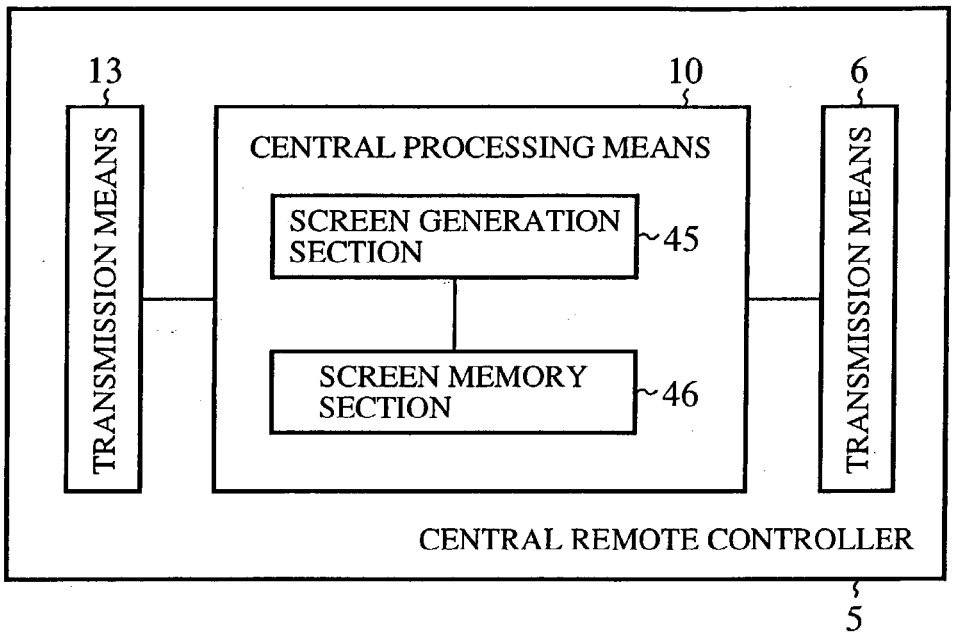
FIG. 39 is a block diagram showing an internal configuration of a central remote controller in the air conditioner control system according to the sixteenth embodiment.

FIG. 39 is a block diagram showing an internal configuration of the central remote controller 5. In FIG. 39, reference number 45 designates a screen generation section, and 46 indicates a screen memory section. The remote controller 5 of the sixteenth embodiment has the same configuration of the central remote controller 5 of the first embodiment shown in FIG. 1. However, those same components are omitted from FIG. 39.

Figure 40:
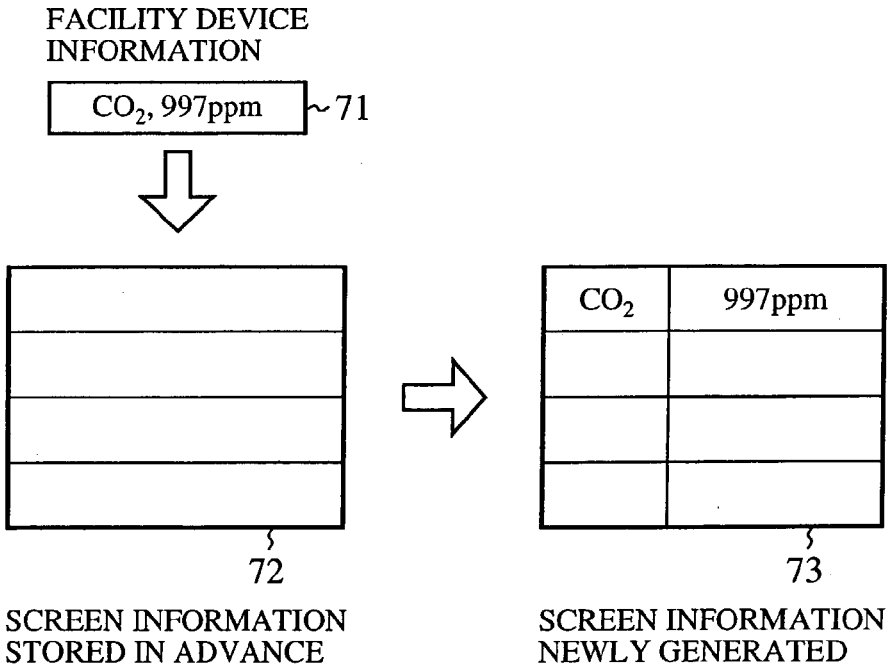
FIG. 40 is a diagram showing a process of the central remote controller in the air conditioner control system according to the sixteenth embodiment of the present invention.

FIG. 40 is a diagram showing a process of the central remote controller 5. In FIG. 40, reference number 71 indicates information of the facility devices 39 obtained by the facility management device 37 and transmitted to the central remote controller 5. Reference number 72 denotes basic screen information stored in the memory section 46 previously, other than facility device information 71 o be added. Reference number 73 designates screen information that is newly generated by adding (or storing or writing) the information 71 of the facility device transmitted from the facility management device 37 on the basic screen information 72.

Next, a description will now be given of the operation of the air conditioner control system of the sixteenth embodiment.

The air conditioner control system is equipped with a carbon dioxide concentration sensor as the facility device 39 that is optionally equipped.

The facility management device 37, as shown in FIG. 40, transmits to the central remote controller 5 the information "$CO_2$" (as a kind of the facility device 39) and "997 ppm" (as a state of the facility device 39) as the facility device management information 71.

The screen generation section 45 generates new screen information 73 having both the information "$CO_2$" and "997 ppm" by combining the basic screen information 72 stored in the screen memory section 46 and both the information "$CO_2$" and "997 ppm". The screen generation section 45 transmits the generated one to the remote monitor terminal 15 through the branch means 21.

The personal computer as the remote monitor terminal 15 incorporating the browser software 16 receives the screen information 73 newly generated by the central remote controller 5, namely, the information "$CO_2$" and "997 ppm" of the facility device 39 and displays the received information on the display means such as a monitor (not shown).

As described above, according to the sixteenth embodiment, because the central remote controller 5 generates the screen information 73 based on the facility device information 71 of the facility device 39 obtained by the facility management device 37, it is possible that the remote monitor terminal 15 monitors the state of one or more the facility devices 39 that are optionally built in the system after the initial installation.

Seventeenth Embodiment

Figure 41:
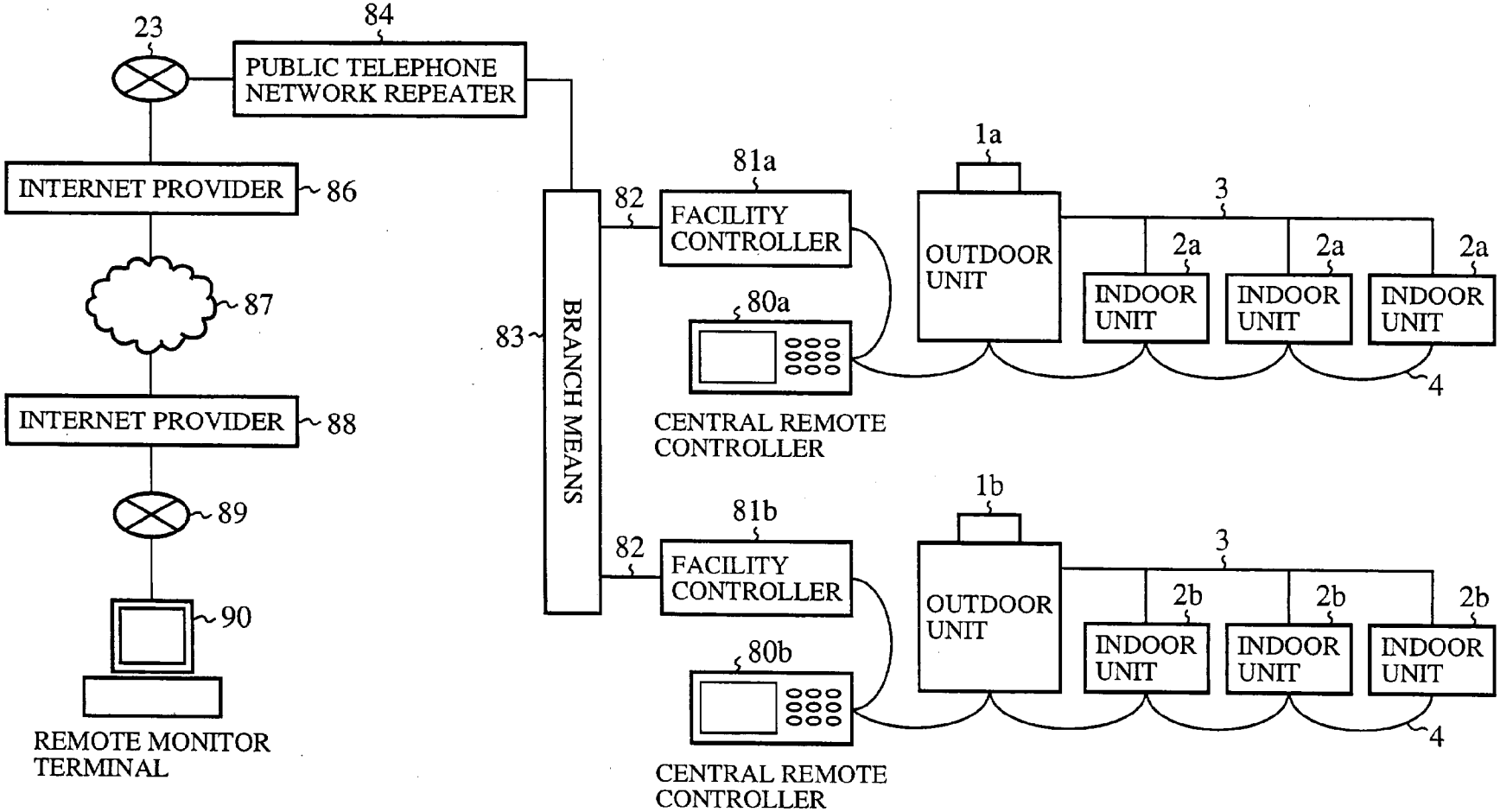
FIG. 41 is a block diagram showing a configuration of an air conditioner control system according to the seventeenth embodiment of the present invention.

FIG. 41 is a block diagram showing a configuration of an air conditioner control system according to the seventeenth embodiment of the present invention. In FIG. 41, reference character 1*a* and 1*b* designate outdoor units, and 2*a* and 2*b* denote indoor units. A pair of the outdoor unit 1*a* and indoor unit 2*a* forms an air conditioner. A pair of the outdoor unit 1*b* and indoor unit 2*b* also forms another air conditioner. Reference number 3 indicates a coolant pipe between the outdoor unit 1*a* and the indoor unit 2*a*, and between the outdoor unit 1*b* and the indoor unit 2*b*.

In FIG. 41, reference number 4 designates a transmission medium as a dedicated communication line of the air conditioner. Reference character 80*a* denotes a central remote controller, connected to the transmission medium 4, for controlling the operation of and monitoring the state of the operation of the air conditioner made up of the outdoor unit la and the indoor unit 2*a*. Reference character 80*b* indicates a central remote controller, connected to the transmission medium 4, for controlling the operation of and monitoring the operation state of the air conditioner made up of the outdoor unit 1*b* and the indoor unit 2*b*. Reference character 81*a* designates a facility controller, connected to the transmission medium 4, for collecting the operation information of the air conditioner made up of the outdoor unit 1*a* and the indoor unit 2*a*, and transmitting E-mail regarding the information of the air conditioner collected. Reference character 81*b* designates a facility controller, connected to the transmission medium 4, for collecting the operation information of the air conditioner made up of the outdoor unit 1*b* and the indoor unit 2*b*, and transmitting E-mail regarding the information of the air conditioner collected.

In FIG. 41, reference number 82 designates a transmission medium connected to the facility controllers 81*a* and 81*b*, 8 denotes a branch means such as a hub connected to the transmission medium 82, 84 indicates a public telephone network repeater such as a dial-up router, 23 and 89 designate a public telephone network, 86 and 88 denote Internet service providers (or Internet provider, for short), 87 denotes the Internet, and 90 indicates a remote monitor terminal for remotely monitoring and controlling the operation of the air conditioner through the Internet 87, and the facility controllers 81*a* and 81*b*.

Figure 42:
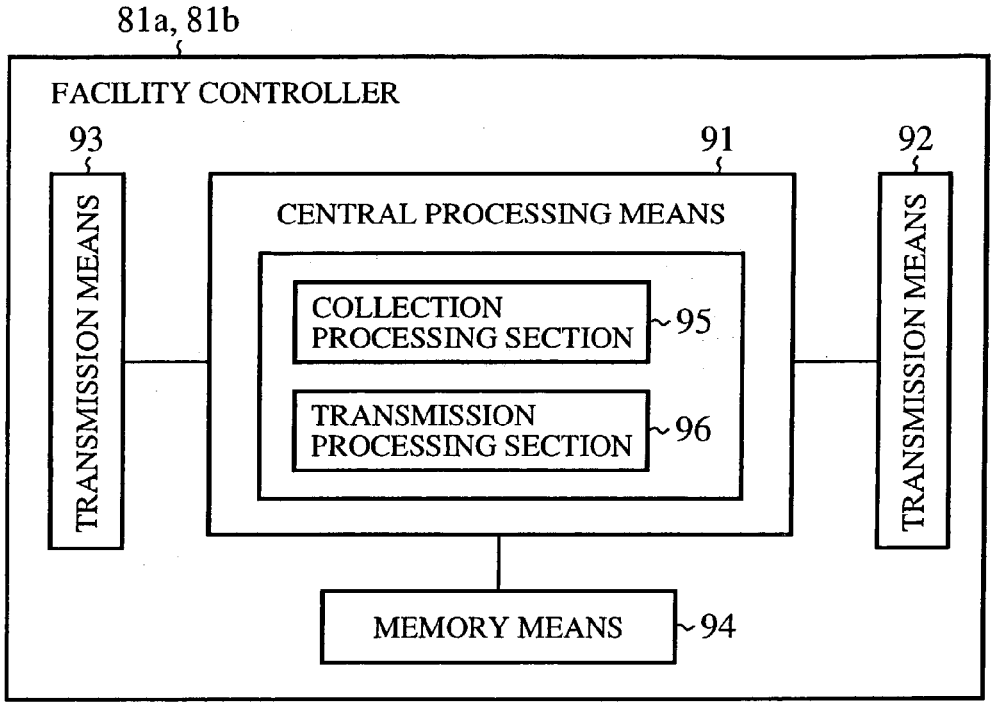
FIG. 42 is a block diagram showing an internal configuration of a facility controller in the air conditioner control system according to the seventeenth embodiment.

FIG. 42 is a block diagram showing an internal configuration of each of the facility controllers 81*a* and 81*b*. In FIG. 42, and reference number 91 designates a central processing means for performing the entire operation of the facility controllers 81*a* and 81*b*. Reference number 92 denotes a transmission means, connected to the transmission medium 4, through which the facility controllers 81*a* and 81*b* communicate with the corresponding air conditioners. Reference number 93 denotes a transmission means, connected to the transmission medium 82, through which the facility controllers 81*a* and 81*b* communicate with the remote monitor terminal 15. Reference number 94 indicates a memory means for storing the air conditioner information collected.

In FIG. 42, reference number 95 designates a collection processing section for collecting the air conditioner information regarding the operation of the air conditioner and stores the collected one and instructs to transmit the air conditioner information stored in the memory means 94 when the number of collections of the air conditioner information exceeds a predetermined number. Reference number 96 indicates a transmission processing section for transmitting E-mail including the air conditioner information stored in the memory means 94 based on the collection processing section 95.

Next, a description will now be given of the operation of the air conditioner control system of the seventeenth embodiment.

Figure 43:
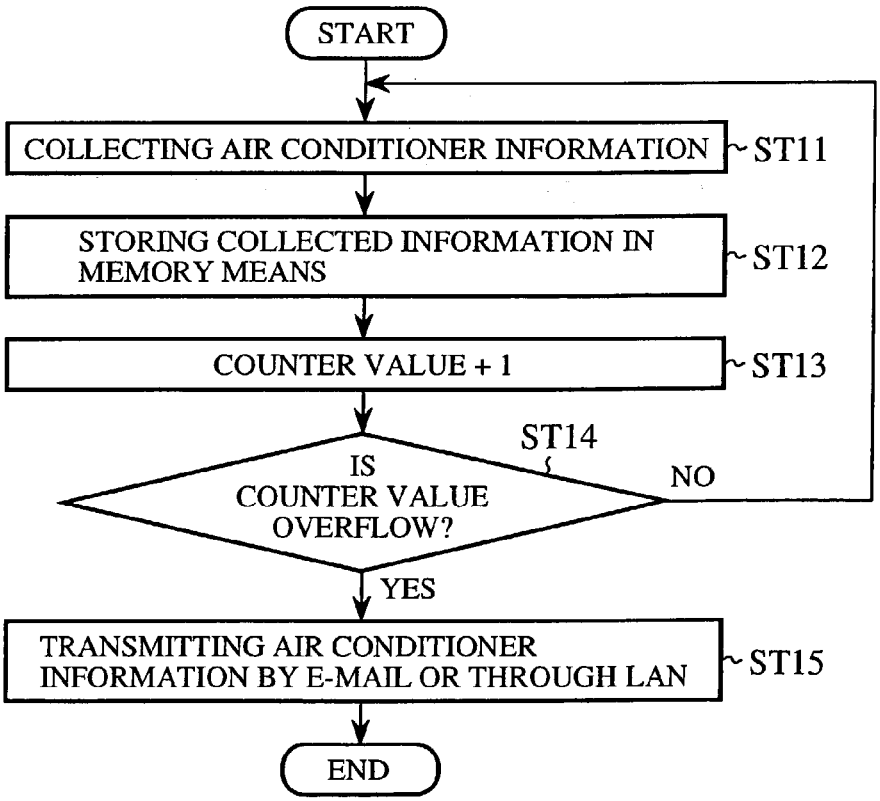
FIG. 43 is a flow chart showing a process of the facility controller in the air conditioner control system according to the seventeenth embodiment.

FIG. 43 is a flow chart showing the process of the facility controllers 81*a* and 81*b* in the air conditioner control system according to the seventeenth embodiment.

At Step ST11, the collection processing section 95 in each of the facility controllers 81*a* and 81*b* collects the air conditioner information regarding the air conditioner through the transmission medium 4. At this time, for example, the collection processing section 95 collects the information such as an outlet temperature of a compressor, a pipe temperature, and a frequency of the compressor from the outdoor units 1*a* and 1*b*, and information of an actuator sensor such as a room temperature from the indoor units 2*a* and 2*b*.

At Step ST12, the collection processing section 95 stores the air conditioner information collected into the memory means 94. At Step ST13, a counter (not shown) incorporated in the central processing means 91 is incremented by one (+1). At Step ST14, it is checked whether the counter value exceeds the predetermined value. When it does not exceed the predetermined value, the process returns to Step ST11 and then those operations of Steps ST11, ST12, and ST13 are repeated. In this case, it is so designed that the counter automatically overflows when the memory means 94 becomes approximately full with the air conditioner information.

At Step ST14, when the collection processing section 95 detects that the value of the counter overflows, at Step ST15, the transmission processing section 96 transmits E-mail including the air conditioner information stored in the memory means 94 to the Internet provider 88 through the transmission medium 82, the branch means 83, the public telephone network repeater 84, the public telephone network 23, the Internet provider 86, and the Internet 87,.

Figure 44:
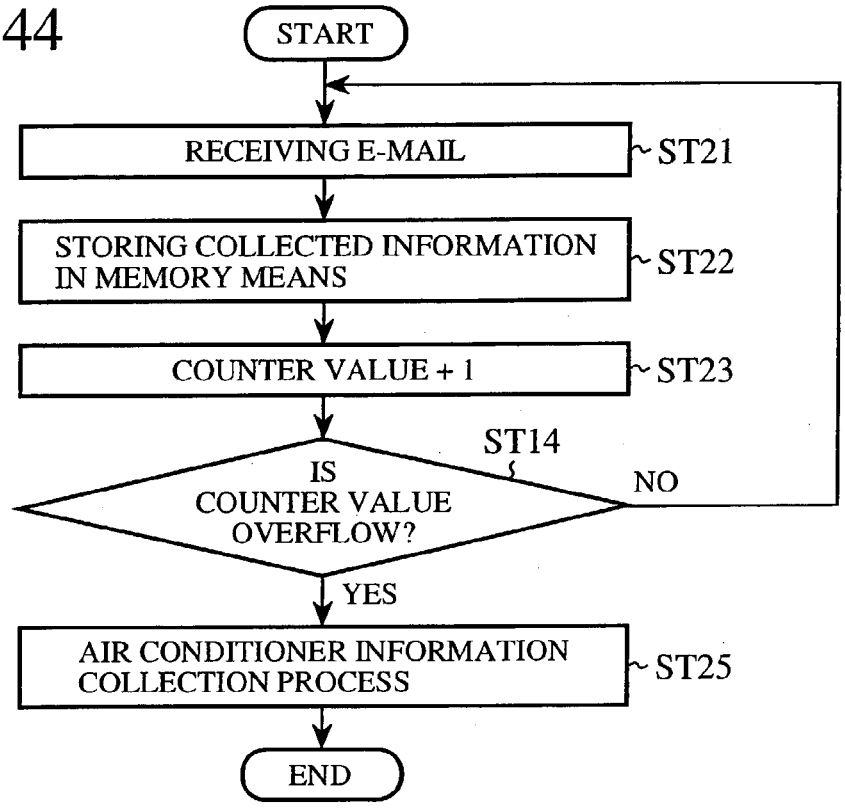
FIG. 44 is a flow chart showing a process of the remote monitor terminal in the air conditioner control system according to the seventeenth embodiment.

FIG. 44 is a flow chart showing the process flow of the remote monitor terminal 90 in the air conditioner control system according to the seventeenth embodiment.

At step ST21, the remote monitor terminal 90 accesses the Internet provider 88 through the public telephone network 89 in order to obtain the air conditioner information by getting the E-mail. At Step ST22, the remote monitor terminal 15 stores the air conditioner information into the memory means (not shown) in the remote monitor terminal 90, and increments a counter (not shown) in the remote monitor terminal 90 by one (+1).

At Step ST24, the remote monitor terminal 90 checks whether the counter value exceeds the predetermined value. When the counter value does not exceed it, the process returns to Step ST21, and the processes ST21, ST22, and ST23 are repeated. In this case, it is so designed that the counter value in the remote monitor terminal 90 automatically overflows when the number of the received E-mails exceeds a predetermined number.

At Step ST24, when detecting that the counter value overflows, the remote monitor terminal 90 totalizes all of the air conditioner information using the E-mails at Step ST25, in which the number of the received E-mails is determined in advance.

As described above, according to the seventeenth embodiment, because the facility controllers 81*a* and 81*b* transmit the air conditioner information stored in the memory means 94 when the collection number of the air conditioner information is reached to the predetermined value, it is not necessary to incorporate any additional memory into the memory means 94 and to clear the air conditioner information previously collected.

In addition, according to the seventeenth embodiment, because the facility controllers 81*a* and 81*b* transmit E-mails including the collected air conditioner information to the remote monitor terminal 90 through the Internet 87, and because the place of the remote monitor terminal 90 is close to the access point of the Internet provider, in general, it is thereby possible to reduce the telephone charge for the transmission of the air conditioner information.

Further, because the Internet provider 86 can transmit E-mails to a plurality of the Internet providers 86 specified, without any additional telephone charge, it is possible to reduce the telephone charge and possible to transmit the air conditioner information without any checking of the presence of an idle trunk or any checking whether or not the remote monitor terminal 90 is currently used for another application. Further, it is not necessary to incorporate additional dedicated telephone line and additional remote monitor terminal 90 for receiving the air conditioner information collected.

Eighteenth Embodiment

The air conditioner control system of the eighteenth embodiment has the same configuration of the seventeenth embodiment shown in the block diagram of FIG. 41 and the facility controllers 81*a* and 81*b* have the same internal configuration of those of the seventeenth embodiment shown in the block diagram of FIG. 42.

Next, a description will now be given of the operation of the air conditioner control system of the eighteenth embodiment.

Figure 45:
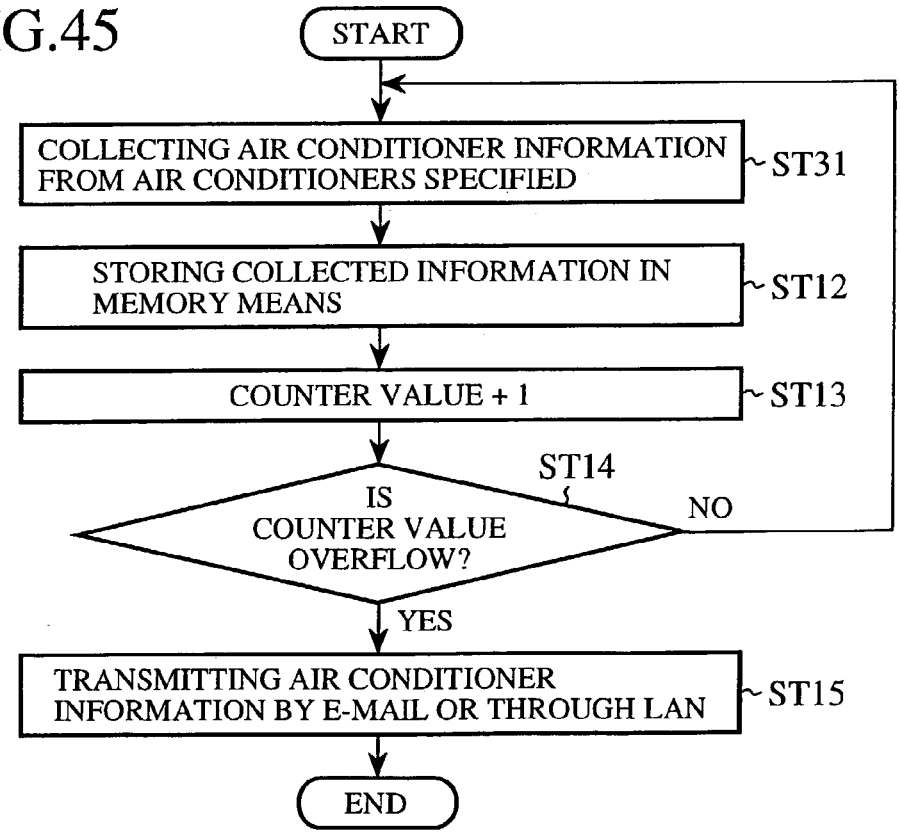
FIG. 45 is a flow chart showing a process of a facility controller in an air conditioner control system according to an eighteenth embodiment of the present invention.

FIG. 45 is a flow chart showing a process of the facility controllers 81*a* and 81*b* in an air conditioner control system according to the eighteenth embodiment.

In Step ST31, the collection processing section 95 in each of the facility controllers 81*a* and 81*b* collects the air conditioner information from the air conditioner comprising the outdoor unit la and the indoor unit 1*b* which are specified in advance, for example.

Step ST12 and following Steps ST13, ST14, and ST15 shown in FIG. 45 perform. the same processes of the seventeenth embodiment shown in FIG. 43. Further, the remote monitor terminal 90 performs the same process of the seventeenth embodiment shown in FIG. 44.

As described above, the eighteenth embodiment has the same effect of the seventeenth embodiment. In addition, because the number of the air conditioners is limited and only the operation states of which are collected, the remote monitor terminal 90 can collect the air conditioner information every time interval necessary for the analysis of abnormal state without hindering the communication for the normal control by the transmission medium 4 of a relatively low communication speed. It is also possible to introduce any additional dedicated analyzer.

Nineteenth Embodiment

The air conditioner control system of the nineteenth embodiment has the same configuration of the seventeenth embodiment shown in the block diagram of FIG. 41 and the facility controllers 81*a* and 81*b* have the same internal configuration of those of the seventeenth embodiment shown in the block diagram of FIG. 42.

Next, a description will now be given of the operation of the air conditioner control system of the nineteenth embodiment.

Figure 46:
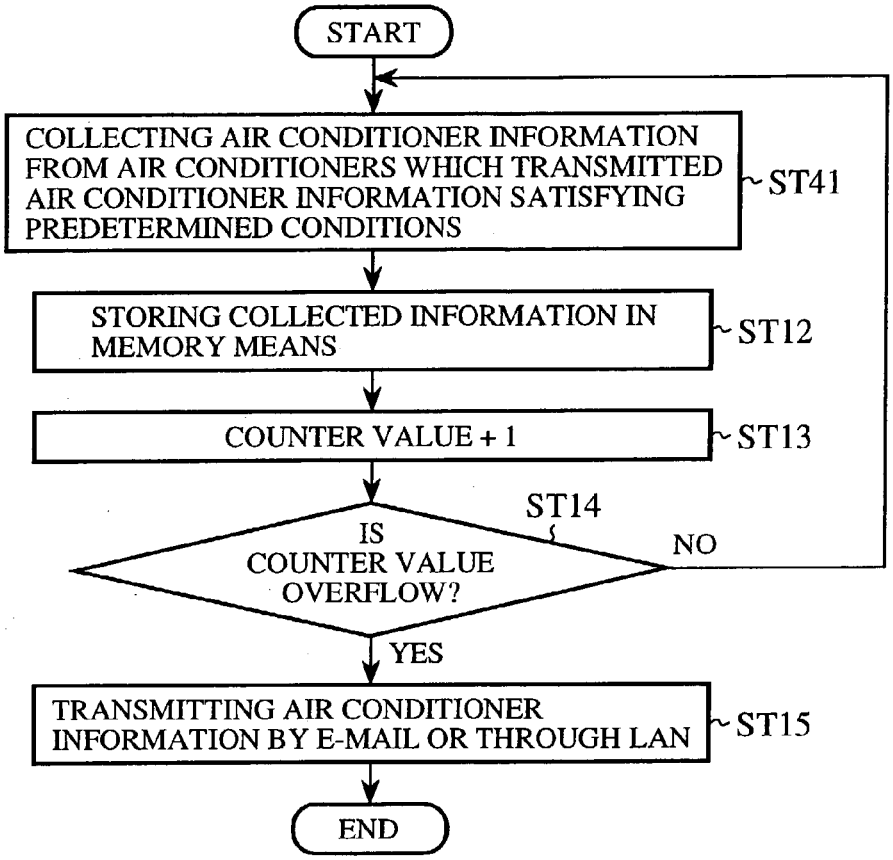
FIG. 46 is a flow chart showing a process of a facility controller in an air conditioner control system according to a nineteenth embodiment of the present invention.

FIG. 46 is a flow chart showing a process of the facility controller in the air conditioner control system according to the nineteenth embodiment.

In Step ST41, the collection processing section 95 in each of the facility controllers 81*a* and 81*b* collects the air conditioner information only from the air conditioner, through the transmission means 92 and the transmission medium 4, whose air conditioner information satisfies a predetermined condition for malfunction previously set.

For example, one example of the condition for malfunction is that the outlet temperature of the compressor exceeds a predetermined threshold value. In this case, there is a possibility to lack the amount of a gas for use in the air conditioner. The collection processing section 95 collects only the outdoor unit la and the indoor unit 2*a* in the air conditioner whose outlet temperature exceeds the predetermined threshold temperature.

Step ST12 and following Steps ST13, ST14, and ST15 shown in FIG. 46 perform the same processes of the seventeenth embodiment shown in FIG. 43. Further, the remote monitor terminal 90 performs the same process of the seventeenth embodiment shown in FIG. 44.

As described above, the nineteenth embodiment has the same effect of the seventeenth embodiment. In addition, because the collection processing section collects only the operation states of the air conditioner that informs (transmits) the condition state under the malfunction condition that is set in advance, it is thereby possible to limit the number of the air conditioners to collect the air conditioner information. Thereby, the remote monitor terminal 90 can collect the air conditioner information every time interval necessary for the analysis of the abnormal state without hindering the communication for the normal control by the transmission medium 4 of a relatively low communication speed. It is also possible to introduce any additional dedicated analyzer.

Twentieth Embodiment

Figure 47:
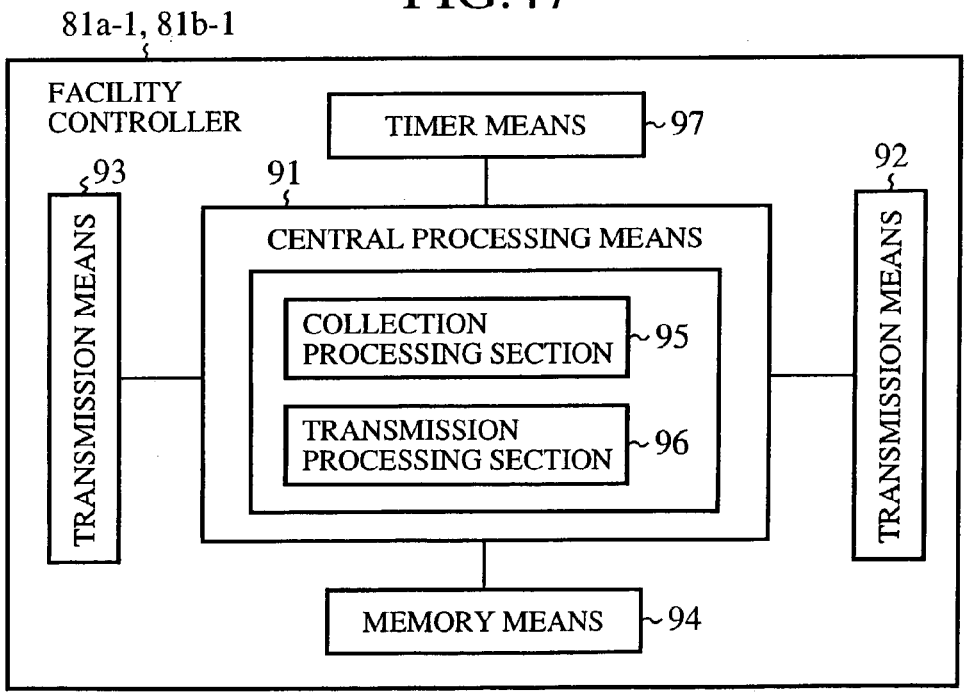
FIG. 47 is a block diagram showing an internal configuration of a facility controller in an air conditioner control system according to a twentieth embodiment of the present invention.

The air conditioner control system of the twentieth embodiment has the same configuration of the seventeenth embodiment shown in the block diagram of FIG. 41. FIG. 47 is a block diagram showing a configuration of the internal configuration of facility controllers 81*a*-1 and 81*b*-1 in the air conditioner control system of the twentieth embodiment. In FIG. 47, reference number 97 designates a timer means for counting time. Other system components have the same configuration of those in the air conditioner control system of the seventeenth embodiment shown in FIG. 42.

Next, a description will now be given of the operation of the air conditioner control system of the twentieth embodiment.

Figure 48:
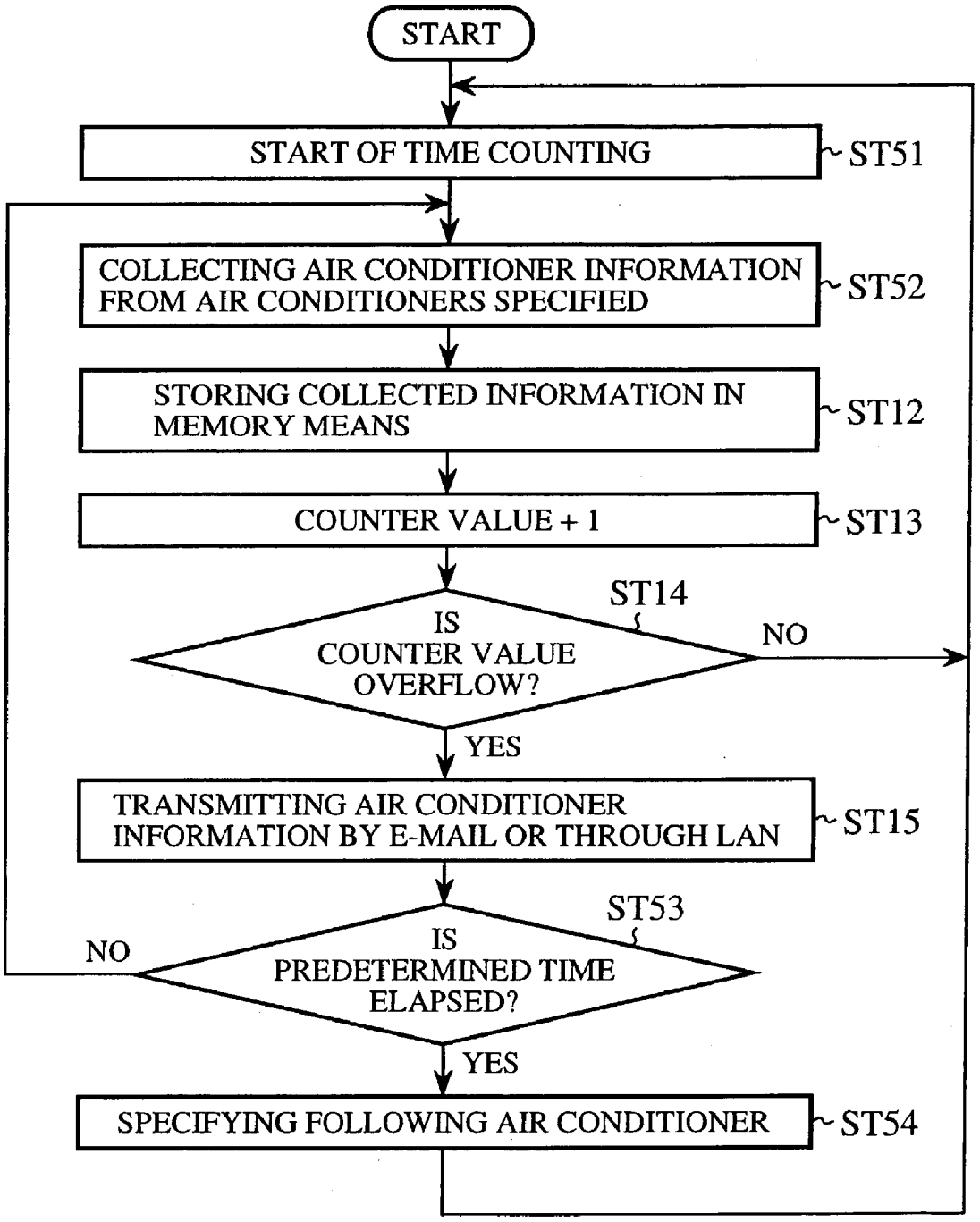
FIG. 48 is a flow chart showing a process of the facility controller in the air conditioner control system according to the twentieth embodiment.

FIG. 48 is a flow chart showing a process of the facility controllers 81*a*-1 and 81*b*-1 in the air conditioner control system of the twentieth embodiment.

In Step ST51, the timer means 97 in each of the facility controllers 81*a*-1 and 8*b*-1 initiates the counting of time. In Step ST52, the collection processing section 95 collects through the transmission means 92 and the transmission medium 4 the air conditioner information only from the air conditioners that are determined in advance.

Steps 12 to 15 perform the same process in the seventeenth embodiment shown in FIG. 43.

In Step ST53, the central processing means 91 recognizes whether or not the time length counted by the timer means 97 exceeds the predetermined time length. When the counted time length does not exceed the predetermined time length, the operation flow returns to Step ST52 and the following processes of Step ST52 are repeated. When the counted time length exceeds the predetermined time length, the collection processing means 95 specifies the following air conditioner as the target at Step ST54. The operation flow returns to Step ST54, and the following processes after Step ST54 are repeated for the specified air conditioner.

When it is determined that the predetermined time length is 24 hours to be used at Step ST53, the collection processing means 95 specifies a different air conditioner each day. Thereby, when one air conditioner fails, the collection processing means 95 can collect the air conditioner information during a day. It is possible to efficiently analyze the state of the air conditioner at fault and thereby possible to repair this air conditioner correctly.

The remote monitor terminal 90 performs the same process of the seventeenth embodiment shown in FIG. 44.

As described above, the air conditioner control system of the twentieth embodiment has the same effect of that of the seventeenth embodiment. In addition, because the collection processing section collects only the operation states of the air conditioner during only the specified time length, it is thereby possible to limit the number of the air conditioners to collect the air conditioner information. Thereby, the remote monitor terminal 90 can collect the air conditioner information every time interval necessary for the analysis of abnormal state without hindering the communication for the normal control by the transmission medium 4 of a relatively low communication speed. It is also possible to introduce any additional dedicated analyzer.

Twenty-First Embodiment

Figure 49:
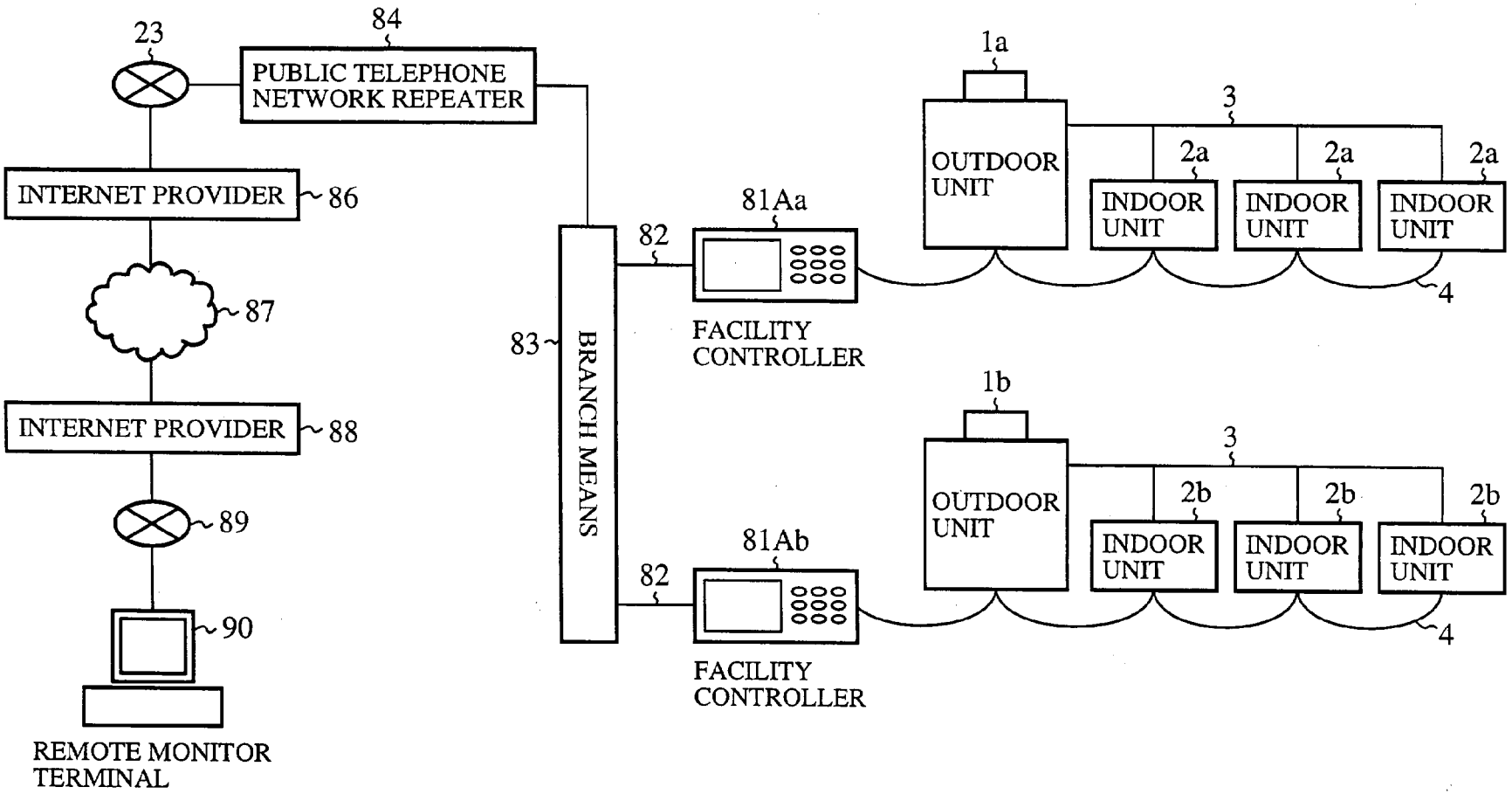
FIG. 49 is a block diagram showing a configuration of an air conditioner control system according to a twenty-first embodiment of the present invention.

FIG. 49 is a block diagram showing a configuration of an air conditioner control system according to a twenty-first embodiment of the present invention. In FIG. 49, reference character 81Aa designate a facility controller connected to the transmission medium 4 for controlling the operation of and monitoring the state of the air conditioner made up of the outdoor unit 1*a* and the indoor unit 2*a*, and for collecting the air conditioner information and transmitting E-mail including the air conditioner information collected. Reference character 81Ab designate a facility controller connected to the transmission medium 4 for controlling the operation of and monitoring the state of the air conditioner made up of the outdoor unit 1*b* and the indoor unit 2*b*, and for collecting the air conditioner information and transmitting E-mail including the air conditioner information collected.

Thus, the facility controllers 81Aa and 81Ab have the function of both the central remote controllers 80*a* and 80*b* and the facility controllers 81*a* and 81*b* of the seventeenth embodiment shown in FIG. 41, respectively.

Other components of the system shown in FIG. 49 have the same configuration of those in the air conditioner control system of the seventeenth embodiment shown in FIG. 41.

Figure 50:
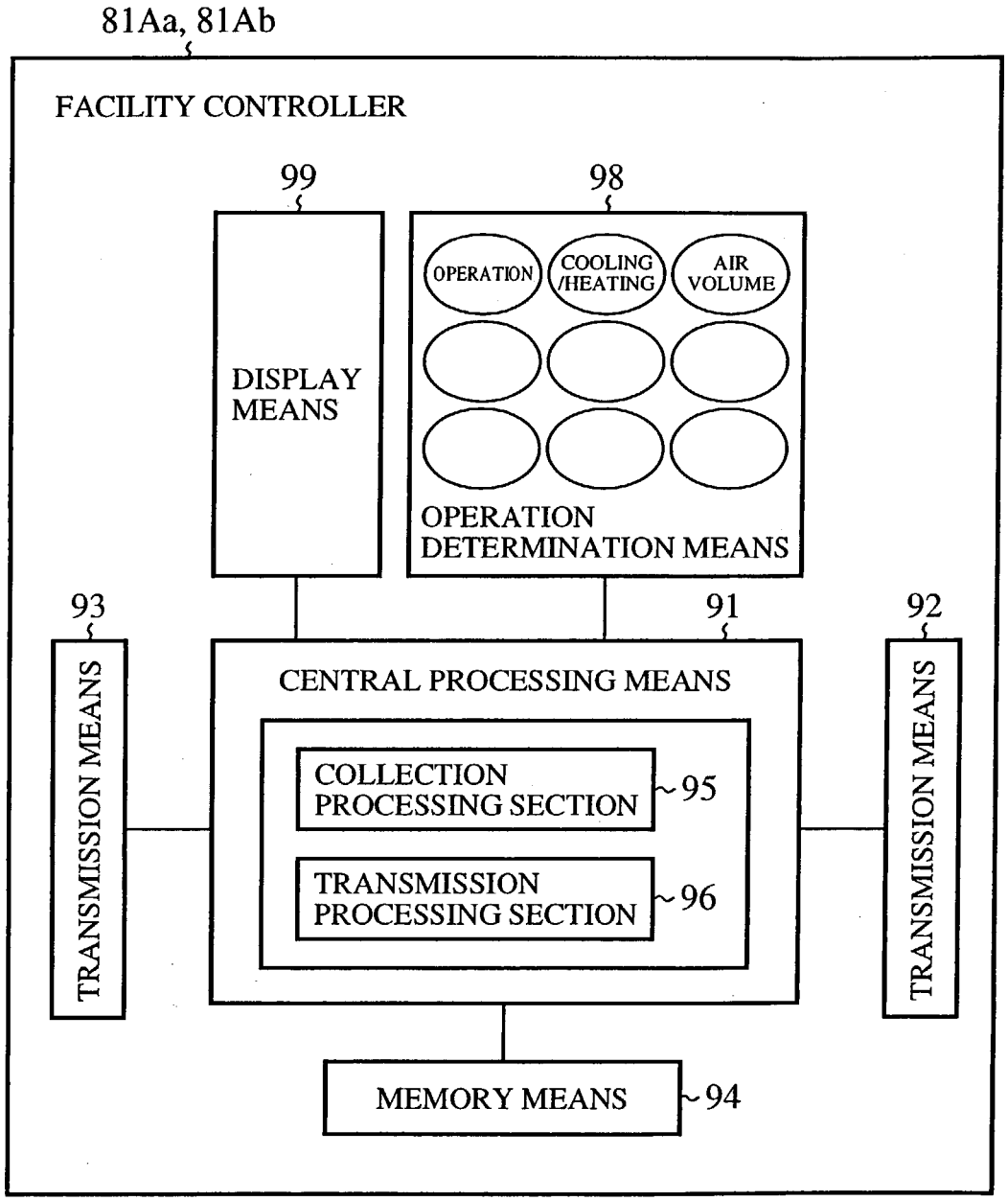
FIG. 50 is a block diagram showing an internal configuration of a facility controller in the air conditioner control system according to a twenty-first embodiment of the present invention.

FIG. 50 is a block diagram showing an internal configuration of the facility controllers 81Aa and 81Ab in the air conditioner control system according to the twenty-first embodiment. In FIG. 50, reference number 98 designates an operation handling means having switches, which are different on function, in order to operate the air conditioners. Reference number 99 denotes a display means for displaying the contents of the operation and the operation state of the air conditioners. Other system components have the same configuration of those in the air conditioner control system of the seventeenth embodiment shown in FIG. 42.

Next, a description will now be given of the operation of the air conditioner control system of the twenty-first embodiment.

The facility controllers 81Aa and 81Ab perform the same process, regarding the collection of the air conditioner information and the transmission thereof, of the facility controllers 81*a* and 81*b* of the seventeenth embodiment shown in FIG. 43. The remote monitor terminal 15 also performs the same process of that of the seventeenth embodiment shown in FIG. 54.

In the twenty-first embodiment, although the facility controllers 81Aa and 81Ab perform the same operation of the facility controllers 81*a* and 81*b* of the seventeenth embodiment shown in FIG. 43, the present invention is not limited by this configuration. For example, it is possible to perform the same process of the facility controllers of the eighteenth embodiment to twentieth embodiment shown in FIG. 45, FIG. 46, and FIG. 48.

As described above, the twenty-first embodiment has the same effect of the first embodiment. In addition, because the central remote controller and the facility controller are combined in function, it is possible to eliminate duplication between them such as the central processing means, the transmission means, a power source, and so on. This can reduce the entire fabrication cost and the placement area of the air conditioner control system.

Twenty-Second Embodiment

Figure 51:
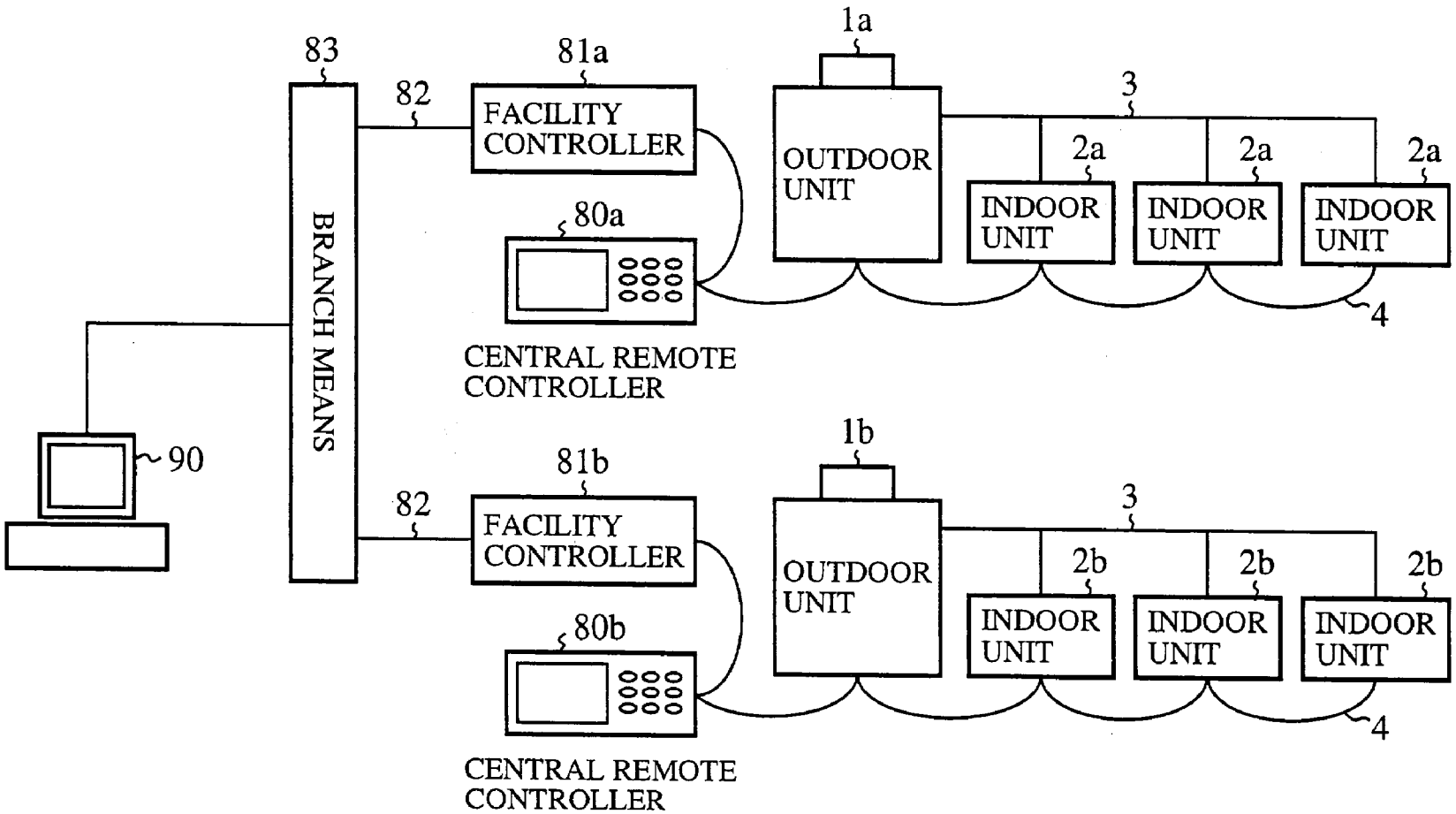
FIG. 51 is a block diagram showing a configuration of an air conditioner control system according to a twenty-second to twenty-fifth embodiments of the present invention.

FIG. 51 is a block diagram showing a configuration of an air conditioner control system according to the twenty-second embodiment of the present invention. In FIG. 51, the remote monitor terminal 90 is connected to the branch mean 83, which monitors and controls the operation of the air conditioners through the facility controllers 81*a* and 81*b*. Other components of the system shown in FIG. 51 have the same configuration of those in the air conditioner control system of the seventeenth embodiment shown in FIG. 41. In addition, each of the facility controllers 81*a* and 81*b* has the same configuration of that of the seventeenth embodiment shown in FIG. 42. However, in the twenty-second embodiment shown in FIG. 51, the transmission processing section 96 (see FIG. 42) in each of the facility controllers 81*a* and 81*b* transmits through the LAN built in a building, not using E-mail through the Internet, the air conditioner information collected by the collection processing section 95 (see FIG. 42). The remote monitor terminal 90 receives the air conditioner information transmitted.

Next, a description will now be given of the operation of the air conditioner control system of the twenty-first embodiment.

The facility controllers 81*a* and 81*b* perform the same processes of Step ST11 to Step ST14 in the seventeenth embodiment shown in FIG. 43. In Step ST15, the transmission processing section 96 transmits the air conditioner information stored in the memory means 94 through the transmission medium 47 and the branch means 83.

The remote monitor terminal 90 performs the same processes of the seventeenth embodiment shown in FIG. 44 other than the process of receiving E-mail in Step ST21. That is, at Step ST22, the remote monitor terminal 90 receives the air conditioner information, stores the received one into the memory means (not shown). At Step St23, the counter (not shown) is incremented by one (+1). At Step ST23, the remote monitor terminal 90 recognizes whether the value of the counter exceeds the predetermined value. When it does not exceed the predetermined value, the operation flow backs to Step ST22 and the following processes are repeated. When the value of the counter exceeds it, at Step ST25, in order to obtain the desired monitor information, the remote monitor terminal 90 calculates all of the air conditioner information obtained by the received processes. The number of the received processes is determined in advance.

As described above, according to the twenty-second embodiment, because the facility controllers 81*a* and 81*b* transmit the air conditioner information stored in the memory means 94 when the number of the received air conditioner information is reached to the predetermined value, it is not necessary to incorporate any additional memory in addition to the memory means 94 and to delete the old air conditioner information for the newly obtained air conditioner information.

Twenty-Third Embodiment

The air conditioner control system of the twenty-third embodiment has the same configuration of the twenty-second embodiment shown in the block diagram of FIG. 51 and the facility controllers 81*a* and 81*b* have the same internal configuration of those of the seventeenth embodiment shown in the block diagram of FIG. 42. However, in the twenty-third embodiment, like the twenty-second embodiment, the remote monitor terminal 90 receives the air conditioner information collected by the collection processing section 95 in each of the facility controllers 81*a* and 81*b* through a LAN built in a building, without using E-mail through the Internet.

Next, a description will now be given of the operation of the air conditioner control system of the twenty-third embodiment.

The facility controllers 81*a* and 81*b* perform the same processes of Step ST11 to Steps ST31, ST12, ST13, ST14, and ST15 in the eighteenth embodiment shown in FIG. 45. In Step ST15, the transmission processing section 96 transmits the air conditioner information stored in the memory means 94 to the remote monitor terminal 90 based on the instruction from the collection processing section 95 in each of the facility controllers 81*a* and 81*b* through the transmission medium 82 and the branch means 83. The remote monitor terminal 90 performs the same processes of that in the twenty-second embodiment.

As described above, the twenty-third embodiment has the same effect of the twenty-second embodiment. In addition, because the number of the air conditioners for the collection of the air conditioner information is limited, the remote monitor terminal 90 can collect the air conditioner information every time interval necessary for the analysis of abnormal state without hindering the communication for the normal control by the transmission medium 4 of a relatively low communication speed. It is also possible to introduce any additional dedicated analyzer.

Twenty-Fourth Embodiment

The air conditioner control system of the twenty-fourth embodiment has the same configuration of that of the twenty-second embodiment shown in FIG. 51. Each of the facility controller 81*a* and 81*b* has the same internal configuration of that of the seventeenth embodiment shown in FIG. 42.

Like the twenty-second embodiment, the facility controllers 81*a* and 81*b* transmit the air conditioner information collected by the collection processing section 95 to the remote monitor terminal 90 through a LAN built in a building, not using E-mail through the Internet.

Next, a description will now be given of the operation of the air conditioner control system of the twenty-fourth embodiment.

The facility controllers 81*a* and 81*b* perform the same processes of Steps ST41, ST12, ST13, ST14, and ST15 in the nineteenth embodiment shown in FIG. 46. In Step ST15, the transmission processing section 96 transmits the air conditioner information stored in the memory means 94 to the remote monitor terminal 90 based on the instruction from the collection processing section 95 in each of the facility controllers 81*a* and 81*b* through the transmission medium 82 and the branch means 83. The remote monitor terminal 90 performs the same processes of that in the twenty-second embodiment.

As described above, the twenty-fourth embodiment has the same effect of the twenty-second embodiment. In addition, because the collection processing section collects only the operation states of the air conditioner that informs (transmits) the condition state under the malfunction condition that is set in advance, it is thereby possible to limit the number of the air conditioners to collect the air conditioner information. Thereby, the remote monitor terminal 90 can collect the air conditioner information every time interval necessary for the analysis of abnormal state without hindering the communication for the normal control by the transmission medium 4 of a relatively low communication speed. It is also possible to introduce any additional dedicated analyzer.

Twenty-Fifth Embodiment

The air conditioner control system of the twenty-fifth embodiment has the same configuration of that of the twenty-second embodiment shown in FIG. 51. Each of the facility controller 81*a*-1 and 81*b*-1 has the same internal configuration of that of the twentieth embodiment shown in FIG. 47. However, in the twenty-fifth embodiment, like the twenty-second embodiment, the collection processing section 95 in each of the facility controllers 81*a*-1 and 81*b*-1 transmits the air condition information collected by the collection processing section 95 to the remote monitor terminal 90 through a LAN built in a building, not by E-mail through the Internet.

Next, a description will now be given of the operation of the air conditioner control system of the twenty-fifth embodiment.

The facility controllers 81*a*-1 and 81*b*-1 perform the same processes of Steps ST51, ST52, ST12, ST13, ST14, ST53, and ST54 in the twentieth embodiment shown in FIG. 48. In Step ST15, the transmission processing section 96 transmits the air conditioner information stored in the memory means 94 to the remote monitor terminal 90 based on the instruction from the collection processing section 95 in each of the facility controllers 81*a* and 81*b* through the transmission medium 82 and the branch means 83. Steps ST53 and ST54 performs the same processes of those in the twentieth embodiment.

As described above, the twenty-fifth embodiment has the same effect of the twenty-second embodiment. In addition, because the collection processing section collects only the operation states of the air conditioner during only the specified time length, it is thereby possible to limit the number of the air conditioners to collect the air conditioner information. Thereby, the remote monitor terminal 90 can collect the air conditioner information every time interval necessary for the analysis of abnormal state without hindering the communication for the normal control by the transmission medium 4 of a relatively low communication speed. It is also possible to introduce any additional dedicated analyzer.

Twenty-Sixth Embodiment

Figure 52:
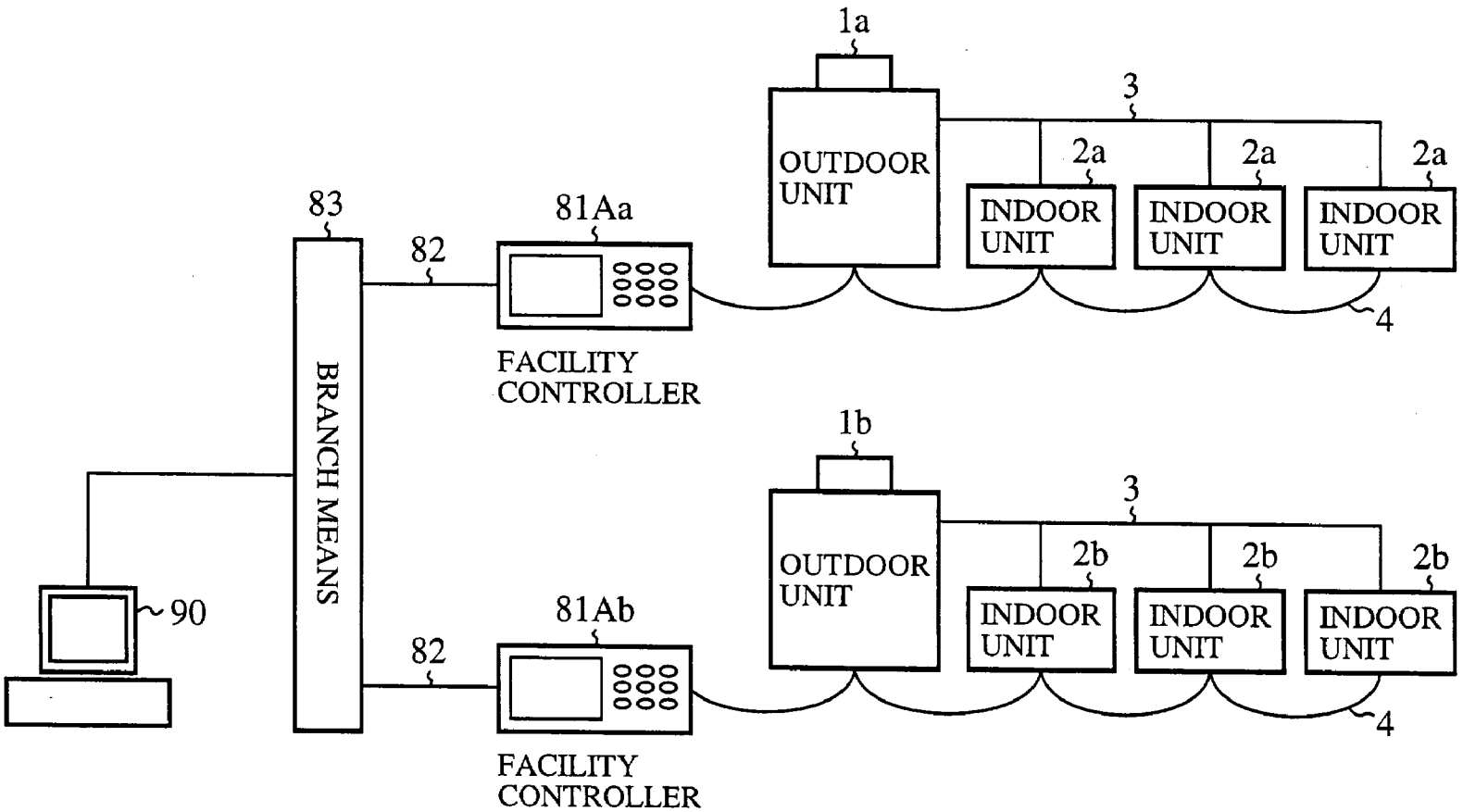
FIG. 52 is a block diagram showing a configuration of an air conditioner control system according to a twenty-sixth embodiment of the present invention.

FIG. 52 is a block diagram showing a configuration of an air conditioner control system according to a twenty-sixth embodiment of the present invention. In FIG. 52, reference number 90 designates a remote monitor terminal connected to the branch mean 83, which monitors and the controls the operation of the air conditioners through the facility controllers 81*a* and 81*n*. Other components of the system shown in FIG. 52 have the same configuration of those in the air conditioner control system of the twenty-first embodiment shown in FIG. 49. In addition, each of the facility controllers 81*a* and 81*b* has the same configuration of that of the twenty-first embodiment shown in FIG. 50. However, in the twenty-sixth embodiment shown in FIG. 52, like the twenty-second embodiment, the transmission processing section 96 in each of the facility controllers 81*a* and 81*b* transmits through the LAN built in a building, not using E-mail through the Internet, the air conditioner information collected by the collection processing section 95 in the facility controllers 81*a* and 81*b*. The remote monitor terminal 90 receives the air conditioner information transmitted.

Next, a description will now be given of the operation of the air conditioner control system of the twenty-sixth embodiment.

The facility controllers 81Aa and 81Ab perform the same processes of the collection of the air conditioner information and the transmission thereof of the facility controllers 81*a* and 81*b* in the twenty-second embodiment. In addition, the remote monitor terminal 90 of the twenty-sixth embodiment performs the same process of that of the remote monitor terminal 90 of the twenty-second embodiment.

In the twenty-sixth embodiment, although the facility controllers 81Aa and 81Ab perform the same processes of the facility controllers 81*a* and 81*b* of the twenty-second embodiment, the present invention is not limited by this configuration. For example, it is possible that those controllers 81Aa and 81Ab performs the processes of the facility controllers 81*a* and 81*b* of the twenty-third embodiment or twenty-fourth embodiment.

As described above, the twenty-sixth embodiment has the same effect of the twenty-second embodiment. In addition, because the central remote controller and the facility controller are combined in function, it is possible to eliminate duplication between them such as the central processing means, the transmission means, a power source, and so on. This can reduce the entire fabrication cost and the placement area of the air conditioner control system.

Twenty-Seventh Embodiment

Figure 53:
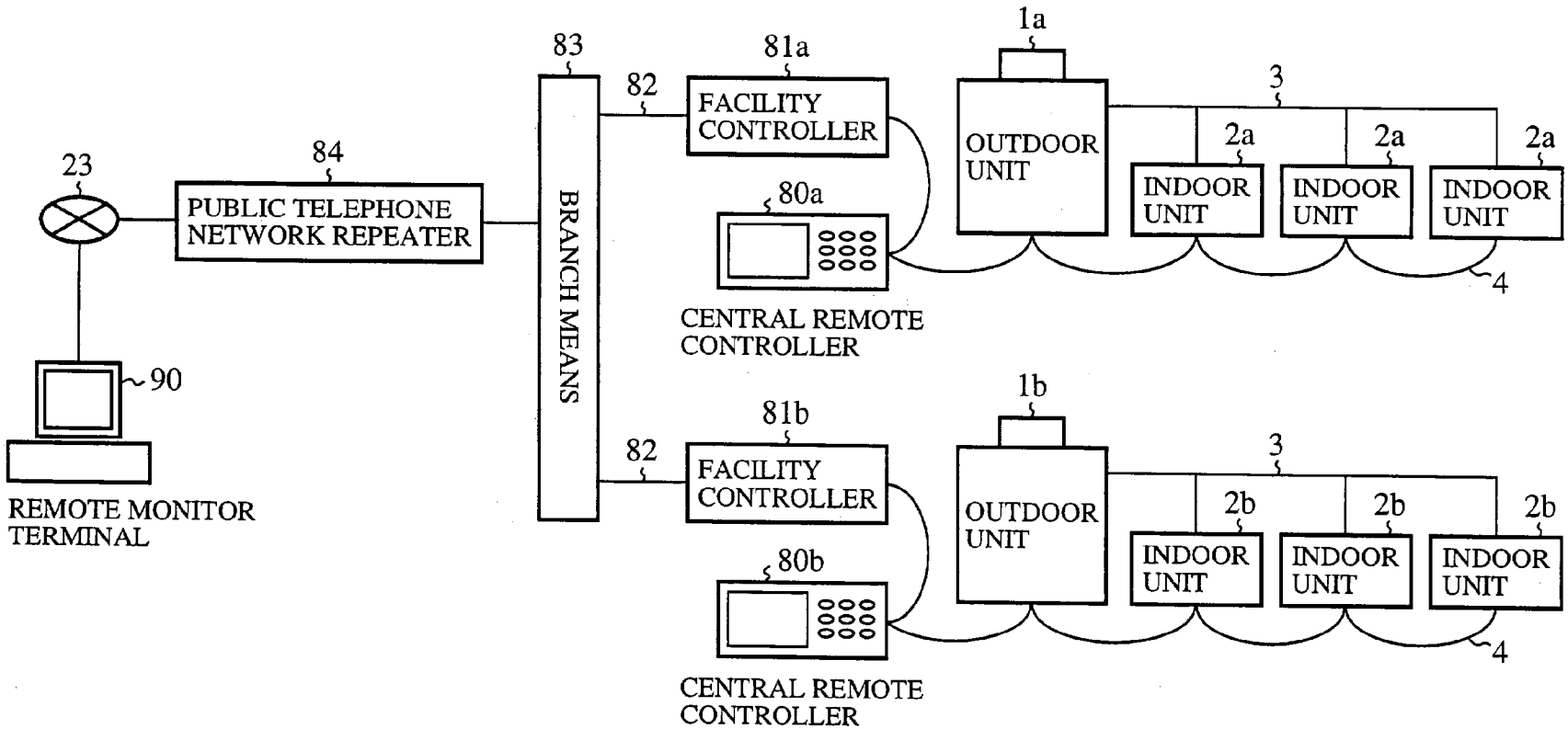
FIG. 53 is a block diagram showing a configuration of an air conditioner control system according to a twenty-seventh embodiment of the present invention.

FIG. 53 is a block diagram showing a configuration of an air conditioner control system according to a twenty-seventh embodiment of the present invention. In the configuration of the twenty-seventh embodiment, the remote monitor terminal 90 is connected to the branch means 83, the public telephone network repeater 84, and the public telephone network 23.

Next, a description will now be given of the operation of the air conditioner control system of the twenty-seventh embodiment.

The facility controllers 81*a* and 81*b* communicate with the remote monitor terminal 90 through the public telephone network repeater 84, and the public telephone network 23. Both the controllers 81*a* and 81*b* and the remote monitor terminal 90 performs the same processes in the twenty-second embodiment to twenty-fifth embodiment other than the process of the communication described above.

Figure 54:
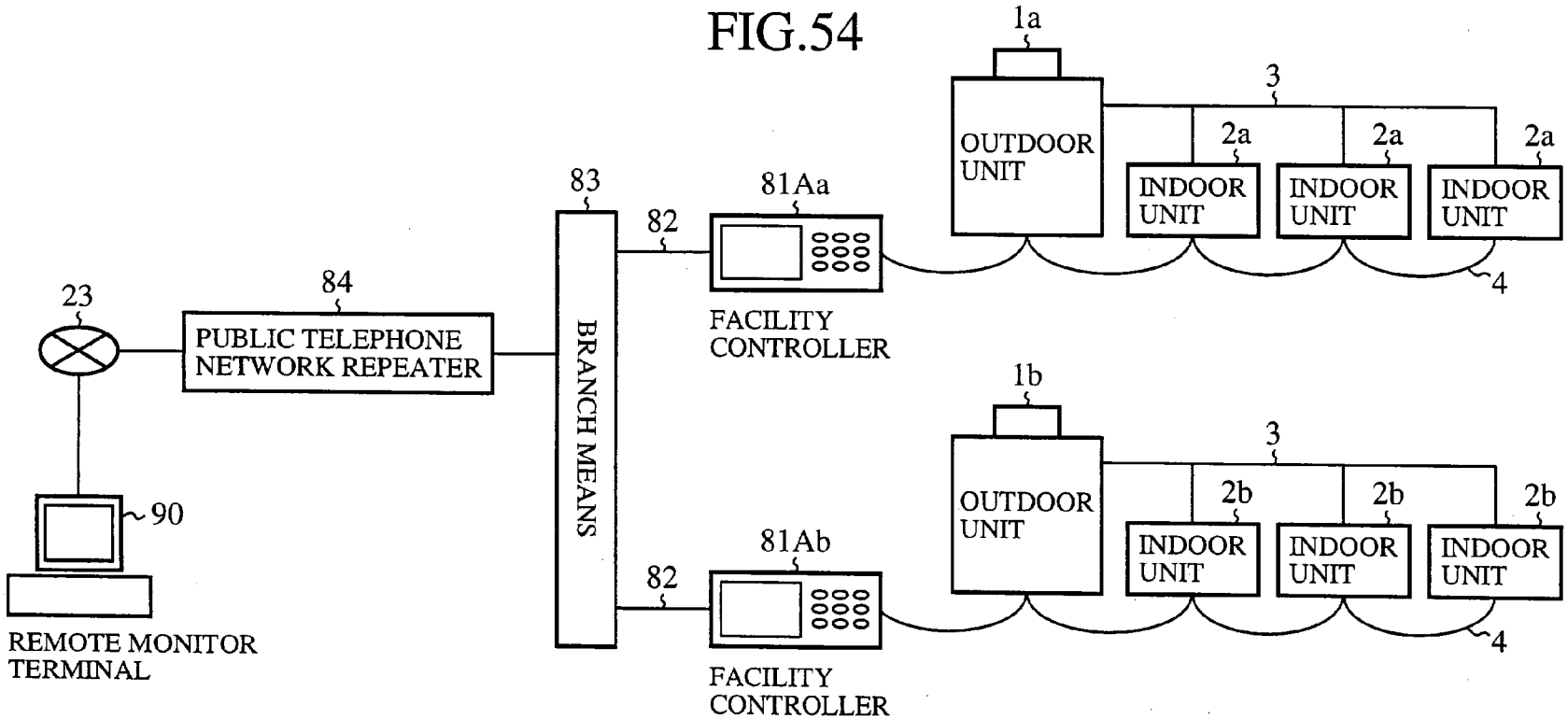
FIG. 54 is a block diagram showing another configuration of the air conditioner control system according to the twenty-seventh embodiment of the present invention.

In the twenty-seventh embodiment, the remote monitor terminal 90 of the twenty-second embodiment shown in FIG. 51 is connected to the facility controllers 81*a* and 81*b* through the branch means 83, the public telephone network repeater 84, and the public telephone network 23. The present invention is not limited by this configuration. For example, as shown in FIG. 54, it is possible to connect the remote monitor terminal 90 of the twenty-sixth embodiment shown in FIG. 52 to the facility controllers 81Aa and 81Ab though the branch means 83, the public telephone network repeater 84, and the public telephone network 23.

As described above, the twenty-seventh embodiment has the effect of each of the twenty-second embodiment to the twenty-sixth embodiment. In addition, in the twenty-seventh embodiment, it is not necessary to incorporate the remote monitor terminal 90 in the building where the air conditioners are mounted. It is thereby possible to monitor the state of the air conditioners and also to control the operation of them through the public telephone network 23 from another building that is separated in distance from the place where the air conditioners are mounted.

Twenty-Eighth Embodiment

Figure 55:
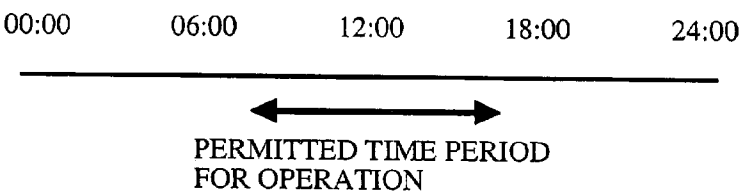
FIG. 55 is a diagram showing a process of each facility controller in the air conditioner control system according to the twenty-eighth embodiment.

The air conditioner control system of the twenty-eighth embodiment has the same configuration of the system of the seventeenth embodiment shown in FIG. 53. Each of the facility controller 81*a* and 81*b* has the same internal configuration of that of the twentieth embodiment shown in FIG. 47. FIG. 55 is a diagram showing a process of each of the facility controllers 81*a* and 81*b* in the air conditioner control system.

Next, a description will now be given of the operation of the air conditioner control system of the twenty-eighth embodiment.

The facility controllers 81*a* and 81*b* perform the same processes of collecting the air conditioner information and transmitting the collected information by the facility controllers 81*a* and 81*b* in the twentieth embodiment. In addition, the remote monitor terminal 90 in the twenty-eighth embodiment performs the same process of that of the remote monitor terminal 90 in the twenty-seventh embodiment.

When the facility controllers 81*a* and 81*b* are connected to the public telephone network 23, there is a possibility that a malevolent third person accesses the air conditioners through the facility controllers 81*a* and 81*b* without permission. In order to avoid an occurrence of the dangerous action, the central processing means 91 in each of the facility controllers 81*a* and 81*b* controls so that the remote monitor terminal 90 can accesses the air conditioners only during a daytime, not during a night time other than the day time, for example, shown in FIG. 55.

According to the twenty-eighth embodiment, although the air conditioner control system has the same configuration of the twenty-seventh embodiment shown in FIG. 53, the present invention is not limited by this configuration. For example, it is possible to have the same configuration shown in FIG. 54, or possible to have any one of the same configurations of the seventeenth embodiment to twentieth embodiment shown in FIG. 41 or the same configuration of the twenty-first embodiment shown in FIG. 49.

As described above, the twenty-eighth embodiment has the same effect of the twenty-seventh embodiment. In addition, because it is so controlled that the remote monitor terminal cannot access the air conditioners during the night time through the public telephone network 23, the twenty-eighth embodiment has the effect that any malevolent third person cannot access the air conditioners through the facility controllers 81*a* and 81*b* without permission.

Twenty-Ninth Embodiment

The air conditioner control system of the twenty-ninth embodiment has the same configuration of the system of the seventeenth embodiment shown in FIG. 53. Each of the facility controller 81*a* and 81*b* has the same internal configuration of that of the twentieth embodiment shown in FIG. 47.

Next, a description will now be given of the operation of the air conditioner control system of the twenty-eighth embodiment.

The facility controllers 81*a* and 81*b* perform the same processes of the collection of the air conditioner information and the transmission thereof of the facility controllers 81*a* and 81*b* in the twenty-seventh embodiment. In addition, the remote monitor terminal 90 of the twenty-ninth embodiment performs the same process of that of the remote monitor terminal 90 of the twenty-seventh embodiment.

Recently, because many offices use personal computers to generate heat, it is necessary to cool the offices during daytime hours even if it is a cold season. Further, it is necessary for the user to switch the heating and cooling every day. The twenty-ninth embodiment can increase the handing the above case for user's convenience.

Figure 56:
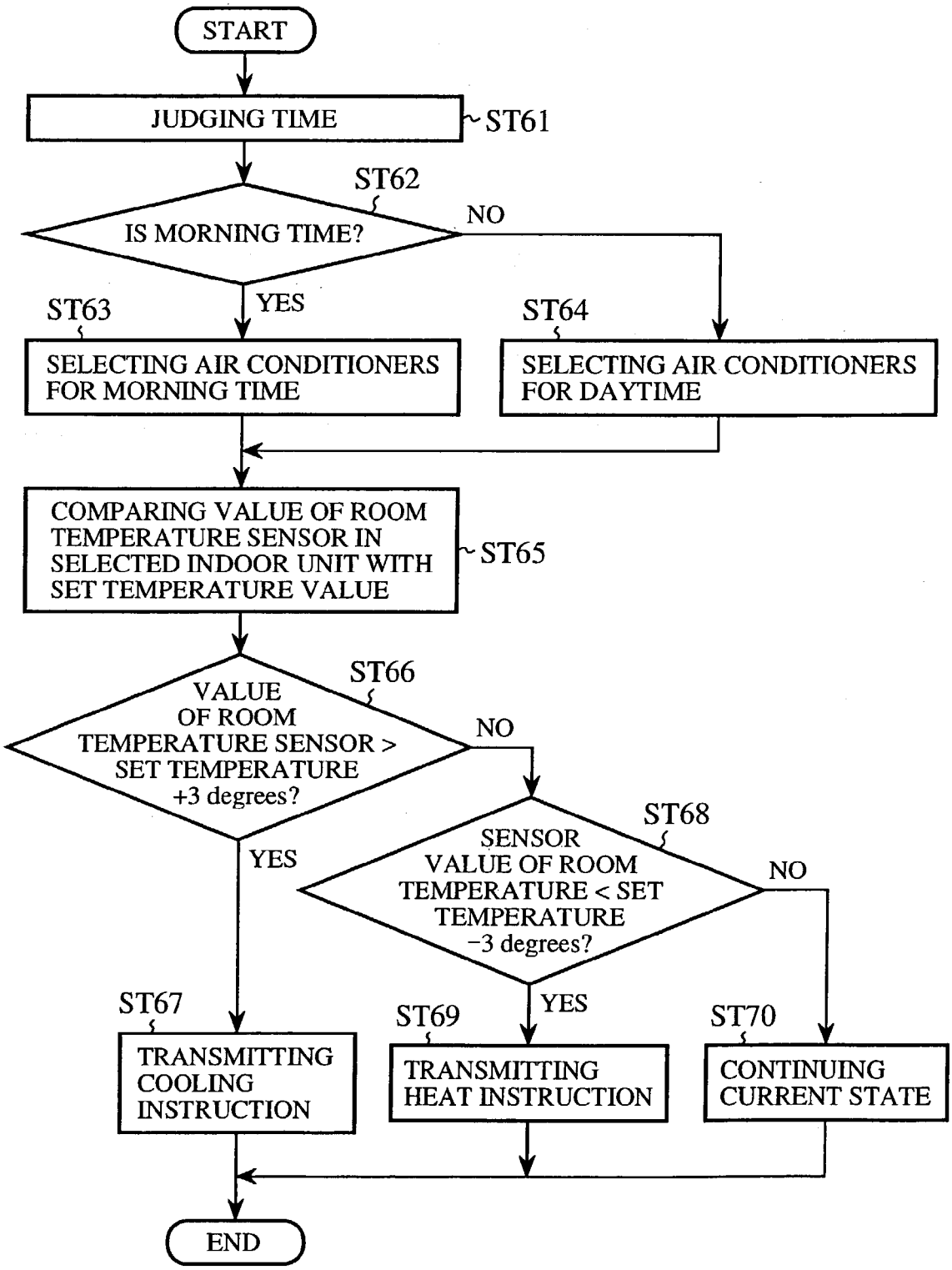
FIG. 56 is a flow chart showing a process of a facility controller in an air conditioner control system according to the twenty-ninth embodiment.
Figure 57:
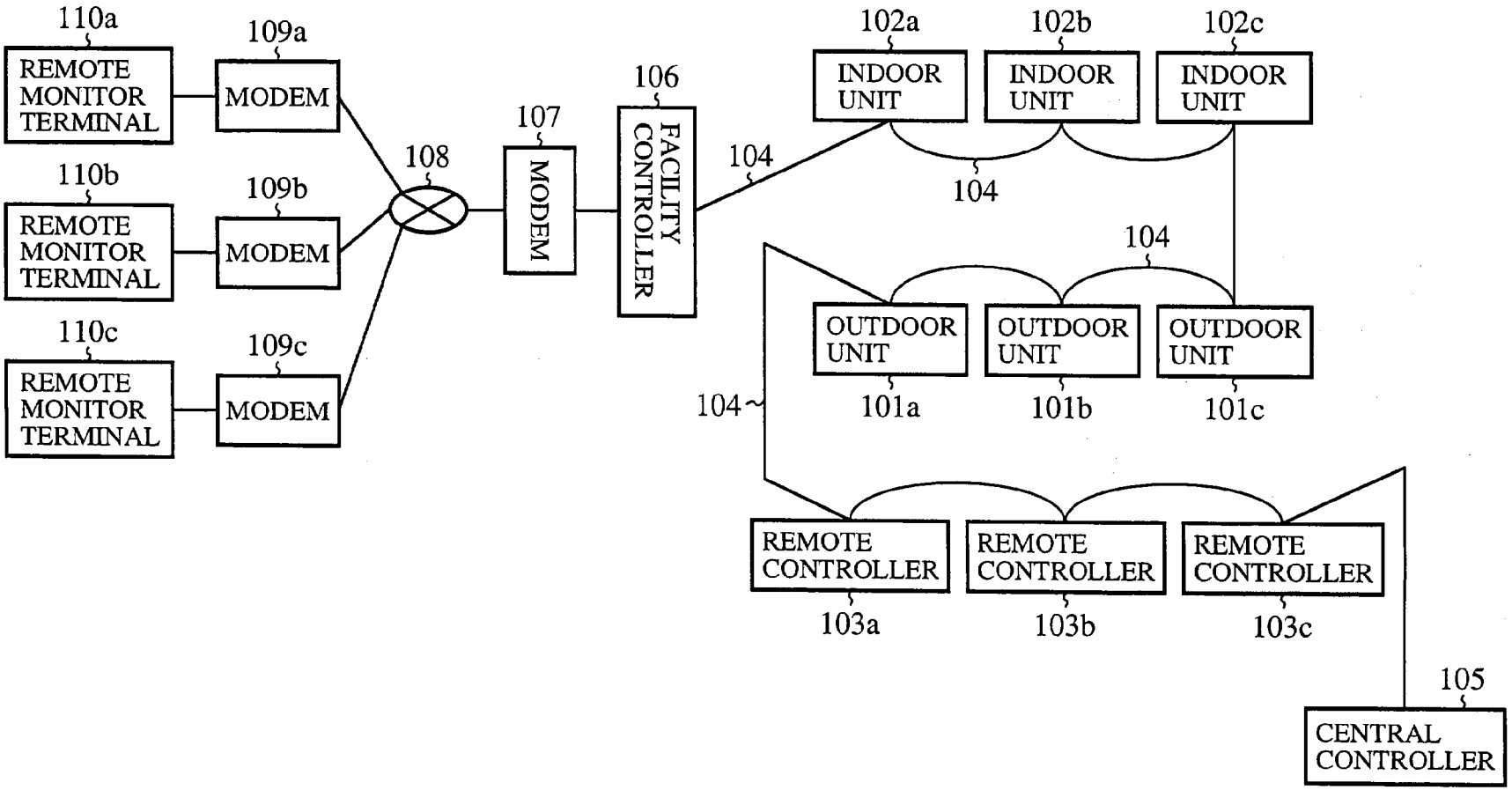
FIG.57 (PRIOR ART)
FIG. 57 is a block diagram showing a configuration of a conventional air conditioner control system.
Figure 58:
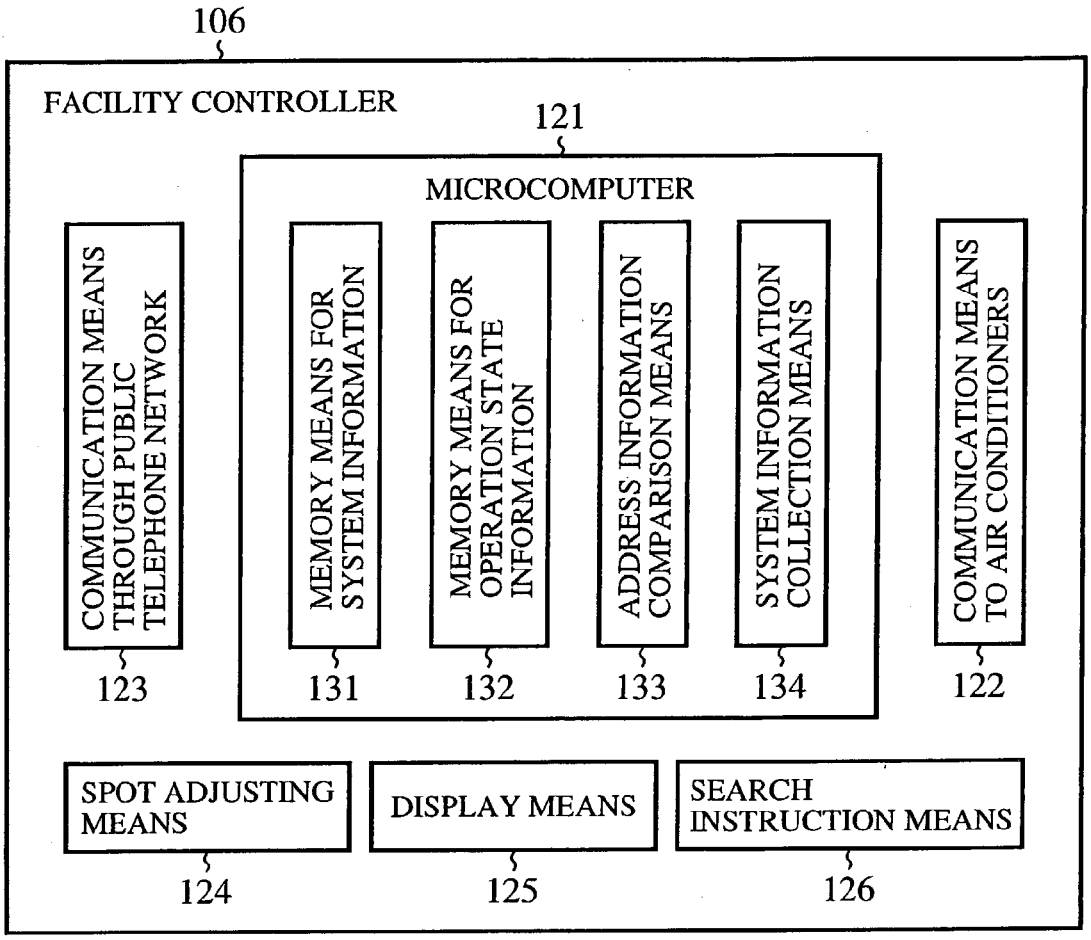
FIG.58 (PRIOR ART)
FIG. 58 is a block diagram showing an internal configuration of a facility controller in the conventional air conditioner control system.

FIG. 56 is a flow chart showing a process of each of the facility controllers 81*a* and 81*b* in the air conditioner control system according to the twenty-ninth embodiment.

At Step ST61, the central processing means 91 in each of the facility controllers 81*a* and 81*b* checks the value of the timer means 97. The judgment result at Step ST62 indicates the morning hours, the central processing means 91 selects the indoor unit 2 in the air conditioner whose operation condition is set for the morning hours. When the value of the timer means 97 as the judgment result indicates the daytime hours, at Step ST64, the central processing means 91 selects the indoor 2 in another air conditioner whose operation condition is set for the daytime hours.

At Step ST61, the central processing means 91 compares the value of the room temperature sensor in the selected indoor unit 2 with the value of the set temperature. At Step ST66, the central processing means 91 judges whether the current value of the room temperature sensor exceeds a target value of (the set temperature value +3 degrees). When the current value exceeds the target value, at Step ST67, the central processing means 91 instructs to initiate the cooling to the selected indoor unit 2. When it does not exceed the target value, at Step ST68, the central processing means 91 judges whether the current value of the room temperature sensor exceeds a target value (=the set temperature value −3 degrees). When the current value of the room temperature sensor is less than the target value, at Step ST69, the central processing means 91 instructs to initiate the heating to the selected indoor unit 2. When the current value of the room temperature sensor is not less than the target value, the central processing means 91 instructs to continue the current operation to the indoor unit 2.

In the twenty-ninth embodiment, although the air conditioner control system has the same configuration of that of the twenty-seventh embodiment shown in FIG. 53, it is possible to have the configuration of the air conditioner control system shown in FIG. 54, or possible to have any one of the configurations of the twenty-second to twenty-fifth embodiments shown in FIG. 51, of the configuration of the twenty-sixth embodiment shown in FIG. 52, of the configurations of the seventeenth embodiment to the twentieth embodiment shown in FIG. 41, and of the twenty-first embodiment shown in FIG. 49.

As described above, the twenty-ninth embodiment has the same effect of the twenty-seventh embodiment. In addition, because the user does not switch the cooling and heating each day, it is possible to improve the convenience to use the air conditioners by the user.

As set forth, according to the present invention, because it is not necessary to incorporate any dedicated devices and programs, and not necessary to do work, a distributor, a maintenance technician, and a facility designer can handle the air conditioner control system easily, and it is possible to reduce the construction cost or the maintenance cost of the air conditioner control system as large as possible.

In addition, the present invention has the effect that it is possible to realize the air conditioner control system capable of operating facilities and devices with a low cost that are mounted together with the air conditioners after the initial installation without any adding control devices of a high price.

Furthermore, the present invention has the effect that it is not necessary to increase the size of the memory storage in the facility controllers and it is possible to use the preceding air conditioner information without deleting the preceding information.

Still furthermore, the present invention has the effect that it is possible to send various information to the places of a plurality of destination addresses without increasing the telephone charge and regardless of the presence of a usable telephone line (without checking the presence of the usable telephone line (not busy line) and regardless of checking whether the remote monitor terminal is used for another application, and it is not necessary to incorporate any dedicated telephone line and to install any dedicated remote monitor terminal.

While the above provides a full and complete disclosure of the preferred embodiments of the present invention, various modifications, alternate constructions and equivalents may be employed without departing from the scope of the invention. Therefore the above description and illustration should not be construed as limiting the scope of the invention, which is defined by the appended claims.

What is claimed is:

1. An air conditioner control system comprising:

an air conditioner comprising an outdoor unit and an indoor unit;

a central remote controller handling operation of the air conditioner and collecting operation information of the air conditioner; and a remote monitor terminal monitoring operation state of the air conditioner and controlling the operation of the air conditioner, wherein the central remote controller comprises:

first transmission means to communicate with the air conditioner;

second transmission means to communicate with remote monitor terminal;

an operation information processing section processing operation information from operation setting means, each of which is independent in function, transmitting the operation information to the air conditioner through the first transmission means, collecting the operation information of the air conditioner received through the first transmission means, generating screen information based on the collected operation information of the air conditioner, and displaying the screen information on a display means; and a management information processing section generating screen information based on the operation information of the air conditioner collected through the first transmission means, transmitting the screen information to the remote monitor terminal through the second transmission means, relaying control information transmitted from the remote monitor terminal through the second transmission means, and transmitting the control information to the air conditioner through the first transmission means, wherein the remote monitor terminal displays the screen information transferred from the central remote controller.

2. The air conditioner control system as claimed in claim 1, wherein the central remote controller comprises a plurality of central remote controllers, and each of the central remote controllers connected to the corresponding air conditioner is connected to the remote monitor terminal through a branch means.

3. The air conditioner control system as claimed in claim 1, wherein the central remote controller comprises a plurality of central remote controllers, and each of the central remote controllers connected to the corresponding air conditioner is connected to the remote monitor terminal through a branch means and a public telephone network.

4. The air conditioner control system as claimed in claim 1, wherein the central remote controller comprises a plurality of central remote controllers, and each of the central remote controllers connected to the corresponding air conditioner is connected to the remote monitor terminal through a branch means and public telephone networks, and Internet, wherein the management information processing section in each central remote controller generates E-mail information regarding the operation information transferred from the air conditioner and the control information transmitted from the remote monitor terminal, and transmits the E-mail information to a cellular phone terminal connected to the remote monitor terminal or the Internet.

5. The air conditioner control system as claimed in claim 1, further comprises first and second facility devices placed together with the air conditioner, wherein the central remote controller transmits to the air conditioner a request in order to monitor the first facility device based on a facility device control procedure for controlling the operation of the first and second facility devices stored in the central remote controller, and controls the operation of the second facility device or the air conditioner according to the state of the first facility device informed through the air conditioner.

6. The air conditioner control system as claimed in claim 5, wherein the remote monitor terminal, to be also used as an initial setting tool, transmits the facility device control procedure to the central remote controller, and the central remote controller receives and stores the facility device control procedure.

7. An air conditioner control system comprising:

an air conditioner comprising an outdoor unit and an indoor unit;

a central remote controller handling operation of the air conditioner and collecting operation information of the air conditioner; and a remote monitor terminal monitoring operation state of the air conditioner and controlling the operation of the air conditioner, wherein the central remote controller comprises:

first transmission means to communicate with the air conditioner;

second transmission means to communicate with remote monitor terminal;

an operation information processing section processing operation information from operation setting means, each of which is independent in function, transmitting the operation information to the air conditioner through the first transmission means, collecting the operation information of the air conditioner received through the first transmission means, generating screen information based on the collected operation information of the air conditioner, and displaying the screen information on a display means; and a management information processing section relaying the operation information of the air conditioner collected through the first transmission means, transmitting the screen information to the remote monitor terminal through the second transmission means, relaying control information transmitted from the remote monitor terminal through the second transmission means, and transmitting the control information to the air conditioner through the first transmission means, wherein the remote monitor terminal generates screen information based on the operation information transferred from the central remote controller and displays the screen information.

8. An air conditioner control system comprising:

first air conditioners comprising outdoor units and indoor units;

first central remote controllers handling operation of the first air conditioners and collecting operation information of the first air conditioners; and a second air conditioner comprising an outdoor unit and an indoor unit;

a second central remote controller handling operation of the second air conditioner and collecting operation information of the second air conditioner; and a remote monitor terminal monitoring operation state of the first and second air conditioners and controlling the operation of the first and second air conditioners through a public telephone network, wherein the first central remote controllers collect the operation information of the first air conditioners and transmit the operation information to the second central remote controller through a branch means, the second central remote controller generates screen information based on the operation information of the first air conditioners collected by the first central remote controllers and the operation information of the second air conditioner, and transmits the screen information to the remote monitor terminal through the public telephone network, and the remote monitor terminal receives and displays the screen information transmitted from the second central remote controller.

9. The air conditioner control system as claimed in claim 8, wherein the second central remote controller comprises:

first transmission means to communicate with the second air conditioner;

second transmission means to communicate with the first central remote controllers;

third transmission means to communicate with the remote monitor terminal through the public telephone network;

an operation information processing section processing operation information from operation setting means, each of which is independent in function, transmitting the operation information to the second air conditioner through the first transmission means, collecting the operation information of the second air conditioner through the first transmission means, generating screen information based on the collected operation information of the second air conditioner, and displaying the screen information on a display means; and a management information processing section generating a screen information based on the operation information of the first air conditioners obtained from the first central remote controllers through the second transmission means and the operation information of the second air conditioner obtained through the first transmission means, transmitting the screen information to the remote monitor terminal through the third transmission means, relaying control information transmitted from the remote monitor terminal through the third transmission means, transmitting the control information to the second air conditioner through the first transmission means, and transmitting the control information to the first central remote controllers through the second transmission means.

10. The air conditioner control system as claimed in claim 8, wherein the second central remote controller is connected to the remote monitor terminal through public telephone networks and Internet, wherein the second central remote controller generates E-mail information regarding the operation information transferred from the first and second air conditioners and the control information transmitted from the remote monitor terminal, and transmits the E-mail information to a cellular phone terminal connected to the remote monitor terminal or the Internet.

11. The air conditioner control system as claimed in claim 8, wherein the first central remote controllers are mounted on a control panel and the second central remote controller is mounted on an operation panel mounted outside of or mounted on the control panel.

12. An air conditioner control system comprising:

first air conditioners comprising outdoor units and indoor units;

first central remote controllers handling operation of the first air conditioners and collecting operation information of the first air conditioners; and a second air conditioner comprising an outdoor unit and an indoor unit;

a second central remote controller handling operation of the second air conditioner and collecting operation information of the second air conditioner; and a remote monitor terminal monitoring operation state of the first and second air conditioners and controlling the operation of the first and second air conditioners through a public telephone network, wherein the first central remote controllers collect the operation information of the first air conditioners and transmit the collected operation information to the second central remote controller through a branch means, the second central remote controller relays the operation information of the first air conditioners transferred from the first central remote controllers and the operation information of the second air conditioner, and transmits both the operation information to the remote monitor terminal, and the remote monitor terminal receives both the operation information, generates screen information based on both the operation information, and displays the screen information generated.

13. The air conditioner control system as claimed in claim 12, wherein the second central remote controller comprises:

first transmission means to communicate with the second air conditioner;

second transmission means to communicate with the first central remote controllers;

third transmission means to communicate with the remote monitor tenninal through the public telephone network;

an operation information processing section processing operation information from operation setting means, each of which is independent in function, generating screen information based on the operation information of the second air conditioners transmitted through the first transmission means, and displaying the screen information on a display means; and a management information processing section relaying the operation information of the first air conditioners collected by the first central remote controllers and received through the second transmission means and the operation information of the second air conditioner received through the first transmission means, transmitting both the screen information to the remote monitor terminal through the third transmission means, relaying control information transmitted from the remote monitor terminal through the third transmission means, and transmitting the control information to the second air conditioner through the first transmission means and to the second central relay controllers through the second transmission means.

14. An air conditioner control system comprising:

a plurality of air conditioners comprising outdoor units and indoor units;

a plurality of central remote controllers handling operation of the air conditioners and collecting operation information of the air conditioners;

an information relay unit receiving the operation information of the air conditioners collected by the central remote controllers; and a remote monitor terminal monitoring operation state of the air conditioner through a public telephone network and controlling the operation of the air conditioner through the public telephone network, wherein the central remote controllers transmit the collected operation information of the air conditioners to the information relay unit through a branch means, the information relay unit receives the operation information transmitted from the central remote controllers and generates a screen information based on the operation information received, and transmits the screen information to the remote monitor terminal through the public telephone network, and the remote monitor terminal receives the screen information and displays the screen information received.

15. The air conditioner control system as claimed in claim 14, wherein the information relay unit comprises:

first transmission means to communicate with a plurality of the central remote controllers;

second transmission means to communicate with the remote monitor terminal through the public telephone network; and a management information processing section generating screen information based on the operation information of the air conditioners, which is collected by the central remote controllers, received through the first transmission means, transmitting the screen information to the remote monitor terminal through the second transmission means, relaying control information transmitted from the remote monitor terminal through the second transmission means, and transmitting the received control information to the central remote controllers through the first transmission means.

16. The air conditioner control system as claimed in claim 14, wherein the information relay unit is connected to the remote monitor terminal through public telephone networks and Internet, and the information relay unit generates E-mail information regarding the operation information of the air conditioners and the control information transferred from the remote monitor terminal, and transmits the E-mail information to a cellular phone connected to the remote monitor terminal or the Internet.

17. An air conditioner control system comprising:

a plurality of air conditioners comprising outdoor units and indoor units;

a plurality of central remote controllers handling operation of the air conditioners and collecting operation information of the air conditioners;

an information relay unit receiving the operation information of the air conditioners collected by the central remote controllers; and a remote monitor terminal monitoring operation state of the air conditioner through a public telephone network and controlling the operation of the air conditioner through the public telephone network, wherein the central remote controllers transmit the collected operation information of the air conditioners to the information relay unit through a branch means, the information relay unit receives the operation information transmitted from the central remote controllers, and transmits the operation information to the remote monitor terminal through the public telephone network, and the remote monitor terminal receives the operation information transmitted from the information relay unit, generates a screen information based on the operation information received, and displays the screen information generated.

18. The air conditioner control system as claimed in claim 17, wherein the information relay unit comprises:

first transmission means to communicate with a plurality of the central remote controllers;

second transmission means to communicate with the remote monitor terminal through the public telephone network; and a management information processing section relaying the operation information of the air conditioners from the central remote controllers through the first transmission means, transmitting the operation information to the remote monitor terminal through the second transmission means, receiving and relaying the control information transferred from the remote monitor terminal through the second transmission means, and transmitting the control information to the central remote controllers through the first transmission means.

19. An air conditioner control system comprising:

a plurality of air conditioners comprising outdoor units and indoor units;

a plurality of central remote controllers handling operation of the air conditioners and collecting operation information of the air conditioners;

first and second facility devices placed together with the air conditioners;

a third facility device to be added and placed after installation of the air conditioner control system; and a facility management device, connected to the central remote controllers through a branch means, controlling operation of the third facility device;

wherein the facility management device transmits to the air conditioner a request to monitor the first facility device through the central remote controllers based on facility device control procedure stored in the facility management device, and controls the operation of the second facility device, the third facility device, and the air conditioners according to a state of the first facility device informed from the air conditioner.

20. An air conditioner control system comprising:

an air conditioner comprising an outdoor unit and an indoor unit;

a central remote controller handling operation of the air conditioner and collecting operation information of the air conditioner; and a facility device to be added and placed after installation of the air conditioner control system;

a facility management device, connected to the central remote controller through a branch means, controlling operation of the facility device; and a remote monitor terminal monitoring operation state of the air conditioner and controlling the operation of the air conditioner, wherein the central remote controller generates screen information based on information regarding the facility device collected by the facility management device, and transmits the screen information to the remote monitor terminal, and the remote monitor terminal receives the screen information and displays the screen information received.

21. A central remote controller controlling operation of an air conditioner comprising an outdoor unit and an indoor unit, and collecting operation information of the air conditioner, the central remote controller comprising:

first transmission means to communicate with the air conditioner;

second transmission means through which an operation state of the air conditioner is monitored, and to communicate with remote monitor terminal;

an operation information processing section processing operation information from operation setting means, each of which is independent in function, transmitting the operation information to the air conditioner through the first transmission means, collecting the operation information of the air conditioner received through the first transmission means, generating screen information based on the collected operation information of the air conditioner, and displaying the screen information on a display means; and a management information processing section generating screen information, to be displayed by the remote monitor terminal, based on the operation information of the air conditioner collected through the first transmission means, transmitting the screen information to the remote monitor terminal through the second transmission means, relaying control information transmitted from the remote monitor terminal through the second transmission means, and transmitting the control information to the air conditioner through the first transmission means.

22. The central remote controller as claimed in claim 21, wherein the central remote controller is connected to the remote monitor terminal through a public telephone network.

23. A central remote controller controlling operation of an air conditioner comprising an outdoor unit and an indoor unit, and collecting operation information of the air conditioner, the central remote controller comprising:

first transmission means to communicate with the air conditioner;

second transmission means through which an operation state of the air conditioner is monitored, and to communicate with remote monitor terminal;

an operation information processing section processing operation information from operation setting means, each of which is independent in function, transmitting the operation information to the air conditioner through the first transmission means, collecting the operation information of the air conditioner received through the first transmission means, generating screen information based on the collected operation information of the air conditioner, and displaying the screen information on a display means; and a management information processing section relaying the operation information of the air conditioner collected through the first transmission means, transmitting the screen information to the remote monitor terminal, in order to display the screen information thereon, through the second transmission means, relaying control information transmitted from the remote monitor terminal through the second transmission means, and transmitting the control information to the air conditioner through the first transmission means.

24. An air conditioner control system comprising:

air conditioners comprising outdoor units and indoor units;

facility controllers handling operation of the air conditioners and monitoring an operation state of the air conditioners, collecting air conditioner information regarding the operation, storing the collected air conditioner information to memory means, and transmitting the air conditioner information stored in the memory means when the number of collection operations is reached to a predetermined value greater than one; and a remote monitor terminal receiving the air conditioner information transmitted from the facility controllers and monitoring the operation of the air conditioners, wherein the facility controllers transmit an E-mail including the air conditioner information stored in the memory means to a remote monitor terminal when the number of collections of the air conditioner information is reached to a predetermined value, and the remote monitor terminal receives the E-mail including the air conditioner information transmitted from the facility controllers and monitors the operation of the air conditioners based on the air conditioner information received.

25. The air conditioner control system as claimed in claim 24, further comprises central remote controllers through which the remote monitor terminal controls the operation of the air conditioners and monitors the operation state of the air conditioners.

26. The air conditioner control system as claimed in claim 24, wherein the facility controllers collect the air conditioner information from the air conditioners which are specified in advance.

27. The air conditioner control system as claimed in claim 24, wherein the facility controllers collect the air conditioner information from the air conditioners which have transmitted the air conditioner information satisfying a predetermined condition.

28. The air conditioner control system as claimed in claim 24, wherein the facility controllers have a timer means, and the facility controllers collect the air conditioner information from the air conditioners according to the time counted by the timer means.

29. The air conditioner control system as claimed in claim 24, wherein the facility controllers have a timer means, and the facility controllers provides an instruction to initiate the operation of the remote monitor terminal connected to the public telephone network and an instruction to accept the control by the remote monitor terminal.

30. The air conditioner control system as claimed in claim 24, wherein the facility controllers have a timer means, and the air conditioner is selected according to a time value counted by the timer means, and the facility controllers transmit a cooling instruction and a heating instruction to the indoor units, which are selected according to the time value of the timer means, based on a room temperature and a set temperature of the indoor units.

31. The air conditioner control system as claimed in claim 24, wherein the facility controllers are connected to the remote monitor terminal through the public telephone network.

32. A facility controller collecting air conditioner information regarding operation of air conditioners comprising outdoor units and indoor units, comprising:

a collection processing section collecting the air conditioner information regarding the operation of the air conditioners and storing the information into memory means, and instructing to transmit the air conditioner information stored in the memory means when the number of collections of the air conditioner information is reached to a predetermined value greater than one; and a transmission processing section receiving the instruction from the collection processing section and transmitting the air conditioner information stored in the memory means based on the instruction received, wherein the transmission processing section transmits an E-mail including the air conditioner information stored in the memory means.

33. The facility controller as claimed in claim 32, further comprising:

operation handling means to drive the air conditioners; and display means displaying an operation state of the air conditioners.

34. The facility controller as claimed in claim 32, wherein the collection processing section collects the air conditioner information of the air conditioners previously specified.

35. The facility controller as claimed in claim 32, wherein the collection processing section collects the air conditioner information of the air conditioner which has transmitted the air conditioner information that satisfies a predetermined condition.

36. The facility controller as claimed in claim 32, further comprising a timer means counting a time, wherein the collection processing section collects the air conditioner information of the air conditioner which is specified previously according to the time counted by the counter means.

37. The facility controller as claimed in claim 32, further comprising a timer means counting a time, wherein the operation of the air conditioners is controlled by an outside device through the public telephone network according to the time counted by the counter means.

38. The facility controller as claimed in claim 32, further comprising a timer means counting a time, wherein the facility controller selects the indoor unit according to the time counted by the timer means, and the facility controller transmits a cooling instruction and a heating instruction to the indoor unit according to a room temperature and a set temperature.

* * * * *